US006397017B1

(12) United States Patent
Sakai et al.

(10) Patent No.: US 6,397,017 B1
(45) Date of Patent: May 28, 2002

(54) DEVELOPER AMOUNT DETECTING METHOD, DEVELOPING DEVICE, PROCESS CARTRIDGE AND ELECTROPHOTOGRAPHIC IMAGE FORMING APPARATUS

(75) Inventors: Hiroaki Sakai; Kazushi Watanabe, both of Mishima; Toshiyuki Karakama, Shizuoka-ken; Masaru Shimura, Numazu; Hideki Matsumoto, Mishima; Seiji Saito, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/633,256

(22) Filed: Aug. 4, 2000

(30) Foreign Application Priority Data

Aug. 6, 1999 (JP) ..... 11-223338

(51) Int. Cl.[7] ..... G03G 15/00; G03G 15/08

(52) U.S. Cl. ..... 399/27

(58) Field of Search ..... 399/27, 61; 73/304 C; 340/617

(56) References Cited

U.S. PATENT DOCUMENTS

| | | | | |
|---|---|---|---|---|
| 3,575,130 A | * | 4/1971 | Altmann | 340/617 |
| 5,095,335 A | | 3/1992 | Watanabe et al. | 355/200 |
| 5,151,734 A | | 9/1992 | Tsuda et al. | 355/200 |
| 5,160,966 A | * | 11/1992 | Shiina et al. | 399/27 |
| 5,208,634 A | | 5/1993 | Ikemoto et al. | 355/215 |
| 5,223,893 A | | 6/1993 | Ikemoto et al. | 355/200 |
| 5,294,960 A | | 3/1994 | Nomura et al. | 355/210 |
| 5,331,372 A | | 7/1994 | Tsuda et al. | 355/200 |
| 5,345,294 A | | 9/1994 | Nomura et al. | 355/200 |
| 5,404,198 A | | 4/1995 | Noda et al. | 355/200 |
| 5,455,665 A | | 10/1995 | Baba et al. | 355/298 |
| 5,463,446 A | | 10/1995 | Watanabe et al. | 355/200 |
| 5,465,136 A | | 11/1995 | Watanabe | 355/210 |
| 5,470,635 A | | 11/1995 | Shirai et al. | 428/131 |
| 5,475,470 A | | 12/1995 | Sasago et al. | 355/210 |
| 5,488,459 A | | 1/1996 | Tsuda et al. | 355/211 |
| 5,500,714 A | | 3/1996 | Yashiro et al. | 355/200 |
| 5,510,878 A | | 4/1996 | Noda et al. | 355/211 |
| 5,543,898 A | | 8/1996 | Shishido et al. | 355/210 |
| 5,561,504 A | | 10/1996 | Watanabe et al. | 355/215 |
| 5,583,613 A | | 12/1996 | Kobayashi et al. | 355/200 |
| 5,585,895 A | | 12/1996 | Yashiro et al. | 355/215 |
| 5,602,623 A | | 2/1997 | Nishibata et al. | 399/111 |
| 5,608,509 A | | 3/1997 | Shirai et al. | 399/351 |
| 5,617,579 A | | 4/1997 | Yashiro et al. | 399/114 |
| 5,623,328 A | | 4/1997 | Tsuda et al. | 399/111 |
| 5,640,650 A | | 6/1997 | Watanabe et al. | 399/117 |
| 5,655,174 A | * | 8/1997 | Hirst | 399/27 |
| 5,659,847 A | | 8/1997 | Tsuda et al. | 399/113 |
| 5,669,042 A | | 9/1997 | Kobayashi et al. | 399/111 |
| 5,689,774 A | | 11/1997 | Shishido et al. | 399/111 |
| 5,749,027 A | | 5/1998 | Ikemoto et al. | 399/113 |
| 5,768,658 A | | 6/1998 | Watanabe et al. | 399/111 |

(List continued on next page.)

FOREIGN PATENT DOCUMENTS

JP 2000-206774 * 7/2000

*Primary Examiner*—Joan Pendegrass
(74) *Attorney, Agent, or Firm*—Fitzpatrick, Cella, Harper & Scinto

(57) ABSTRACT

A developer amount detecting method for detecting a developer amount for developing an electrostatic latent image formed on an electrophotographic photosensitive member includes a first process for successively detecting the amount of the developer contained in a containing portion by counting the number of individual image signals for forming dots of an image by a main body of an electrophotographic image forming apparatus; and a second process for successively detecting the developer amount by the apparatus main body by transmitting an electric signal according to the amount of the developer contained in the containing portion to the apparatus main body.

66 Claims, 49 Drawing Sheets

U.S. PATENT DOCUMENTS 5,768,660 A 6/1998 Kurihara et al. ..... 399/111
5,774,766 A 6/1998 Karakama et al. ..... 399/111
5,790,923 A 8/1998 Oguma et al. ..... 399/106
5,794,101 A 8/1998 Watanabe et al. ..... 399/103
5,809,374 A 9/1998 Tsuda et al. ..... 399/111
5,812,909 A 9/1998 Oguma et al. ..... 399/103
5,828,928 A 10/1998 Sasago et al. ..... 399/111
5,878,304 A 3/1999 Watanabe et al. ..... 399/92
5,878,310 A 3/1999 Noda et al. ..... 399/117
5,884,124 A 3/1999 Karakama et al. ..... 399/123
5,890,036 A 3/1999 Karakama et al. ..... 399/119
5,899,602 A 5/1999 Noda et al. ..... 399/111
5,903,803 A 5/1999 Kawai et al. ..... 399/116
5,920,752 A 7/1999 Karakama et al. ..... 399/111
5,937,242 A 8/1999 Yokoyama et al. ..... 399/114
5,943,528 A 8/1999 Akutsu et al. ..... 399/110
5,966,566 A 10/1999 Odagawa et al. ..... 399/109
5,966,568 A 10/1999 Numagami et al. ..... 399/111
5,987,269 A * 11/1999 Allen et al. ..... 399/27
6,006,058 A 12/1999 Watanabe et al. ..... 399/167
6,016,413 A 1/2000 Yokoyama et al. ..... 399/113
6,029,032 A 2/2000 Watanabe et al. ..... 399/111
6,032,007 A 2/2000 Yamaji et al. ..... 399/104
6,070,028 A 5/2000 Odagawa et al. ..... 399/104
6,075,956 A 6/2000 Watanabe et al. ..... 399/92
6,097,908 A 8/2000 Uchiyama et al. ..... 399/111
6,097,909 A 8/2000 Watanabe et al. ..... 399/111
6,101,354 A 8/2000 Nakagawa et al. ..... 399/225
6,118,960 A 9/2000 Nakagawa et al. ..... 399/111

* cited by examiner 40
48
EXTERNAL DEVICE
47
46
ANoa
ANob
MPU
Vouta
Voutb
45a
DIFFERENTIAL CIRCUIT
45b
DIFFERENTIAL CIRCUIT
Vca
Vcb
42a
RECTIFYING CIRCUIT
RECTIFYING CIRCUIT
42b
44a
VOLTAGE CONVERTING CIRCUIT
VOLTAGE CONVERTING CIRCUIT
44b
43a
RECTIFYING CIRCUIT
RECTIFYING CIRCUIT
43b
Crefa
Crefb
A
9
38
9d
39
9b
B
8
7
10
4
DEVELOPING BIAS GENERATING CIRCUIT
41

FIRST CAPACITOR

+

SECOND CAPACITOR

⇩

DEVELOPER AMOUNT DETECTING METHOD, DEVELOPING DEVICE, PROCESS CARTRIDGE AND ELECTROPHOTOGRAPHIC IMAGE FORMING APPARATUS

BACKGROUND OF THE INVENTION

1. Field of the Invention

The present invention relates to a developer amount detecting method, a developing device, a process cartridge and an electrophotographic image forming apparatus.

In the present specification, the electrophotographic image forming apparatus is directed to, for example, an electrophotographic copying machine, an electrophotographic printer such as an LED printer or a laser beam printer, an electrophotographic facsimile machine and an electrophotographic word processor.

The process cartridge makes at least one of charging means, developing means and cleaning means and an electrophotographic photosensitive member integrally into a cartridge which is detachably mountable to a main body of the electrophotographic image forming apparatus, or makes at least the developing means and the electrophotographic photosensitive member integrally into a cartridge which is detachably mountable to a main body of the electrophotographic image forming apparatus.

2. Related Background Art

Up to now, in an image forming apparatus using an electrophotographic image forming process, there has been applied a process cartridge system which makes the electrophotographic photosensitive member and process means that operates on the electrophotographic photosensitive member into a cartridge which is detachably mountable to a main body of the electrophotographic image forming apparatus. The process cartridge system can remarkably be improved in the operability since the maintenance of the apparatus can be conducted by a user per se not depending on a service man. For that reason, the process cartridge system has been widely employed in the electrophotographic image forming apparatus.

In the electrophotographic image forming apparatus of the above process cartridge system, a user replaces the cartridge mounted on the apparatus by a fresh one. Therefore, it is a great convenience to provide the electrophotographic image forming apparatus with a function of informing the user that a developer within the process cartridge is completely depleted.

FIG. 13 shows an example of a conventional image forming apparatus A on which a process cartridge B is mounted. A developing device 9 which constitutes developing means by a process cartridge B includes a developing chamber 9A which supplies a developer T to a latent image formed on a photosensitive drum 7 and visualizes the latent image and a developer container 11A that contains the developer T therein. The developer T within the developer container 11A is fed to the developing portion 13 from the interior of the developing chamber 9A by the gravity and an agitating device 9*e* or other developer feeding means.

In the developing chamber 9A, a developing roller 9*a* that serves as a cylindrical developer bearing member for feeding the developer T up to a developing position opposite to the photosensitive drum 7 is disposed in the vicinity of the photosensitive drum 7. The developer T is attracted and held on the surface of the developing roller 9*a*, and the developer T is fed up to the developing position opposite to the photosensitive drum 7 due to the rotation of the developing roller 9*a*.

The amount and height of the developer T are regulated and uniformly coated on the developing roller 9*a* by developer regulating means 9*d* such as a doctor blade while the developer T is being fed.

The developer T is rubbed by the developing roller 9*a*, the developer regulating means 9*d* or the developer T per se so as to be electrically charged during a process where the developer T is fed onto the developing roller 9*a*.

Then, the developer T which has been fed to a portion of the developing roller 9*a* opposite to the photosensitive drum 7, that is, to a developing position by the developing roller 9*a* is transferred onto the photosensitive drum 7 due to an appropriate developing bias voltage applied between the photosensitive drum 7 and the developing roller 9*a* by a developing bias power supply 54 which serves as bias applying means, and an electrostatic latent image on the photosensitive drum 7 is then developed to form a toner image.

The developer T which has not been used for development is fed while it remains on the developing roller 9*a*, and then permitted to be again contained in the developing portion.

On the other hand, a recording medium 2 set in a sheet feed cassette 3*a* is conveyed to a transfer position by a pickup roller 3*b*, a pair of conveying rollers, a registration roller (not shown) and so on in synchronism with the formation of the toner image. A transfer roller 4 is disposed as transfer means at the transfer position, and the toner image on the photosensitive drum 7 is transferred onto the recording medium 2 by application of a voltage.

The recording medium 2 onto which the toner image has been transferred is conveyed to fixing means 5. The fixing means 5 includes a fixing roller 5*b* having a heater 5*a* therein and a driving roller 5*c*, and applies a heat and a pressure to the recording medium 2 which is passing through the fixing roller 5*b* to fix the transferred toner image onto the recording medium 2. Thereafter, the recording medium 2 is discharged to the external.

The photosensitive drum 7 from which the toner image has been transferred onto the recording medium 2 by the transfer roller 4 is subjected to a succeeding image forming process after the developer remaining on the photosensitive drum 7 has been removed by cleaning means 10. The cleaning means 10 scrapes off the residual developer on the photosensitive drum 7 by an elastic cleaning blade 10*a* disposed so as to be abutted against the photosensitive drum 7 and collects the residual developer thus scrapped off into a waste developer reservoir 10*b*.

As described above, in the developing device 10, the developer T is depleted every time the developing operation is repeated. And if the developer is short, there may occur a defect such as a deterioration of the image density or a lack of the image. For that reason, it is necessary to monitor the presence/absence of the developer T in the developing chamber 9A and the develop container 11A so as to prevent the shortage of the developer T.

Under the above circumstances, the conventional developing device 9 includes a developer amount detecting device as means for detecting the residual amount of the developer. The developer amount detecting device includes a bar-shaped antenna electrode 35 for detection of the residual amount of the developer which is disposed horizontally in the interior of the developing chamber 9A as a member for the electrode to detect the residual amount of the developer T.

The developer amount detecting device further includes a developer amount measuring circuit 50. The developer amount measuring circuit 50 is equipped with a capacitance detecting circuit 52 as means for measuring a capacitance between the antenna electrode 35 and the developing roller 9*a*. The capacitance detecting circuit 52 is connected with the antenna electrode 35. With this structure, the developing bias voltage which is applied to the developing roller 9*a* by the developing bias power supply 54 is detected by the antenna electrode 35 to measure the capacitance between antenna electrode 35 and the developing roller 9*a*.

The developer amount measuring circuit 50 also includes a reference capacitance 53 as means for setting a capacitance which is a reference for comparison and a capacitance detecting circuit 51 as means for measuring the reference capacitance 53. The reference capacitance 53 and the developing bias power supply 54 are connected to each other, and the developing bias voltage is detected through the reference capacitance 53, to thereby obtain the capacitance which is a reference in measurement of a unknown capacitance.

The developer amount detecting device compares an output of the capacitance detecting circuit 51 with an output of the capacitance detecting circuit 52 for the reference capacitance by a comparing circuit 55 serving as comparing means to detect a difference therebetween. Then, the developer amount detecting device judges the developer amount as the depletion of developer T by a developer amount warning circuit 57 and notifies the user that the developer T is little if the difference is lower than a given value.

The above system is mainly employed in a small-sized image forming apparatus on which the process cartridge is mounted since the system is simple in structure and inexpensive.

However, as described above, in the conventional image forming apparatus, the antenna electrode 35 is disposed within the developing chamber 9A. Therefore, this detecting method can detect a time immediately when the developer is completely depleted with a high accuracy (near-end detection). However, the amount of developer could not be successively detected.

The conventional developer amount detecting device is so designed as to detect the presence/absence of the developer within the developer container. That is, the conventional developer amount detecting device can merely detect that the developer is little immediately before the developer within the developer container has been completely depleted. In other words, the device could not detect the remaining amount of developer within the developer container.

On the other hand, if the remaining amount of developer within the developer container can be successively detected, the user can be informed of the developer depleted state within the developer container so that the user can prepare a fresh process cartridge at a replacing timing. This is very convenient for the user.

In order to solve the above problem, there has been proposed a developer remaining amount detecting method based on a pixel counting system in which the depleted amount of developer is calculated in accordance with the number of dots drawn by a laser. However, in this method, the depleted amount of developer to be detected is different between a graphic pattern and a text pattern. For that reason, in the case where the lifetime of the process cartridge is short to the degree of 3000 to 5000 sheets, the method is effective because an error in calculation is small. However, in the case where the lifetime of 10000 sheets or more is satisfied, a fear that the error in calculation becomes large in the latter half of the lifetime because of a difference in the depleted amount of developer due to the pattern is presumed.

FIG. 11 shows a state in which the developer is borne on the text pattern and the graphic pattern (solid image) as a schematic diagram showing the depleted amount of toner. This figure shows that the depleted amount of developer (toner) per one dot in the text pattern is more than that in the graphic pattern. FIG. 56 shows how the developer is decreased in the case where only the text pattern and only the graphic pattern are printed on 10000 sheets, respectively. It is understood from the figure that an error in calculation with respect to the pattern of the pixel count system is about ±10% in the lifetime of 10000 sheets of the process cartridge which is filled with toner of 500 g. That is, in the larger-capacity process cartridge, an improvement is further required to successively and accurately detect the remaining amount of developer.

SUMMARY OF THE INVENTION

An object of the present invention is to provide a developer amount detecting method, a developing device, a process cartridge and an electrophotographic image forming apparatus which are capable of successively detecting the amount of developer.

Another object of the present invention is to provide a developer amount detecting method, a developing device, a process cartridge and an electrophotographic image forming apparatus which are capable of detecting the amount of developer with accuracy.

Still another object of the present invention is to provide a developer amount detecting method, a developing device, a process cartridge and an electrophotographic image forming apparatus which are capable of properly informing a user of the amount of developer.

Yet still another object of the present invention is to provide a developer amount detecting method, a developing device, a process cartridge and an electrophotographic image forming apparatus each having a plurality of developer remaining amount detecting means for successively detecting a developer remaining amount within a developer container in which the developer remaining amounts detectable by the respective developer remaining amount detecting means are overlapped with each other, and values detected by the respective developer remaining amount detecting means are weighted, respectively.

Yet still another object of the present invention is to provide a developer amount detecting method, a developing device, a process cartridge and an electrophotographic image forming apparatus which are capable of indicating a developer remaining amount more preferably for a user by shifting from a detected value of a first developer remaining amount detecting means to a detected value of a second developer remaining amount detecting means on the basis of a relation between regions detectable by the plurality of developer remaining amount detecting means and an error in detection in an appropriate method.

Yet still another object of the present invention is to provide a developer amount detecting method, a developing device, a process cartridge and an electrophotographic image forming apparatus which are capable of using a developer without adversely affecting an image, without troubling a user and without any uselessness.

Yet still another object of the present invention is to provide a developer amount detecting method, a developing device, a process cartridge and an electrophotographic image forming apparatus which are inexpensive, each having a developer amount detecting device with a simple structure which is capable of detecting a developer full state to a near-end state which is immediately before printing becomes defective even if the developing device or the process cartridge is long in lifetime with a more accuracy and with a high precision, and which are capable of further improving convenience when the user employs the device.

Yet still another object of the present invention is to provide a developer amount detecting method, a developing device, a process cartridge and an electrophotographic image forming apparatus which are inexpensive, each having a developer amount detecting device which is capable of monitoring a depleted state of the developer with accuracy and grasping a replacement timing of the developing device or the process cartridge with accuracy even if a plurality of users employ the device or a large-scaled print job is conducted, and which are capable of further improving convenience when the user employs the device.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A developing apparatus, a process cartridge and an electrophotographic image forming apparatus in the present invention will next be described in detail in accordance with the drawings.

First Embodiment

One embodiment of the electrophotographic image forming apparatus onto which a process cartridge constructed in accordance with the present invention is detachably mountable will first be explained with reference to FIGS. 1 to 3. In this embodiment, the electrophotographic image forming apparatus is constructed by a laser beam printer A of an electrophotographic system, and an image is formed on a recording medium such as recording paper, an OHP sheet, a cloth, etc. by an electrophotographic image forming process.

Figure 1:
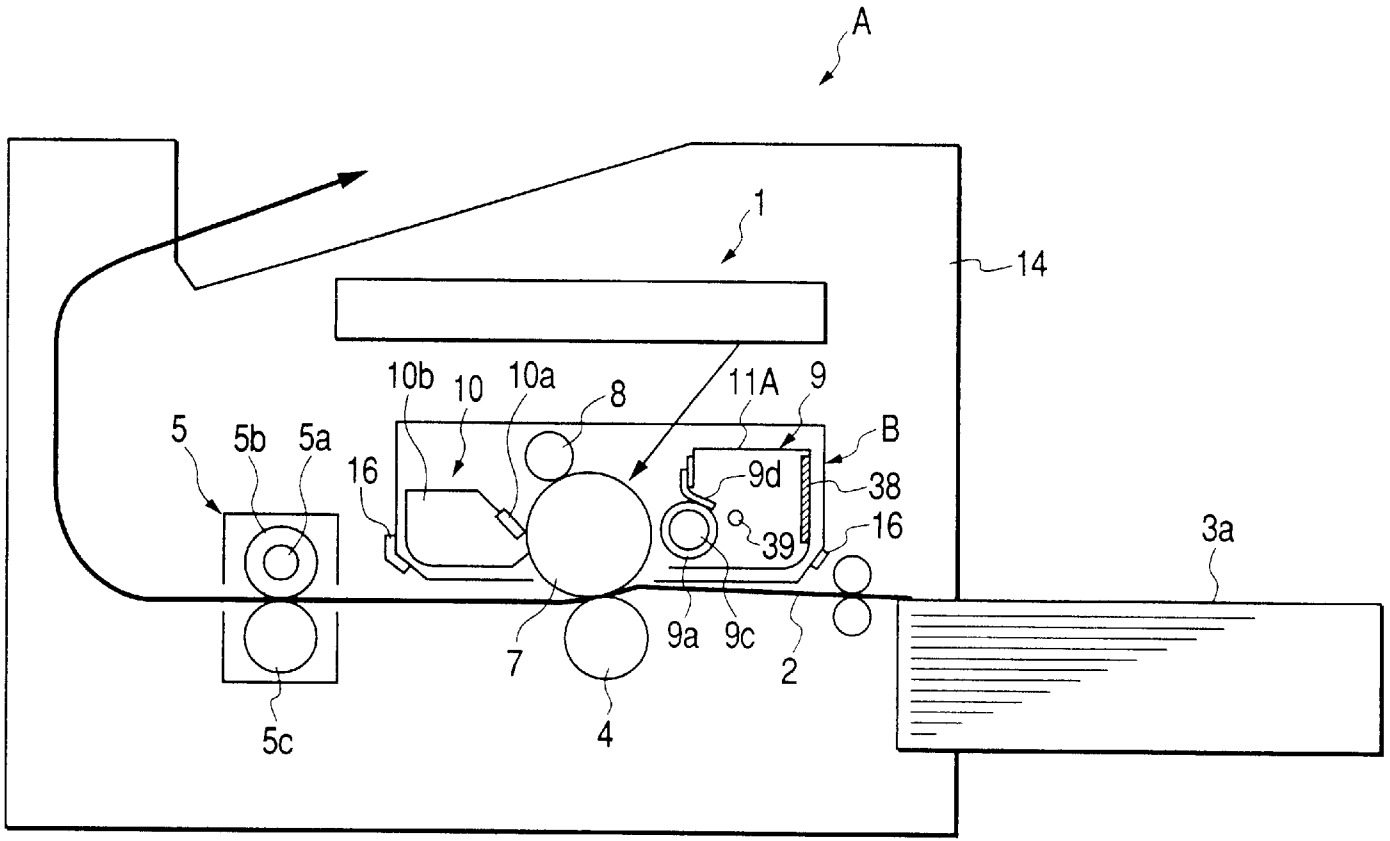
FIG. 1 is a schematic structural diagram showing an electrophotographic image forming apparatus in accordance with an embodiment of the present invention.
Figure 13:
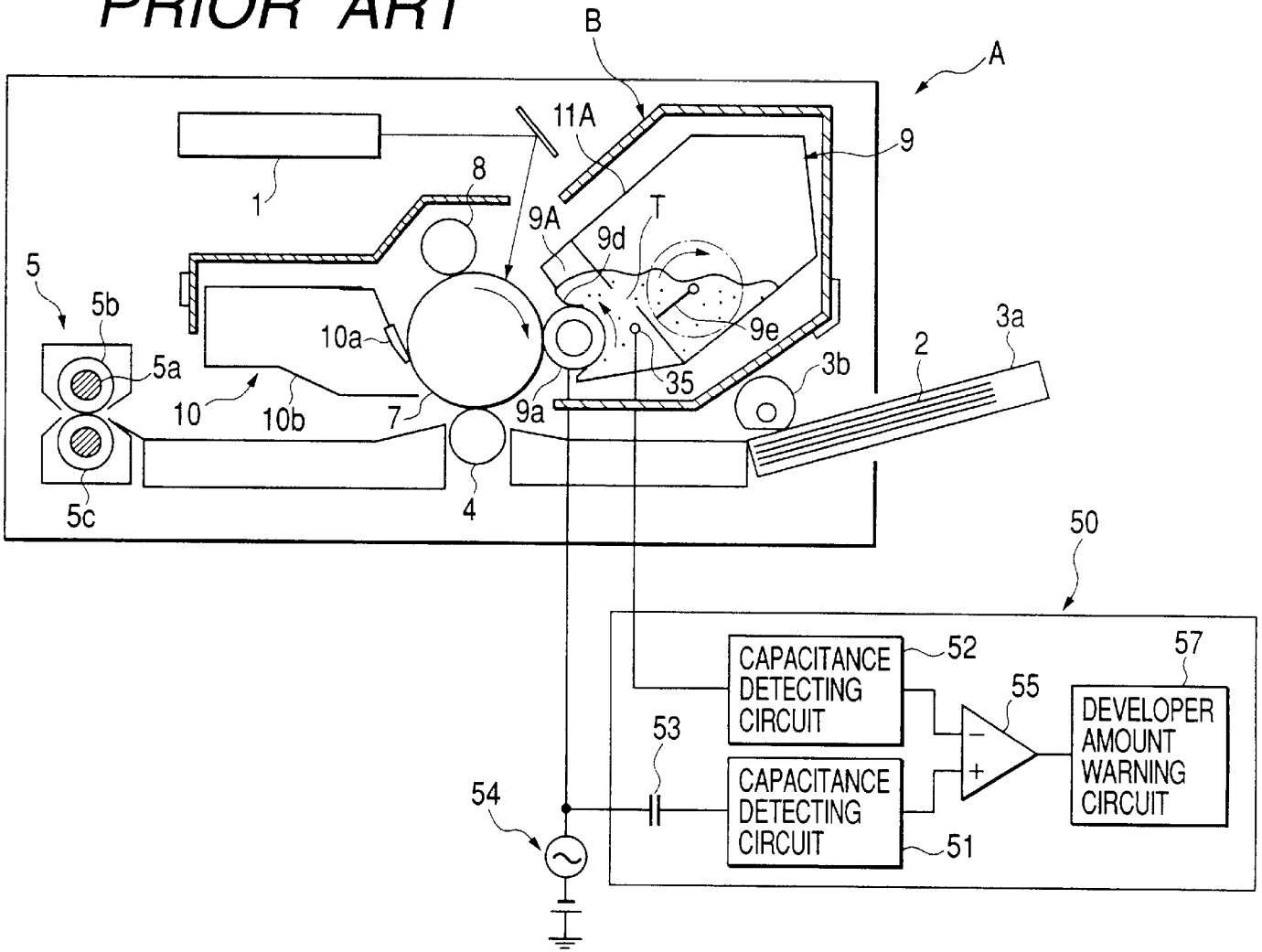
FIG. 13 PRIOR ART
FIG. 13 is a schematic structural diagram showing one example of a conventional electrophotographic image forming apparatus.

FIG. 1 shows a schematic construction of the laser beam printer. In this embodiment, an entire construction of the laser beam printer A is similar to that of the laser beam printer A previously explained with reference to FIG. 13. The laser beam printer A has a drum-shaped electrophotographic photosensitive member, i.e., a photosensitive drum 7. The photosensitive drum 7 is charged by a charging roller 8 as a charging means. A latent image according to image information is next formed on the photosensitive drum 7 by irradiating a laser beam according to the image information from an optical means 1 having a laser diode, a polygon mirror, a lens and a reflecting mirror. This latent image is developed by a developing means 9 and is set to a visible image, i.e., a toner image.

Namely, a developing apparatus 9 as the developing means has a developer container 11A having a developing roller 9*a* as a developer bearing member for storing a developer and bearing and conveying the developer. A stationary magnet 9*c* is built in the developing roller 9*a*. The developer is conveyed by rotating the developing roller 9*a*. A triboelectrification charge is given by a developing blade 9*d* as a developer regulating member, and a developer layer having a predetermined thickness is formed and is supplied to a developing area of the photosensitive drum 7. The developer supplied to this developing area is transferred to the latent image on the above photosensitive drum 7 so that the toner image is formed. The developing roller 9*a* is connected to a developing bias circuit in which a developing bias voltage provided by superposing a DC voltage onto an AC voltage is normally applied to the developing roller 9*a*.

The recording medium 2 set to a sheet feed cassette 3*a* is conveyed to a transfer position by a sheet feeding means such as a conveying roller, etc. in synchronism with the formation of the toner image. A transfer roller 4 as transfer means is arranged in the transfer position, and the toner image on the photosensitive drum 7 is transferred to the recording medium 2 by applying a voltage to the transfer roller 4.

The recording medium 2 having the transferred toner image is conveyed to fixing means 5. The fixing means 5 has a fixing roller 5*b* having a heater 5*a* therein, and a drive roller 5*c*. The fixing means 5 fixes the transferred toner image onto the recording medium 2 by applying heat and pressure to the passing recording medium 2.

After the toner image is transferred to the recording medium 2 by the transfer roller 4, the developer remaining on the photosensitive drum 7 is removed therefrom by cleaning means 10 and is used in the next image forming process. The cleaning means 10 scrapes off the remaining developer on the photosensitive drum 7 by an elastic cleaning blade 10*a* abutting on the photosensitive drum 7, and collects this developer into a waste developer reservoir 10*b*.

In this embodiment, as shown in FIG. 1, a process cartridge B is formed as a cartridge by integrally connecting the photosensitive drum 7, the cleaning means 10 and the charging roller 8 to the developing means 9. This process cartridge B is detachably mounted to cartridge mounting means 16 arranged in an image forming apparatus main body 14 by a user.

In accordance with the present invention, the process cartridge B has a developer amount detecting device capable of successively detecting the remaining amount of the developer in accordance with depletion of the developer within the developer container 11A.

In accordance with this embodiment, the developer amount detecting device has first developer remaining amount detecting means having a first electrode member 38, and second developer remaining amount detecting means having a second electrode member 39. In this embodiment, the first electrode member 38 is set to a plate-shaped antenna electrode member constructed by a flat plate manufactured by stainless steel and having 50 mm in width. The second electrode member 39 is set to a bar-shaped antenna electrode member constructed by a round bar manufactured by stainless steel and having 2 mm in diameter. The developer amount detecting device has a developer amount detecting circuit connected to the first antenna electrode member 38 and the second antenna electrode member 39, and detecting the remaining amount of the developer.

Figure 2:
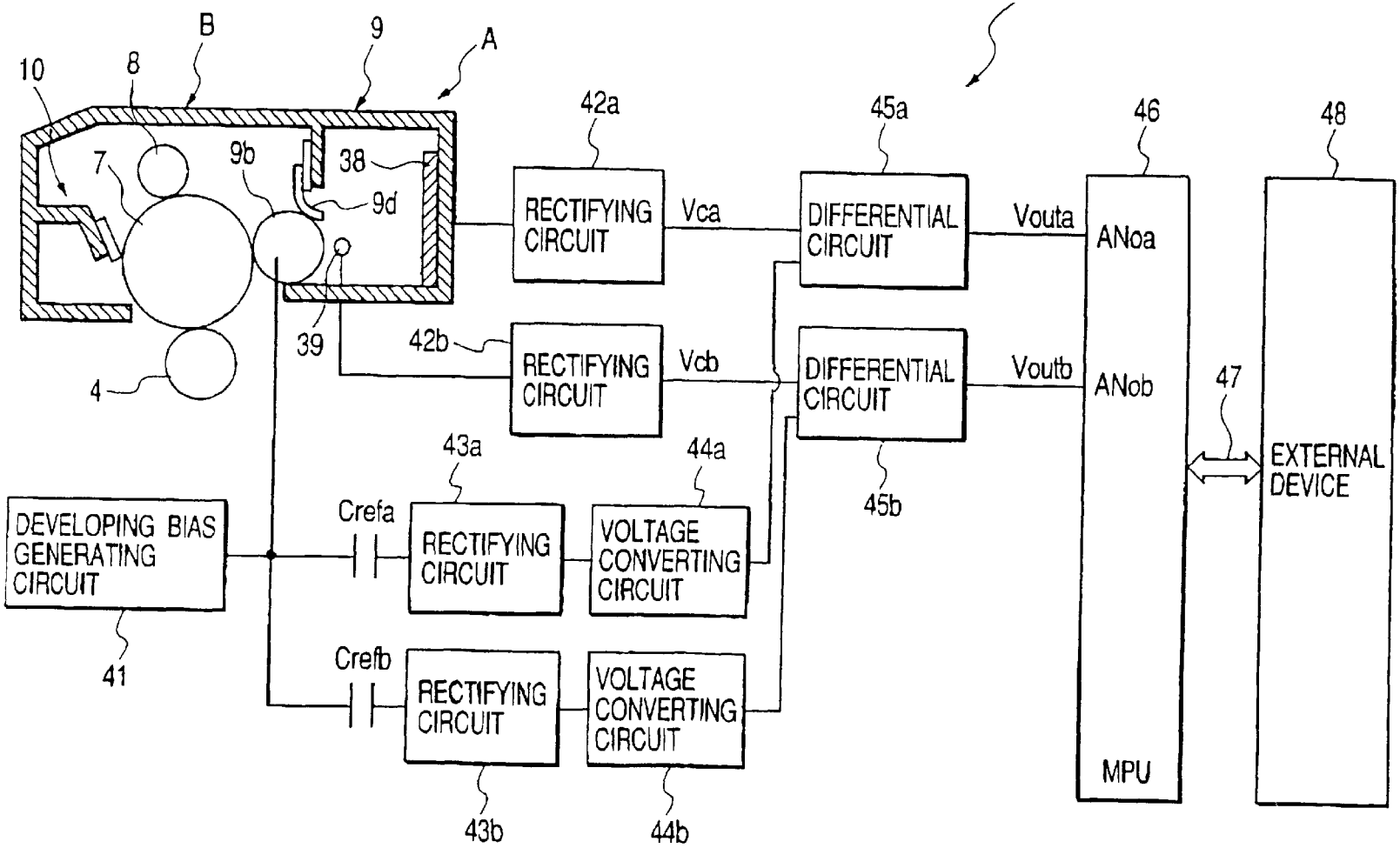
FIG. 2 is a block diagram showing a developer amount detecting circuit used in a developer remaining amount detecting device constructed in accordance with an embodiment of the present invention.
Figure 3:
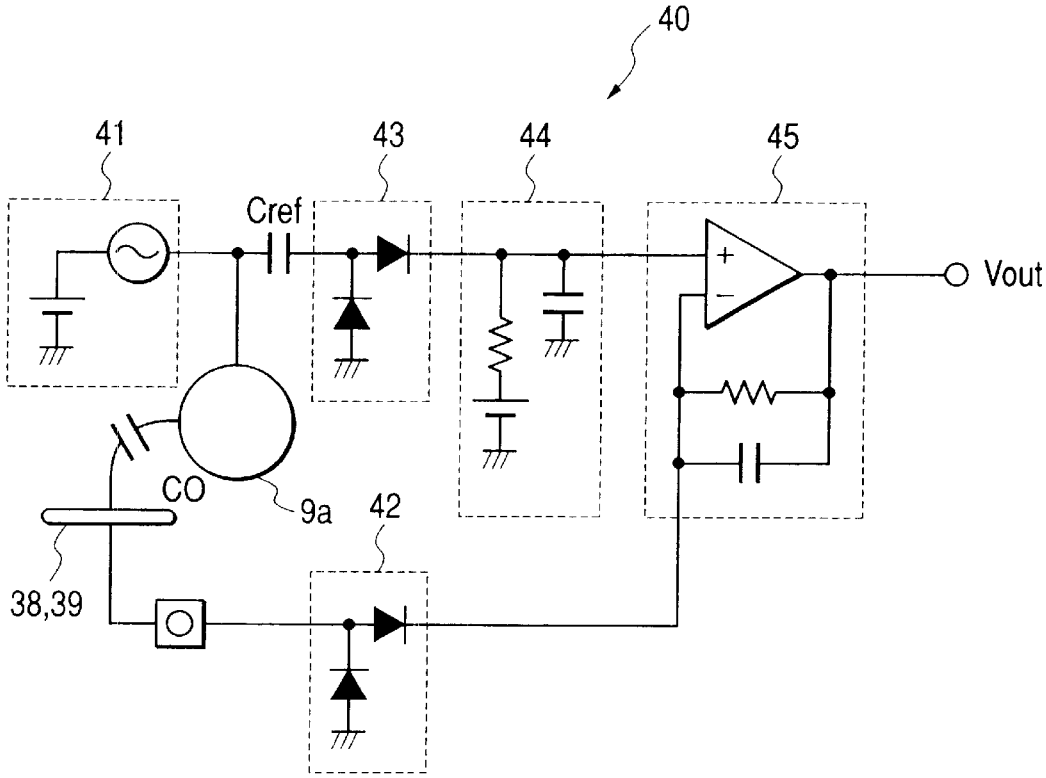
FIG. 3 is a concrete circuit diagram showing the developer amount detecting circuit of FIG. 2.

FIG. 2 is a block diagram showing one example of the developer amount detecting circuit 40 constituting the developer amount detecting device. FIG. 3 shows a more detailed circuit diagram corresponding to this block diagram. In accordance with this embodiment, an AC bias voltage superposing a DC component thereon is applied from a developing bias generating circuit 41 to the developing roller 9*a*. The first antenna electrode member 38 and the second antenna electrode member 39 form capacitors of capacitances COa, COb together with the developing roller 9*a*, and their capacitances are changed in accordance with developer amounts existing therebetween. Namely, AC voltages generated in the first antenna electrode member 38 and the second antenna electrode member 39 are changed in accordance with the developer amount. These voltages from the first antenna electrode member 38 and the second antenna electrode member 39 are rectified by a rectifying circuit 42 (42*a*, 42*b*), and output voltages Vca, Vcb of this rectifying circuit are inputted to a differential circuit 45 (45*a*, 45*b*).

The developer amount detecting circuit 40 has reference capacitors Crefa, Crefb having the same capacity as the capacity between the developer roller 9*a*, the first antenna electrode member 38 and the second antenna electrode member 39 in a state of the developer amount in which it is judged that the developer amount is small. One end of each of the reference capacitors Crefa, Crefb is connected to the developing bias generating circuit 41. The other end of each of the reference capacitors Crefa, Crefb is connected to a reference voltage generating circuit having a rectifying circuit 43 (43*a*, 43*b*) and a voltage converting circuit 44 (44*a*, 44*b*). The reference voltage generating circuit generates a reference voltage for detecting the remaining amount of the developer. The reference voltage from the reference voltage generating circuit is inputted to the above differential circuit 45 (45*a*, 45*b*) and is compared with output voltages Vca, Vcb from the first antenna electrode member 38 and the second antenna electrode member 39. After the comparison is made, an output voltage from the differential circuit 45 (45*a*, 45*b*) is converted to DC voltages Vouta, Voutb able to be inputted to analog ports ANoa, ANob of an MPU 46 and these DC voltages are inputted to the analog ports.

The MPU 46 has an input/output port, an analog input port, a serial communication port, a ROM, a RAM, a timer, etc. A general purpose interface 47 is connected to the serial communication port of the MPU 46 so that the MPU 46 can communicate with an external device 48.

Figure 4:
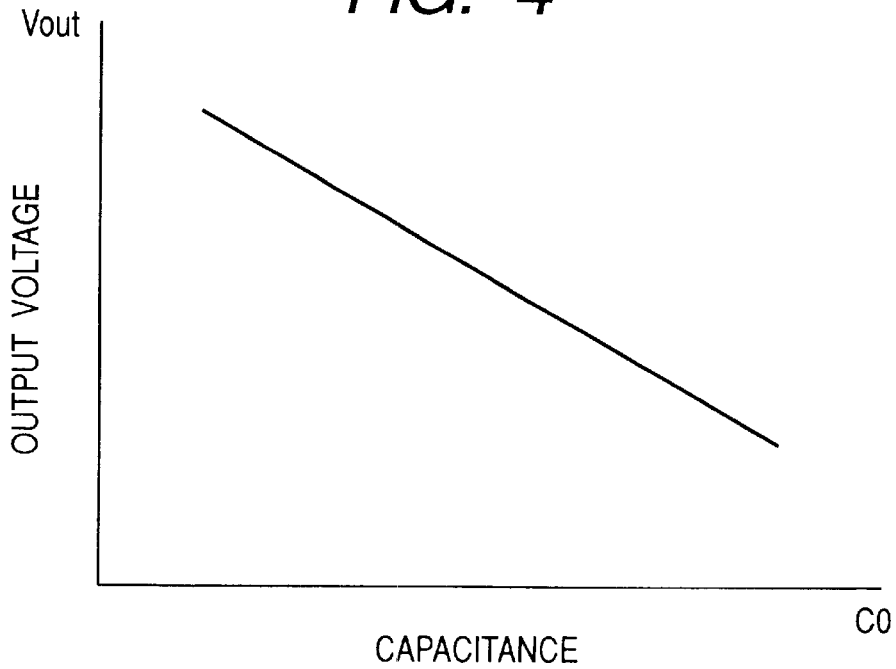
FIG. 4 is a graph showing the relation of a change in capacitance caused by a change in developer amount, and an output from the developer amount detecting circuit.

FIG. 4 shows the relation of an output voltage Vout and a change in capacitance CO caused by a change in the developer amount. In accordance with the present invention, the differential circuit 45 (45*a*, 45*b*) is connected to the first antenna electrode member 38 and the second antenna electrode member 39 as shown in FIGS. 2 and 3. Thus, it is possible to obtain a linear output with respect to the change in the developer amount (i.e., the change in capacitance CO) as shown in FIG. 4.

Figure 5:
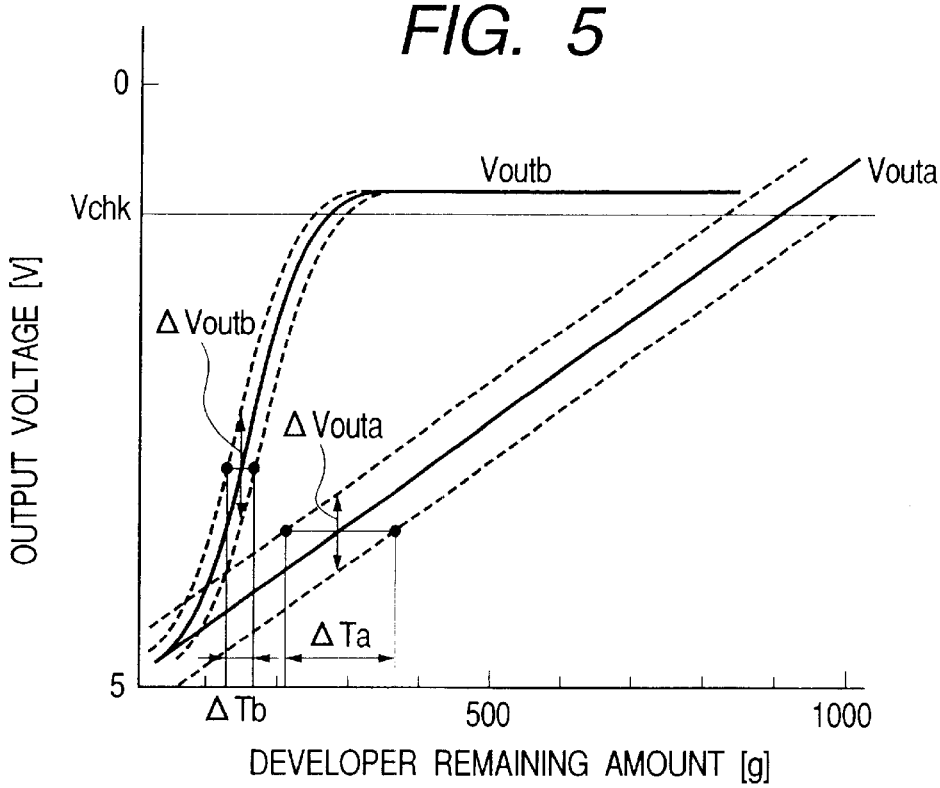
FIG. 5 is a graph showing the relation of the developer remaining amount and outputs from first and second developer remaining amount detecting means.

The above laser beam printer A shown in FIG. 1 and explained as one embodiment of the present invention has a process cartridge which is filled with a developer amount of 1000 g and realizes 20,000 pages in life under a condition of 4% printing. FIG. 5 shows output voltages Vouta, Voutb of the first antenna electrode member 38 and the second antenna electrode member 39 with respect to the developer remaining amount at that time.

Broken lines in FIG. 5 show deviation ranges of the output voltages caused by errors in attaching positions of the detecting circuit and each developer remaining amount detecting means.

In the case of the first antenna electrode member 38 having sensitivity with respect to the developer amount of 1000 g, an error ΔTa in the developer remaining amount is 150 g by a detecting error ΔVouta of 10%. In contrast to this, in the case of the second antenna electrode member 39 having sensitivity with respect to the developer remaining amount equal to or smaller than 200 g, an error ΔTb in the developer remaining amount is equal to or smaller than 50 g with respect to a detecting error ΔVoutb of 10%.

Thus, when the image forming apparatus has plural developer remaining amount detecting means for detecting the developer remaining amount from an initial period of usage of the process cartridge to a near end, and detecting the developer remaining amount from the near end to nonexistence of the developer, connectability of the detecting means and a developer remaining amount detecting accuracy near the near end can be increased by setting the detecting accuracy of the latter to be higher than the detecting accuracy of the former.

A developer remaining amount detecting method will next be explained.

As shown in FIG. 5, when the voltage output Voutb of the second antenna electrode member 39 is equal to or greater than Vchk, the developer remaining amount is calculated on the basis of the voltage output Vouta of the first antenna electrode member 38. In contrast to this, when the voltage output Voutb of the second antenna electrode member 39 is equal to or smaller than Vchk, the developer remaining amount is calculated on the basis of the voltage output Voutb of the second antenna electrode member 39.

Figure 6:
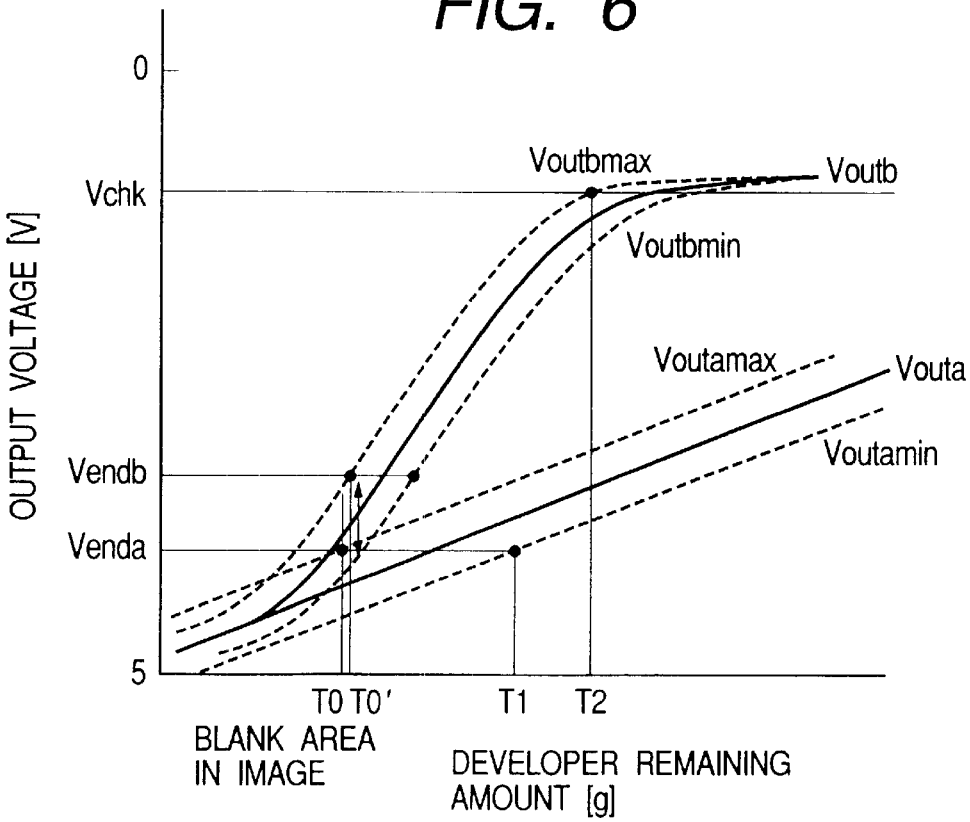
FIG. 6 is a graph showing the relation of the developer remaining amount near a near end and the outputs from the first and second developer remaining amount detecting means.

The developer remaining amount detecting method will be explained further in detail with reference to FIG. 6. The voltage output of the first antenna electrode member 38 is set to Venda when the output of the first antenna electrode member 38 shows that there is no developer (developer remaining amount T0) including an error.

Here, in the present invention, outputs of the developer remaining amount can be naturally connected to each other when the sensitivities of the respective antenna electrode members are combined with each other such that the output of the second antenna electrode member 39 is changed prior to the developer remaining amount T0 and Voutbmax is equal to or smaller than Vchk before a minimum value Voutamin of the voltage output of the first antenna electrode member 38 becomes Venda.

In contrast to this, when the developer remaining amount is set to T1 when a tolerance lower limit value of the first antenna electrode member 38 is set to Voutamin=Venda, the second antenna electrode member 39 is set such that there is sensitivity with respect to a tolerance upper limit value of the output of the second antenna electrode member 39 from a state of T2 in the developer remaining amount.

As explained above, in accordance with the present invention, the developer remaining amount can be successively detected by the first antenna electrode member 38 from an initial period of usage of the process cartridge. The developer remaining amount can be successively detected more accurately by the second antenna electrode member 39 in the vicinity of nonexistence of the developer.

Further, a using limit of the process cartridge is transmitted to a user by giving a "developer nonexistence warning" when the voltage output of the second antenna electrode member 39 is an output voltage Vendb set by Crefb. Here, when the toner remaining amount at this time is set to T0', the "developer nonexistence warning" can be given by setting the relation of T0<T0' before a blank area in an image is formed.

In this embodiment, two developer remaining amount detecting means, i.e., the first antenna electrode member 38 and the second antenna electrode member 39 are described. However, when plural (N) developer remaining amount detecting means are arranged, the remaining amount of the developer can be also successively detected by satisfying a condition similar to that in this embodiment. For example, when a developer volume able to be detected by an n-th ($N \geqq n \geqq 2$) developer remaining amount detecting means is set to be greater than a developer volume able to be detected by an (n−1)-th developer remaining amount detecting means, a dynamic range able to be detected by the n-th developer remaining amount detecting means is increased so that the detecting accuracy is improved.

A minimum developer remaining amount able to begin to be detected by the (n−1)-th developer remaining amount detecting means may be set to be greater than a maximum developer remaining amount when the n-th developer remaining amount detecting means recognizes nonexistence of the developer, or cannot detect the developer remaining amount. In this case, there is no jump of a detecting output of the developer remaining amount and the developer remaining amount can be more naturally detected successively.

Second Embodiment

Figure 7:
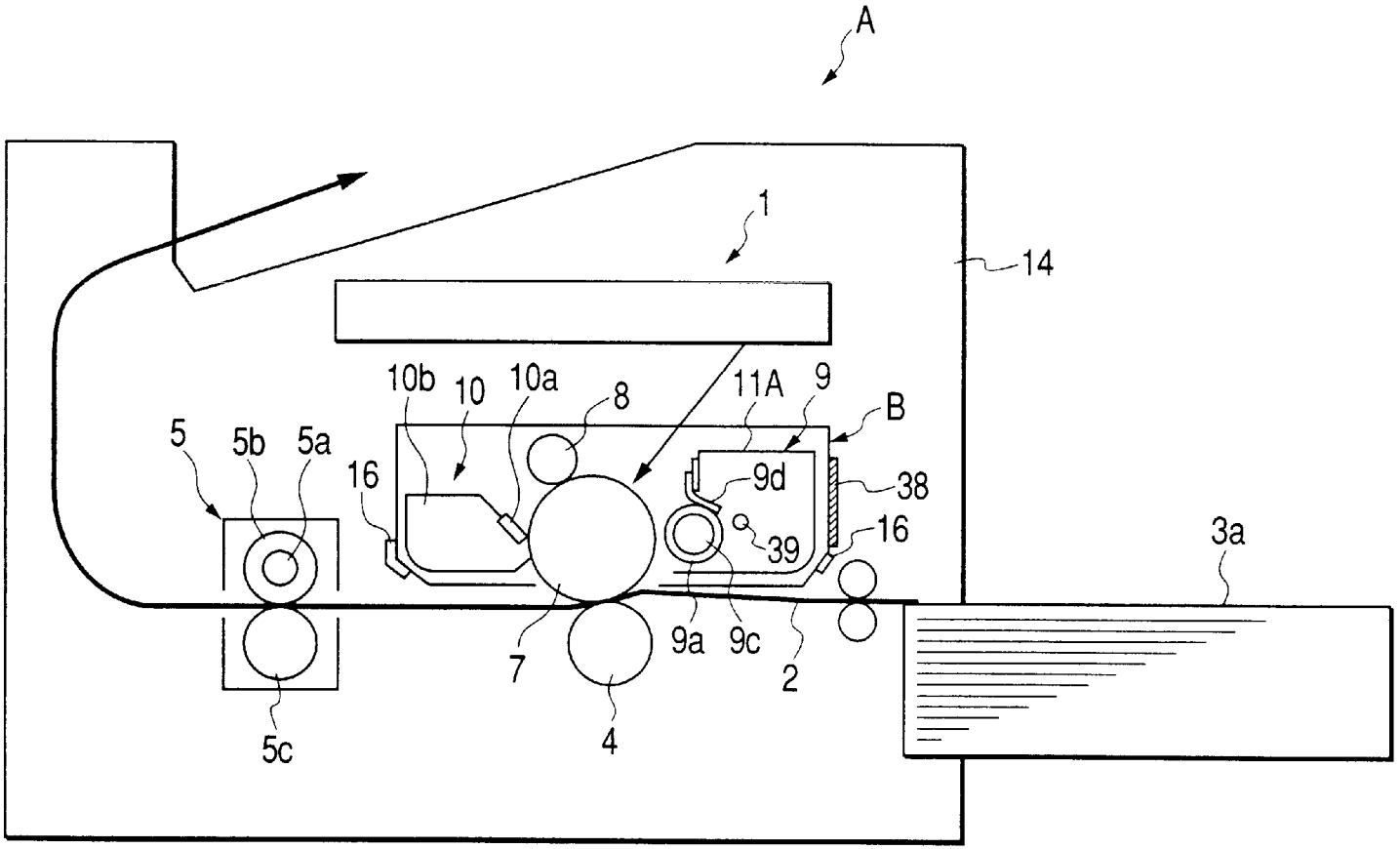
FIG. 7 is a schematic structural diagram showing the electrophotographic image forming apparatus in accordance with another embodiment of the present invention.

FIG. 7 shows a second embodiment of the image forming apparatus of the present invention. The image forming apparatus of this embodiment has a construction similar to that of the image forming apparatus explained in the first embodiment. The second embodiment differs from the first embodiment in that both the first antenna electrode member 38 and the second antenna electrode member 39 as the developer remaining amount detecting means are arranged within the process cartridge B in the first embodiment, but the first antenna electrode member 38 is arranged in an image forming apparatus main body 14 in this embodiment.

In a system for calculating the developer remaining amount from changes in capacitance between the developer roller 9*a* and the antenna electrode members 38, 39 in accordance with the present invention, arranging places of the first antenna electrode member 38 and the second antenna electrode member 39 can be set in a very high degree of freedom.

Namely, a developer storing portion is set such that the developer storing portion is located between the developing roller 9*a* and the antenna electrode members 38, 39 in a state in which the process cartridge B is mounted to the image forming apparatus as in this embodiment. Accordingly, similar to the case of the first embodiment, the developer remaining amount can be successively detected exactly from an initial period of usage of the process cartridge to nonexistence of the developer.

Third Embodiment

Figure 8:
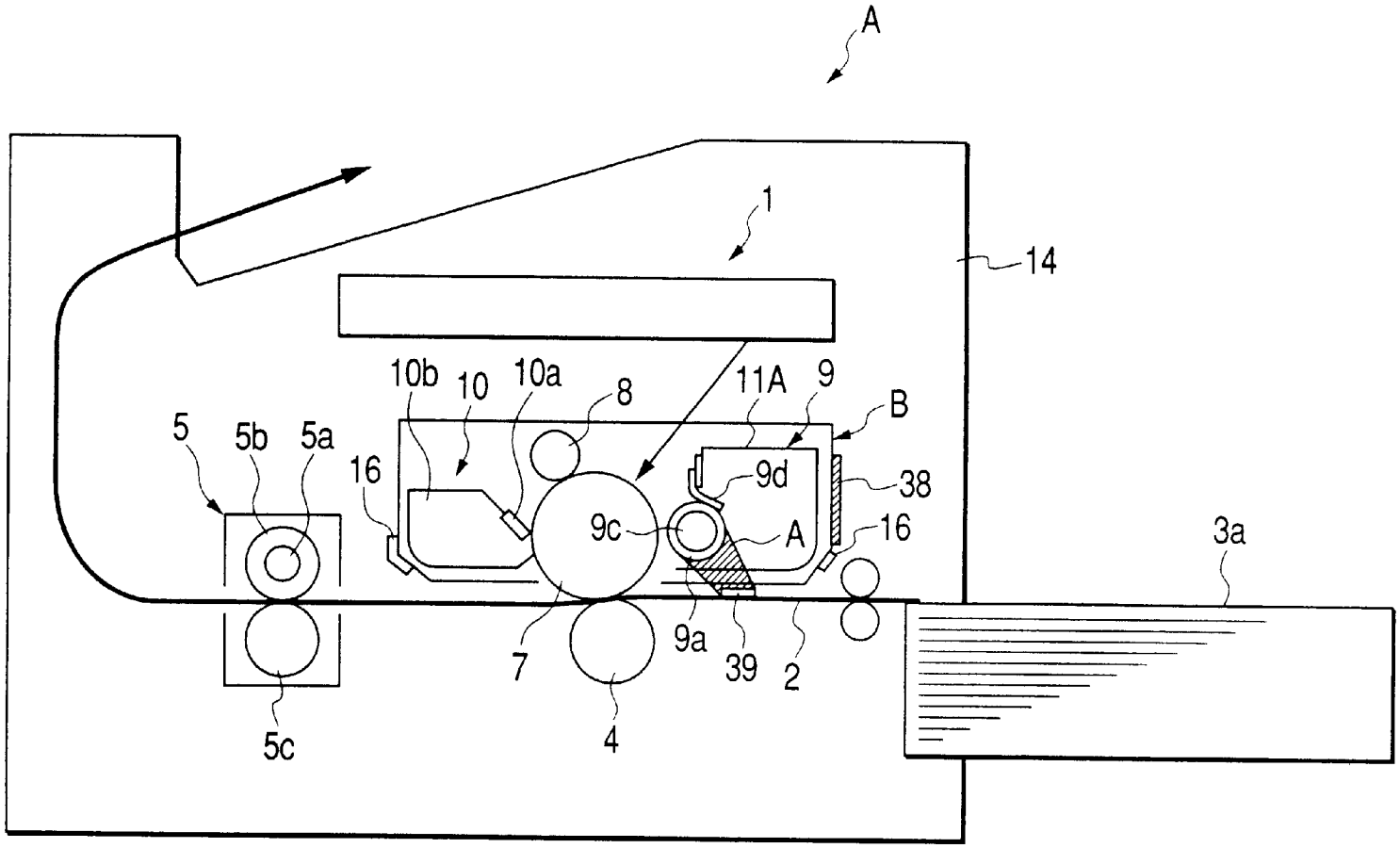
FIG. 8 is a schematic structural diagram showing the electrophotographic image forming apparatus in accordance with another embodiment of the present invention.

FIG. 8 shows a third embodiment of the image forming apparatus of the present invention. The image forming apparatus of this embodiment has a construction similar to that of the image forming apparatus explained in the first embodiment. The third embodiment differs from the first embodiment in that both the first antenna electrode member 38 and the second antenna electrode member 39 are arranged within the process cartridge in the first embodiment, but both the first antenna electrode member 38 and the second antenna electrode member 39 are arranged in an image forming apparatus main body 14 in this embodiment.

Similar to the case of the first embodiment, the developer remaining amount can be also detected in this embodiment. However, in this embodiment, the second antenna electrode member 39 is arranged outside the process cartridge in comparison with a case in which the second antenna electrode member 39 is arranged in the vicinity of the developer roller 9*a* as shown in the first embodiment. Therefore, a changing amount of capacitance is reduced by increasing the distance between the developing roller 9*a* and the second antenna electrode member 39.

Accordingly, in this embodiment, the second antenna electrode member 39 is constructed by using a metallic flat plate of 10 mm in width so as to compensate capacitance by increasing an area of the second antenna electrode member 39. Further, in consideration of a depleted state of the developer, a changing area of capacitance formed between the developing roller 9*a* and the second antenna electrode member 39 is arranged in a position able to be reliably seen until nonexistence of the developer as shown by a hatching portion A of FIG. 8.

It is possible to obtain an output similar to that shown in FIG. 5 by an arrangement of the first antenna electrode member 38 and the second antenna electrode member 39 in accordance with this embodiment. Accordingly, similar to the first embodiment, the developer remaining amount can be successively detected exactly from an initial period of usage of the process cartridge to nonexistence of the developer.

In this embodiment, the first antenna electrode member 38 and the second antenna electrode member 39 are arranged within the image forming apparatus main body 14 so that cost of the process cartridge can be also reduced.

Fourth Embodiment

Figure 9:
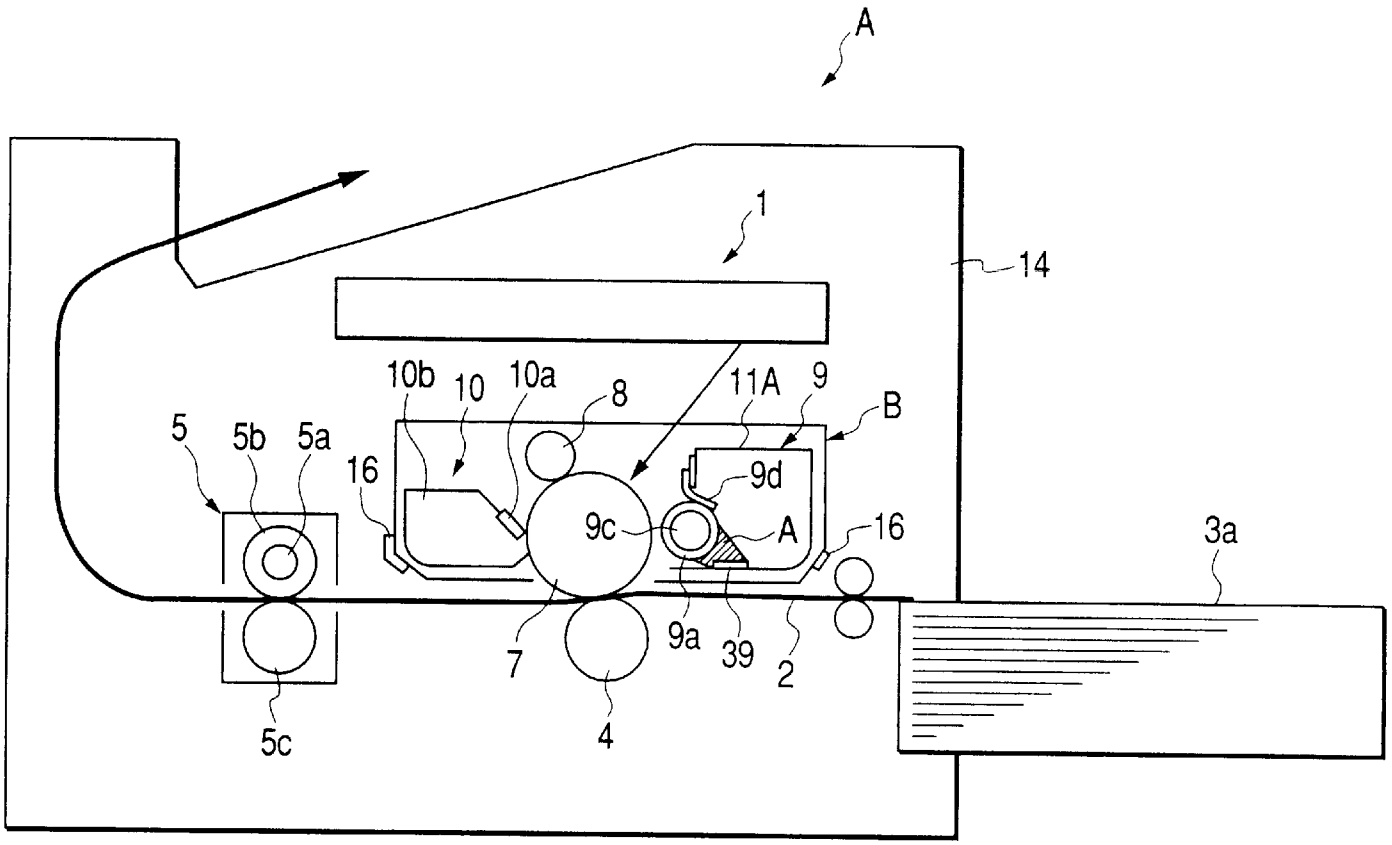
FIG. 9 is a schematic structural diagram showing the electrophotographic image forming apparatus in accordance with another embodiment of the present invention.

FIG. 9 shows a fourth embodiment of the image forming apparatus of the present invention. The image forming apparatus of this embodiment has a construction similar to that of the image forming apparatus explained in the first embodiment. The fourth embodiment differs from the first embodiment in that the first antenna electrode member 38 and the second antenna electrode member 39 are arranged within the process cartridge in the first embodiment, but only the second antenna electrode member 39 as a second developer remaining amount detecting means is arranged within the process cartridge in this embodiment and detects the developer remaining amount at a small developer time and judges nonexistence of the developer.

This embodiment adopts a successive detecting means of a pixel count system as first developer remaining amount detecting means for successively detecting the developer remaining amount from an initial period of usage of the process cartridge.

Figure 10:
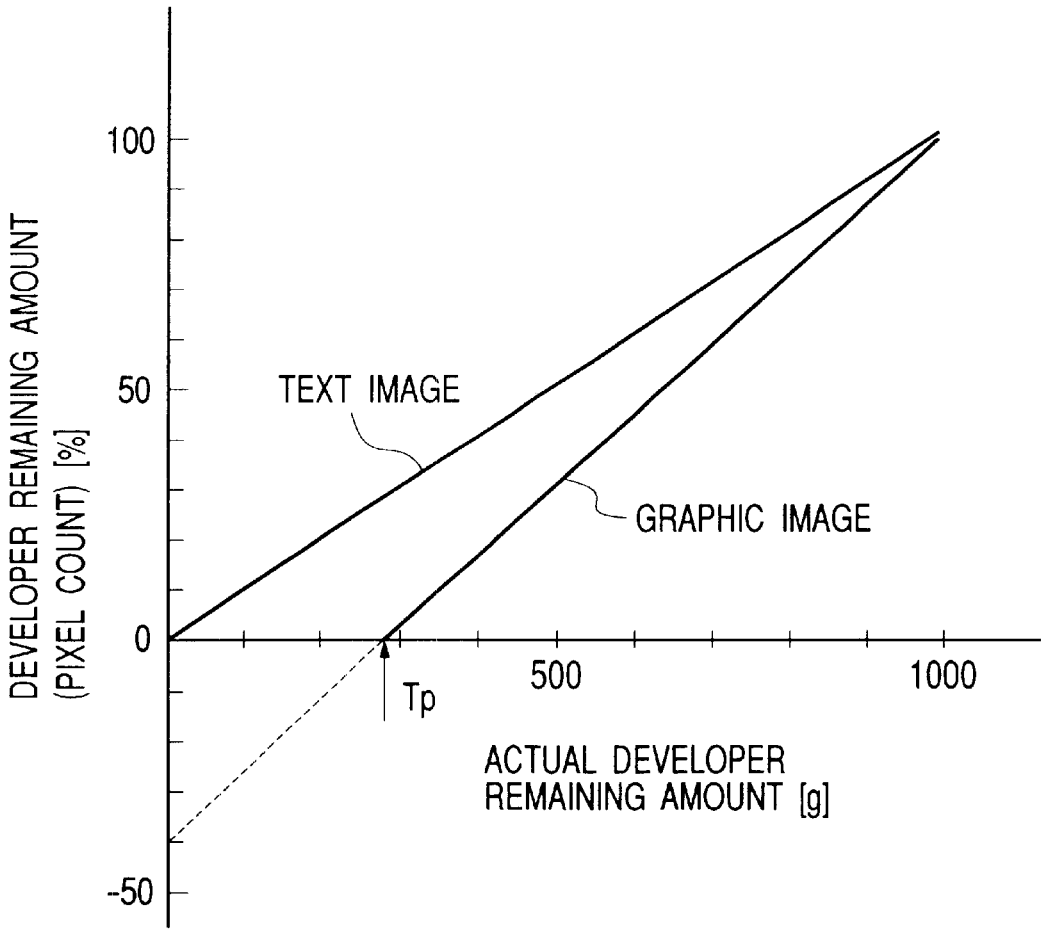
FIG. 10 is a graph showing developer depleted states of a text image and a graphic image in a pixel count system.
Figure 11:
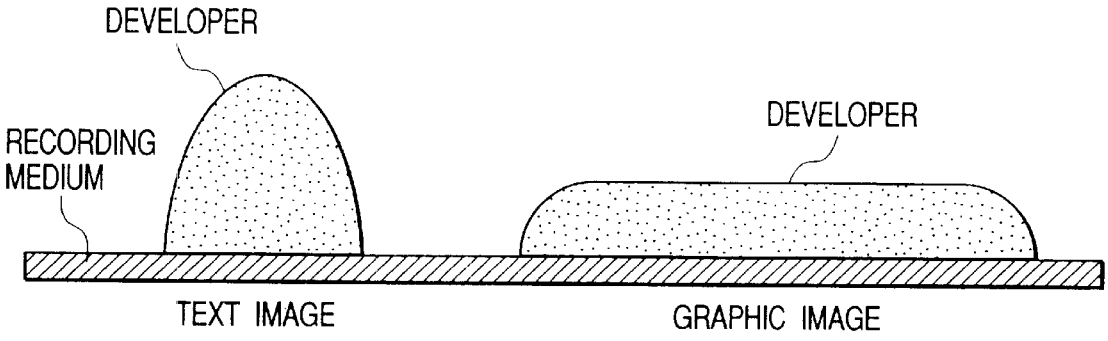
FIG. 11 is a view showing a difference in bearing amount of the developer between the text image and the graphic image.
Figure 12:
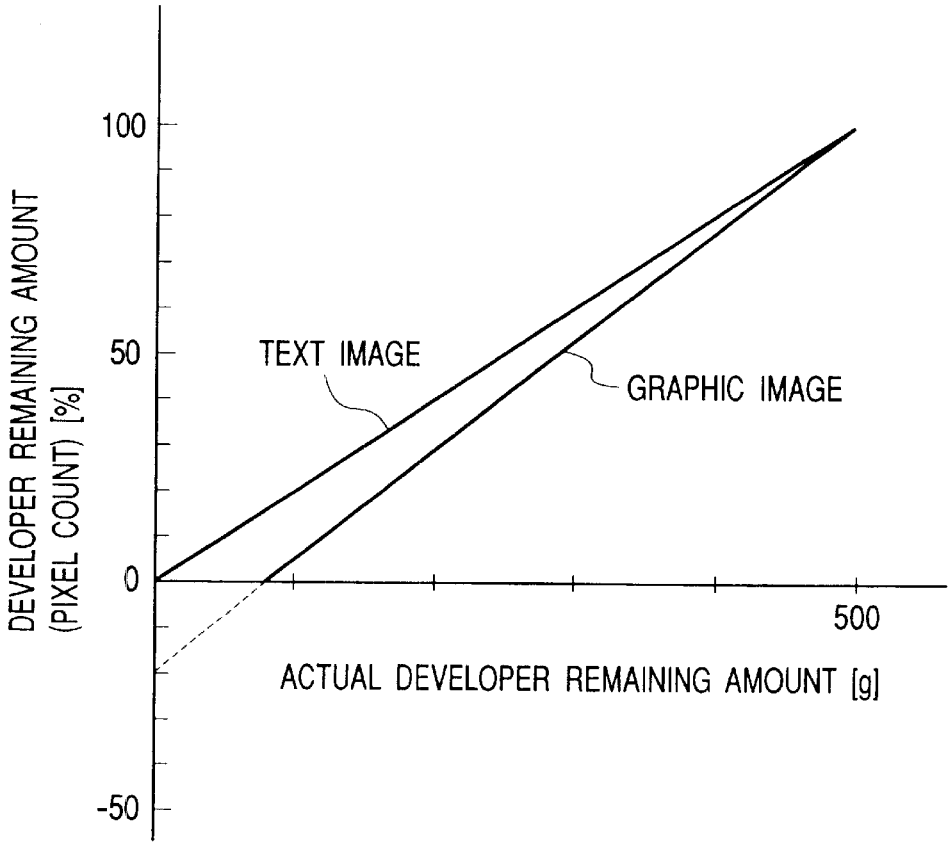
FIG. 12 is a graph showing developer depleted states of the text image and the graphic image in a conventional pixel count system.

This first developer remaining amount detecting means of the pixel count system successively counts an individual image signal when a dot of an image is formed on the photosensitive drum 7 by exposure means so as to form an electrostatic latent image on the photosensitive drum 7. As shown in FIG. 10, an error in developer depleted amount is caused in accordance with patterns. In FIG. 10, worst user models are selected and their average is taken.

Therefore, the second antenna electrode member 39 is set such that the capacity of the developer able to be detected by the second antenna electrode member 39 is greater than the developer remaining amount Tp showing nonexistence of the developer when only a graphic image having a small developer depleted amount per dot of the image is printed. Therefore, similar to the case of the third embodiment, the second antenna electrode member 39 is constructed by using a metallic flat plate of 10 mm in width.

Namely, as shown in FIG. 9, the developer volume of a hatching portion A constructed by the developer roller 9*a* and the second antenna electrode member 39 is preferably set to be equal to or greater than Tp.

Thus, the developer remaining amount can be successively calculated from an initial period of usage of the process cartridge to nonexistence of the developer by arranging only one successive detecting means of a capacitance system as the developer remaining amount detecting means in the image forming apparatus by combining the pixel count system and a capacitance detecting system.

In this embodiment, the detecting system of capacitance of the developer and the pixel count system are combined with each other, but no combining method is limited to this embodiment.

Fifth Embodiment

Figure 14:
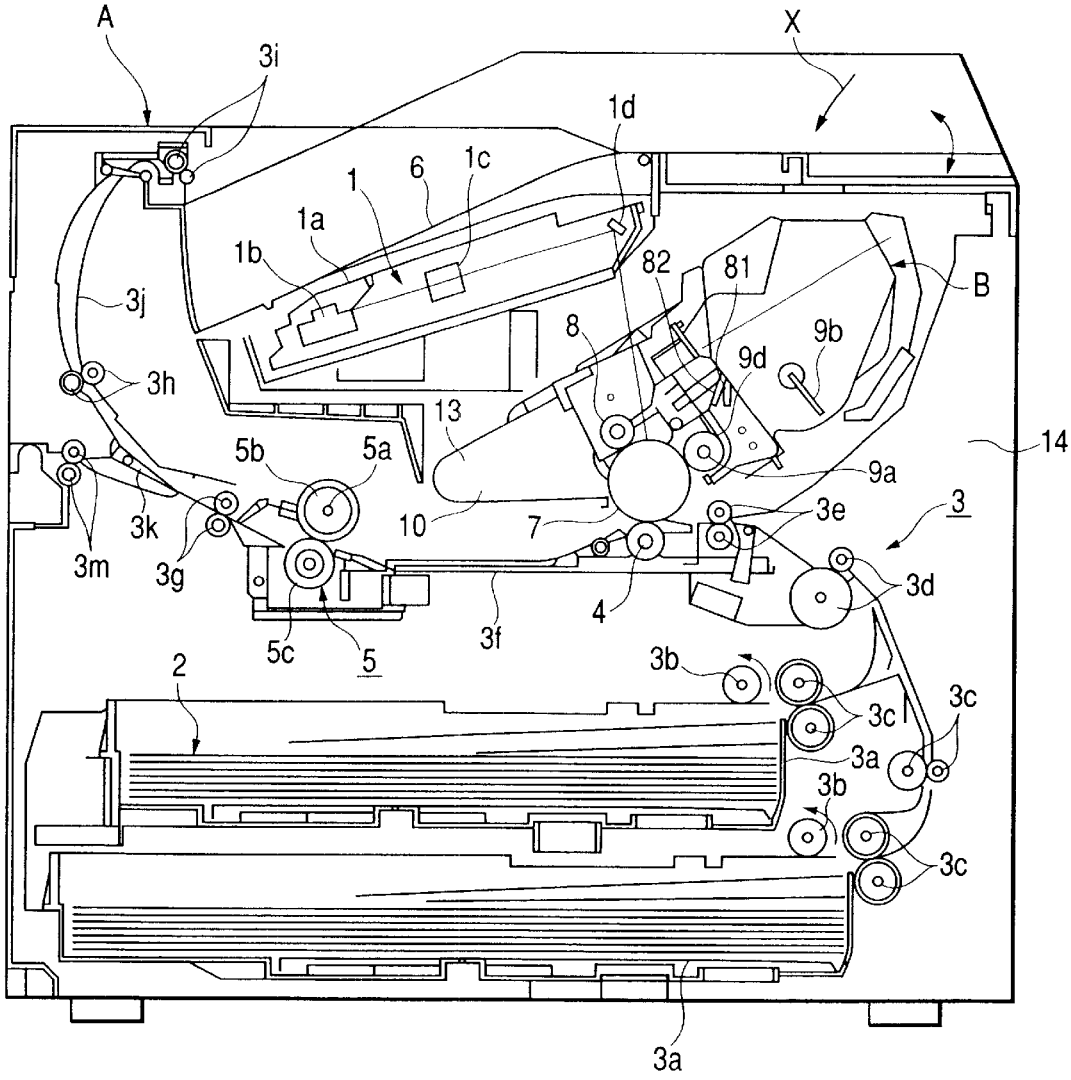
FIG. 14 is a schematic structural diagram showing the electrophotographic image forming apparatus in accordance with another embodiment of the present invention.
Figure 15:
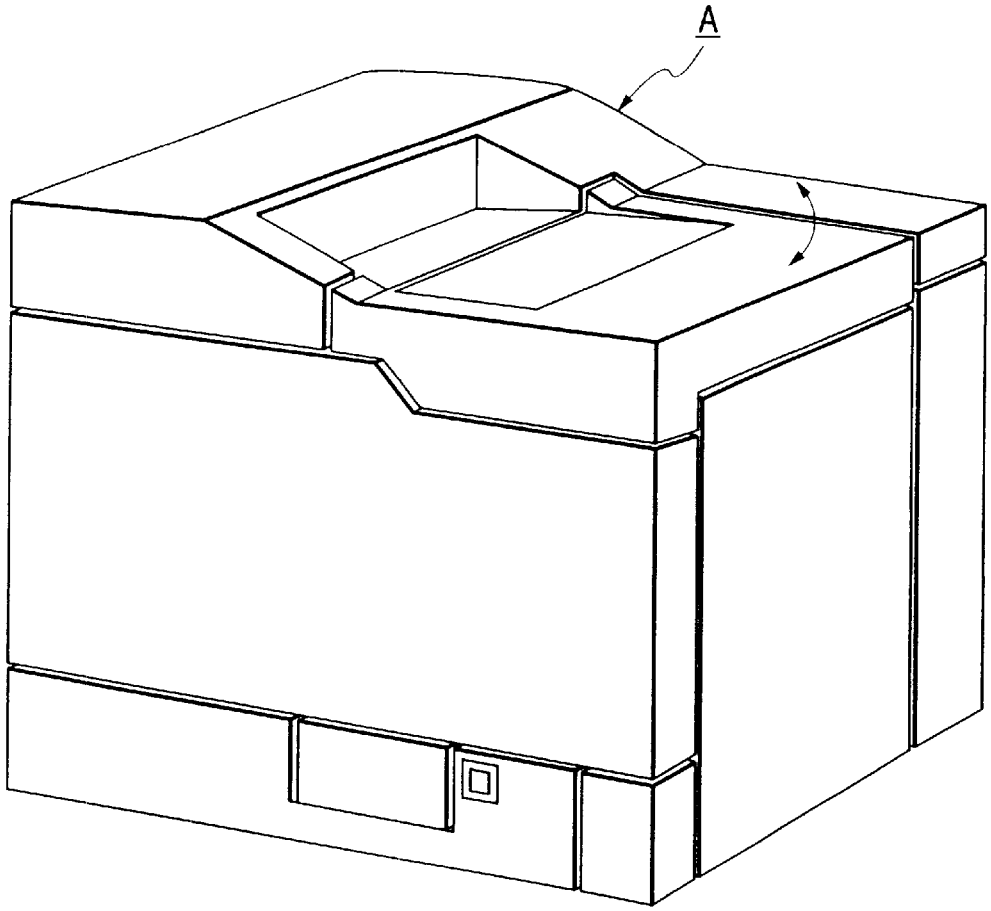
FIG. 15 is a perspective view of an external appearance of the electrophotographic image forming apparatus in the present invention.
Figure 16:
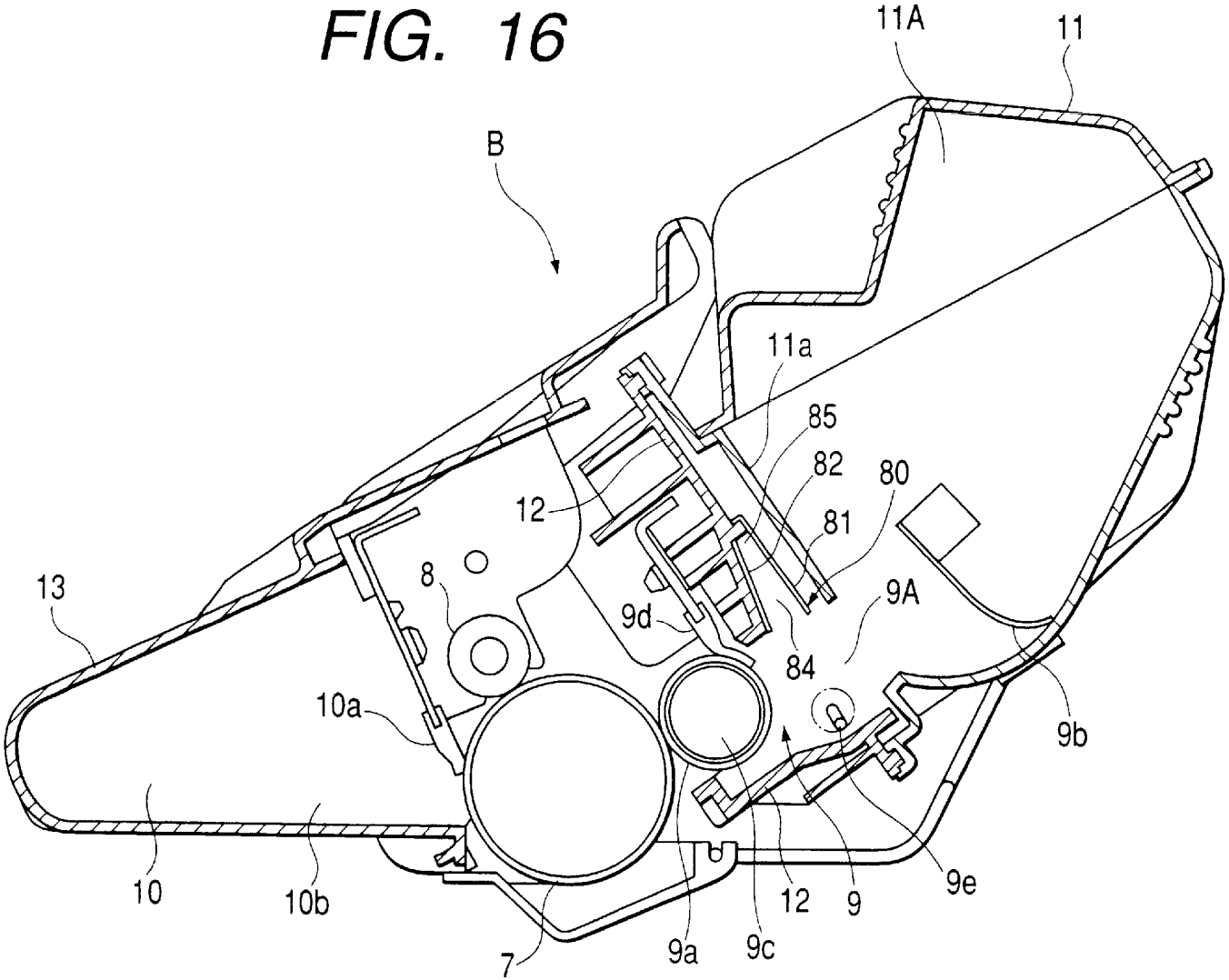
FIG. 16 is a longitudinal sectional view of a process cartridge in accordance with an embodiment of the present invention.

As mentioned above, in accordance with the present invention, the process cartridge has plural developer remaining amount detecting means for detecting the remaining amount of the developer in accordance with depletion of the developer usable within the cartridge. However, FIGS. 14 to 16 show another embodiment of the electrophotographic image forming apparatus to which such a process cartridge constructed in accordance with the present invention can be mounted.

An entire construction of the electrophotographic image forming apparatus of this embodiment is similar to that of the laser beam printer A of an electrophotographic system in the first embodiment explained above. An image is formed on a recording medium such as recording paper, an OHP sheet, a cloth, etc. by an electrophotographic image forming process.

The laser beam printer A has a drum-shaped electrophotographic photosensitive member, i.e., a photosensitive drum 7. The photosensitive drum 7 is charged by a charging roller 8 as charging means. A latent image according to image information is next formed on the photosensitive drum 7 by irradiating a laser beam according to the image information from optical means 1 having a laser diode 1*a*, a polygon mirror 1*b*, a lens 1*c* and a reflecting mirror 1*d*. This latent image is developed by developing means 9 and is set to a visible image, i.e., a toner image.

That is, the developing device 9 is equipped with a developing chamber 9A which includes a developing roller 9*a* that functions as a developer bearing member. A developer contained in the developer container 11A that functions as a developer containing portion which is so formed as to be adjacent to the developing chamber 9A is fed to the developing roller 9*a* of the developing chamber 9A by rotation of a developer feeding member 9*b*. The developing chamber 9A is equipped with an developer agitating device 9*e* in the vicinity of the developing roller 9*a* to circulate the developer within the developing chamber. Also, the developing roller 9*a* includes a stationary magnet 9*c* therein, and the developer is carried by rotation of the developing roller 9*a*. Then, the developer is given triboelectrication charges and formed into a developer layer having a predetermined thickness by a developing blade 9*d*. Thereafter, the developer is supplied to a developing region of the photosensitive drum 7. The developer supplied to the developing region is translated into a latent image on the photosensitive drum 7, thus forming a toner image. The developing roller 9*a* is connected to a developing bias circuit so that a developing bias voltage resulting from superimposing a d.c. voltage on an a.c. voltage is normally applied to the developing roller 9*a*.

On the other hand, a recording medium 2 set in a sheet feeding cassette 3*a* is conveyed to a transfer position by a pickup roller 3*b*, pairs of conveying rollers 3*c*, 3*d*, and a pair of registration rollers 3*e* in synchronism with the formation of the toner image. A transfer roller 4 is disposed as transfer means at the transfer position, and the toner image on the photosensitive drum 7 is transferred onto the recording medium 2.

The recording medium 2 onto which the toner image has been transferred is conveyed to fixing means 5 by a conveying guide 3*f*. The fixing means 5 includes a fixing roller 5*b* having a heater 5*a* therein and a driving roller 5*c* which applies a heat and a pressure to the recording medium 2 which is passing through the fixing roller 5*b* to fix the transferred toner image onto the recording medium 2.

The recording medium 2 is conveyed by pairs of discharge rollers 3*g*, 3*h* and 3*i* and then discharged to a discharge tray 6 through a surface reverse path 3*j*. The discharge tray 6 is disposed on an upper surface of a device body 14 of the laser beam-printer A. Alternatively, a swingable flapper 3*k* may be operated so as to discharge the recording medium 2 by a pair of discharge rollers 3*m* not through the surface reverse path 3*j*. In this embodiment, the conveying means is made up of the pickup roller 3*b*, the pairs of conveying rollers 3*c*, 3*d*, and the pair of registration rollers 3*e*, the conveying guide 3*f*, the pairs of discharge rollers 3*g*, 3*h*, 3*i* and the pair of discharge rollers 3*m*.

The photosensitive drum 7 from which the toner image has been transferred onto the recording medium 2 by the transfer roller 4 is subjected to a succeeding image forming process after the developer remaining on the photosensitive drum 7 has been removed by cleaning means 10. The cleaning means 10 scrapes off the residual developer on the photosensitive drum 7 by an elastic cleaning blade 10*a* abutted against the photosensitive drum 7 and collects the residual developer into a waste developer reservoir 10*b*.

On the other hand, in this embodiment, as shown in FIG. 16, a process cartridge B is produced in such a manner that a developer frame 11 having the developer container (developer containing portion) 11A that contains the developer therein and a developer feeding member 9*b* and a developing frame 12 that holds the developing means 9 such as the developing roller 9*a* and the developing blade 9*d* are welded integrally into a developing unit, and a cleaning frame 13 to which the photosensitive drum 7, the cleaning means 10 such as the cleaning blade 10*a* and the charging roller 8 are fitted is integrally coupled to the developing unit into a cartridge.

Figure 17:
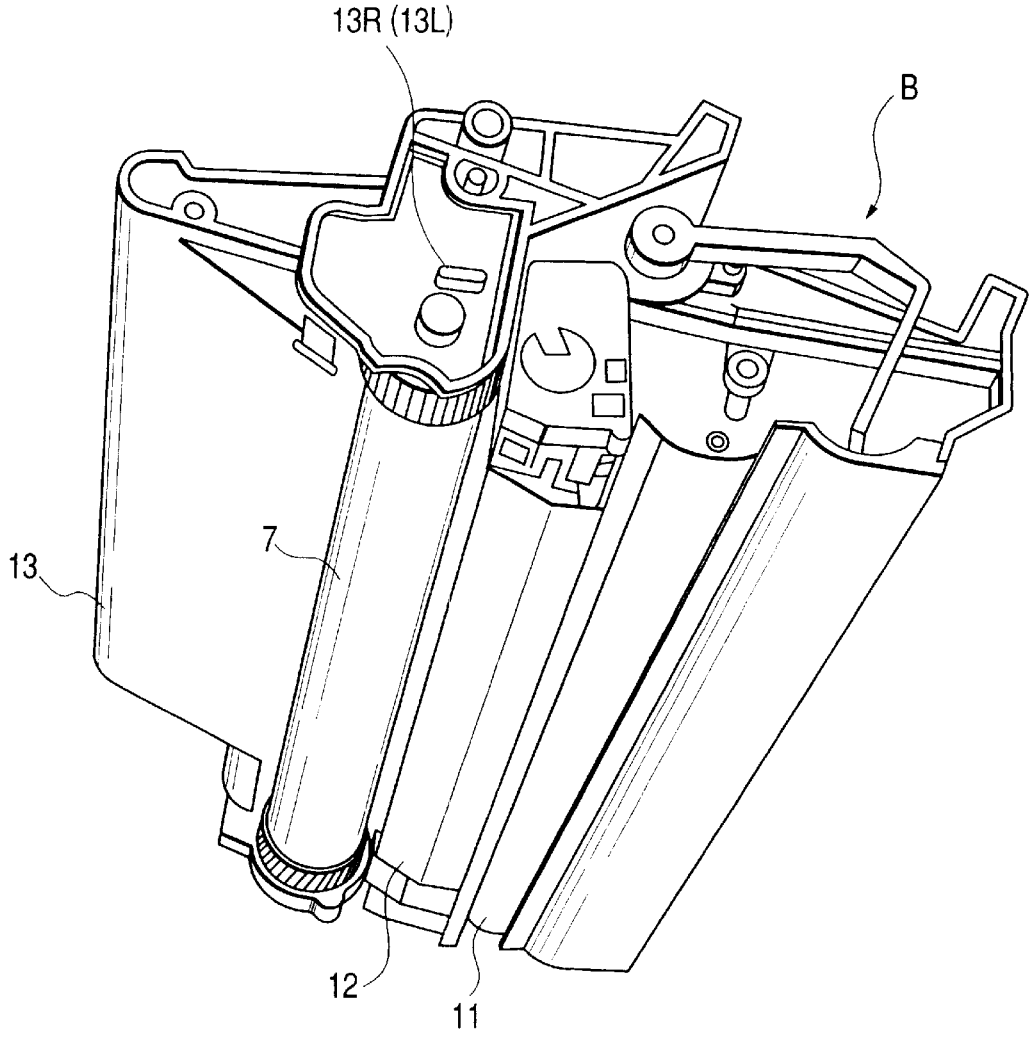
FIG. 17 is a perspective view of an external appearance of the process cartridge in the present invention seen from below.
Figure 18:
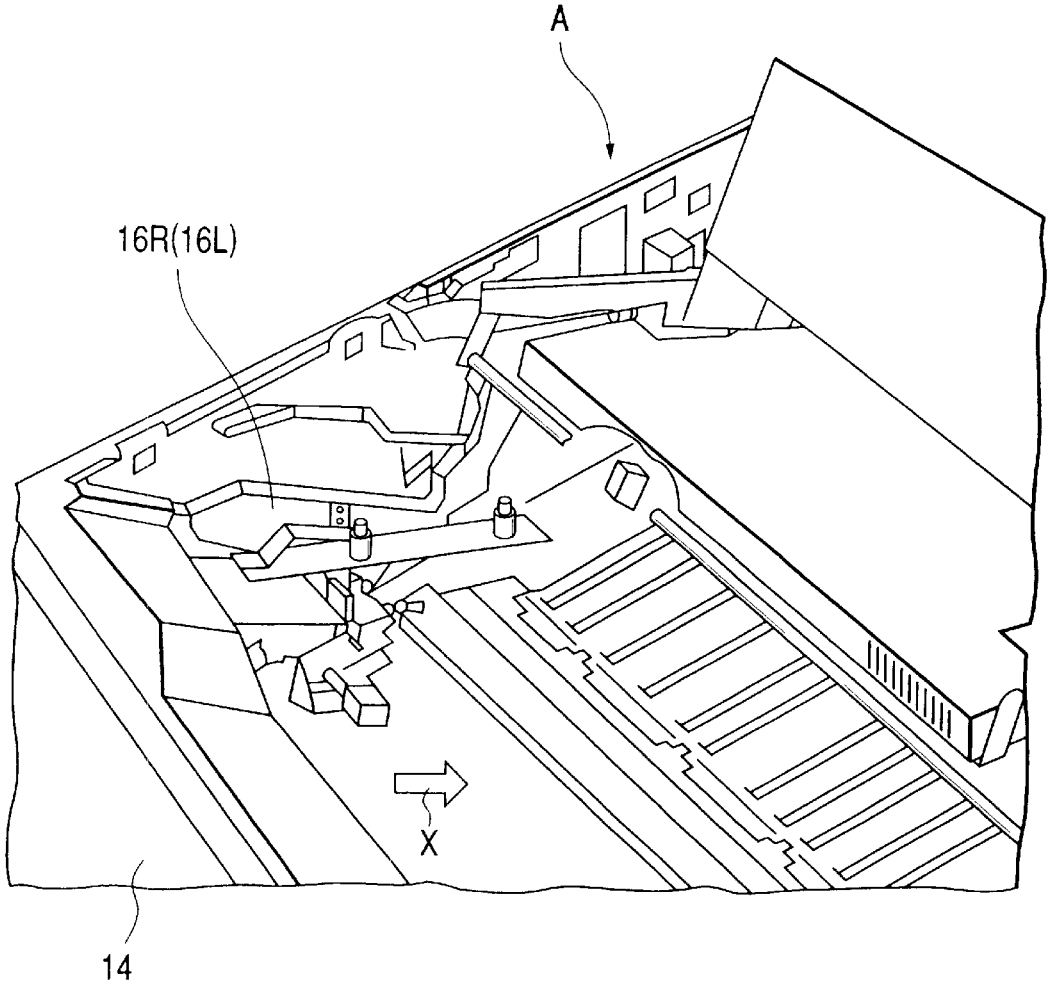
FIG. 18 is a perspective view showing the external appearance of a mounting portion of an apparatus main body for mounting the process cartridge.

The process cartridge B is detachably mounted on the cartridge mounting means disposed in a main body 14 of the image forming apparatus by a user. According to this embodiment, the cartridge mounting means is made up of guide means 13R (13L) formed on both of outer side surfaces of the process cartridge B as shown in FIG. 17 and a guide portion 16R (16L) (FIG. 18) formed in the main body 14 of the apparatus so that the guide means 13R (13L) is insertable into the guide portion 16R (16L).

According to the present invention, the process cartridge B includes a developer amount detecting device which is capable of successively detecting the remaining amount of developer in accordance with the depletion of the developer within the developer container 11A. According to the present invention, the developer amount detecting device includes a plurality of developer remaining amount detecting means, and in this embodiment, the developer amount detecting device is made up of a first developer remaining amount detecting means and a second developer remaining amount detecting means.

First, the first developer remaining amount detecting means will be described. According to this embodiment, as shown in FIGS. 19A and 19B, the first developer remaining amount detecting means includes a measuring electrode member 20A that detects the amount of developer and a reference electrode member 20B that detects the circumstance, that is, the temperature and the humidity of the atmosphere and acts as a comparing member that outputs a reference signal.

Figure 19A:
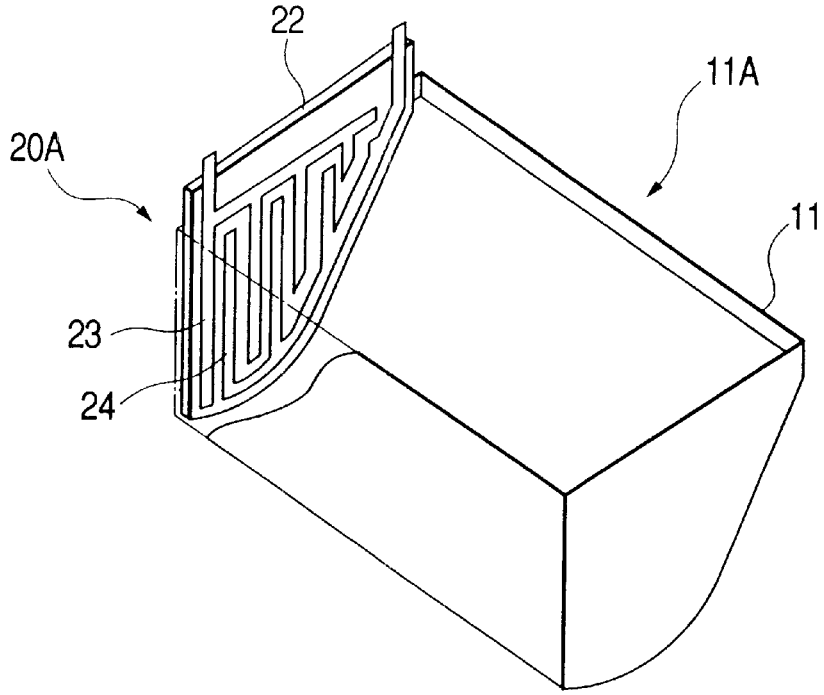
FIGS. 19A and 19B are perspective views showing a developer container, a measuring electrode member and a reference electrode member for explaining a developer amount detecting device in accordance with the present invention.
Figure 19B:
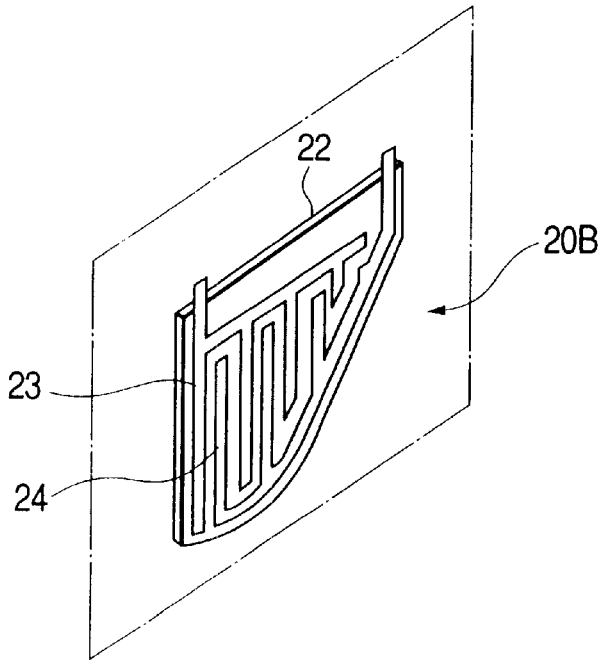
Figure 26:
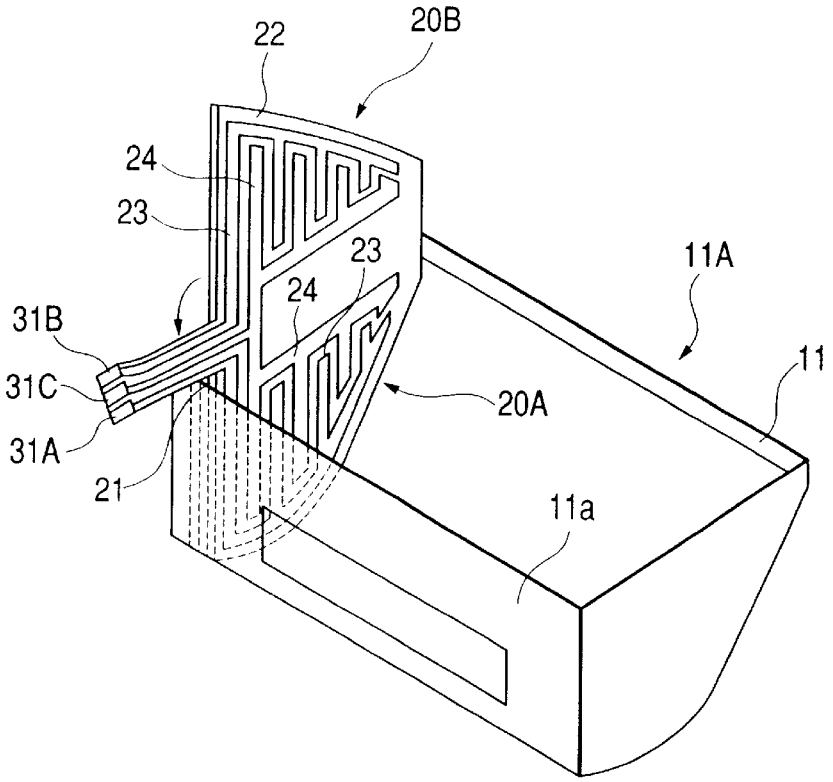
FIG. 26 is a perspective view of the developer container for explaining the developer amount detecting device in accordance with an embodiment of the present invention.
Figure 27:
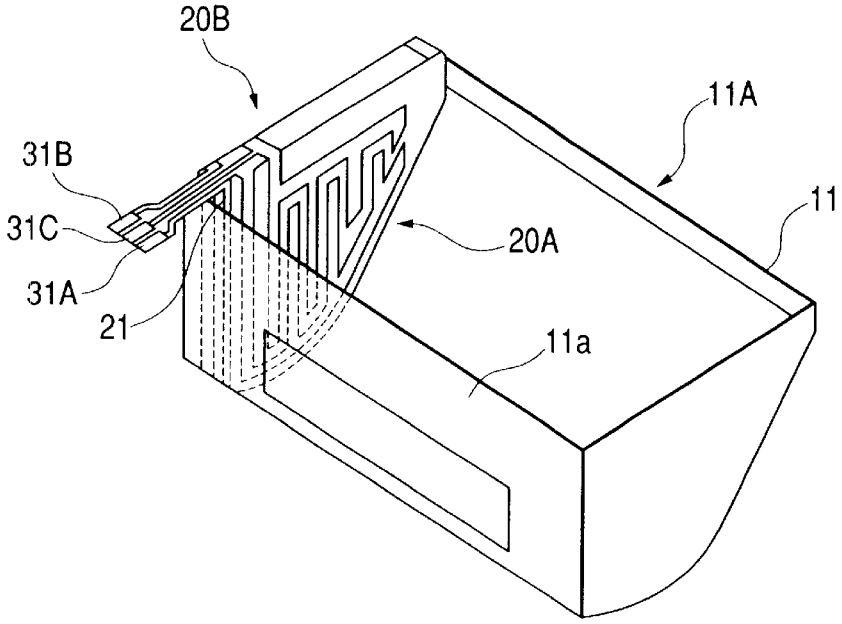
FIG. 27 is a perspective view of the developer container similar to FIG. 26 and explaining a mode in which the reference electrode member is arranged within the developer container.

For example, as shown in FIG. 19A, the measuring electrode member 20A is disposed at a position which is in contact with the developer on the inner side surface of the developer container 11A of the developing device 9 or the bottom surface of the developer container 11A thereof, and also in a direction along which the contact area with the developer is varied as the developer is reduced. Also, although being described in more detail later, the reference electrode member 20B may be disposed within the developer container at the same side as a side where the measuring electrode member 20A is disposed and also at a portion sectioned by a partition wall 21, which is out of the developer as shown in FIGS. 26 and 27.

Figure 20:
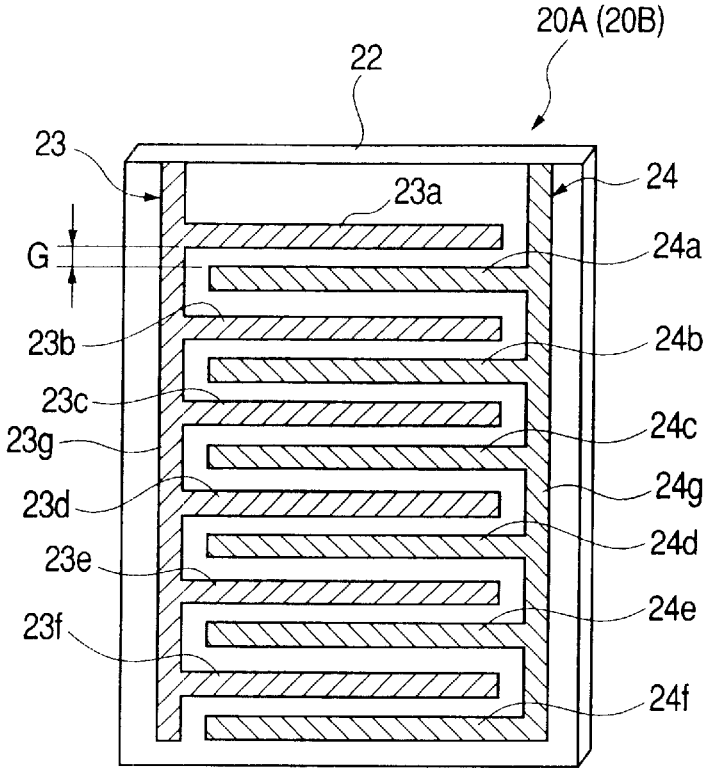
FIG. 20 is a front view showing the measuring electrode member and the reference electrode member in accordance with an embodiment of the present invention.
Figure 21:
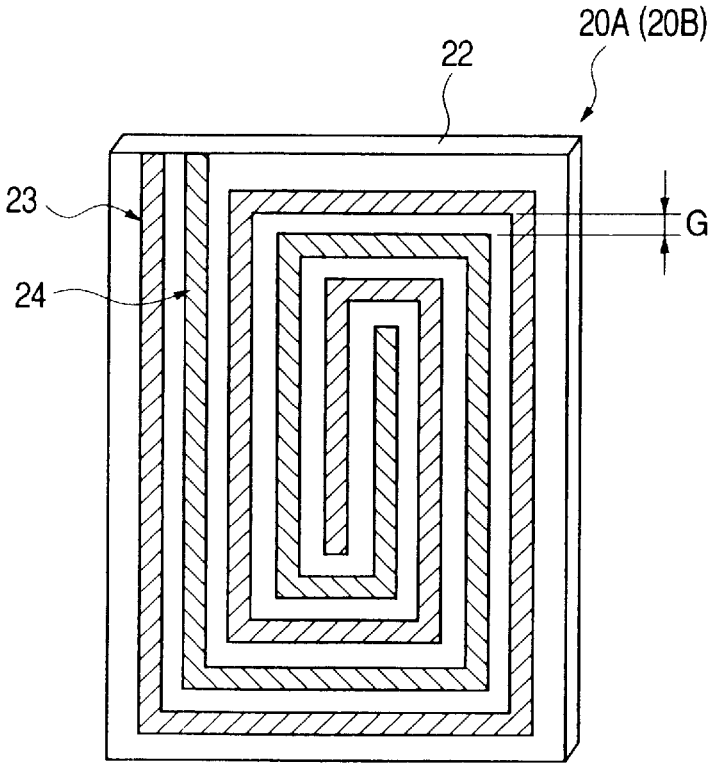
FIG. 21 is a front view showing the measuring electrode member and the reference electrode member in accordance with another embodiment of the present invention.

The measuring electrode member 20A includes a pair of electrodes, that is, an input side electrode 23 and an output side electrode 24 which are formed in parallel with each other on a substrate 22 at a given interval as shown in FIG. 20. In this embodiment, electrodes 23 and 24 have at least a pair of electrode portions 23*a* to 23*f* and 24*a* to 24*f* which are disposed in parallel with each other at a given interval G, and the respective electrode portions 23*a* to 23*f* and 24*a* to 24*f* are connected to each other by connecting electrode portions 23*g* and 24*g*, respectively. Those two electrodes 23 and 24 are made in a large number of concave/convex shapes which are associated with each other. It is needless to say that the electrode pattern of the measuring electrode member 20A is not limited to the above structure, but the electrode pattern may be formed in such a spiral shape that a pair of electrodes 23 and 24 are disposed in parallel with each other at a given interval as shown in FIG. 21.

The measuring electrode member 20A can successively detect the remaining amount of developer within the developer container 11A by measuring the capacitance between the pair of parallel electrodes 23 and 24. In other words, because the developer is larger in dielectric constant than air, the capacitance between the pair of electrodes 23 and 24 increases by bringing the developer in contact with the surface of the measuring electrode member 20A.

Therefore, according to this embodiment, the use of the measuring electrode member 20A with the above structure enables the amount of developer within the developer container 11A to be measured from an area of the developer which is in contact with the surface of the measuring electrode member 20A by application of a given correction curve regardless of the sectional shape of the developer container 11A or the shape of the measuring electrode member 20A.

The electrode patterns 23 and 24 of the above measuring electrode member 20A can be obtained by forming conducting metal patterns 23 and 24 made of copper or the like on a hard print substrate 22 which is for example, 0.4 to 1.6 mm in thickness and made of, for example, paper phenol, glass epoxy or the like, or a flexible printed board 22 which is about 0.1 mm in thickness and made of polyester, polyimide or the like through etching or printing. Those electrode patterns 23 and 24 can be manufactured in the same method as the normal method of forming a wiring pattern on the printed board. Therefore, the electrode patterns 23 and 24 can be readily manufactured even if they are in a complicated electrode pattern shape as shown in FIGS. 20 and 21, and the manufacturing costs are also almost identical with those for a simple pattern.

The use of the complicated pattern shape shown in FIGS. 20 and 21 enables an opposed length between the electrodes 23 and 24, and the application of the pattern forming method such as etching enables an interval G between the electrodes 23 and 24 to be narrowed to the degree of about several tens $\mu$m, thereby being capable of obtaining a larger capacitance. Also, the amount of change in capacitance can be increased, thereby being capable of enhancing an accuracy in detection. Specifically, the electrodes 23 and 24 is set to 0.1 to 0.5 mm in width and 17.5 to 70 $\mu$m in thickness, and the interval G is set to 0.1 to 0.5 mm. Also, a metal pattern formation surface can be laminated by a thin resin film which is, for example, about 12.5 to 125 $\mu$m in thickness.

As described above, in the developer amount detecting device according to the present invention, a change in the contact area of the developer with respect to the measuring electrode member 20A located in a direction along which the developer on the inner side surface or the inner bottom surface of the developer container 11A is reduced, that is, a change in the capacitance of the measuring electrode member 20A is measured, and the amount of developer of the entire developer container is successively detected in accordance with the measured value.

In other words, because the dielectric coefficient of the developer is larger than that of air, a portion of the measuring electrode member 20A which is in contact with the developer (a portion where the developer exists) is larger in outputted capacitance than a portion of the measuring electrode member 20A which is out of contact with the developer (a portion where no developer exists). Consequently, if a change in the capacitance is measured, the amount of developer within the developer container 11A can be presumed.

According to the present invention, the developer remaining amount detecting device has a reference electrode member 20B having the same structure as that of the measuring electrode member 20A as shown in FIGS. 19A and 19B.

The reference electrode member 20B may be structured in the same manner as that of the above measuring electrode member 20A. As shown in FIG. 20, the reference electrode member 20B includes a pair of an input side electrode 23 (23*a* to 23*f*) and an output side electrode 24 (24*a* to 24*f*) which are formed in parallel with each other on a substrate 22 at a given interval G, and those two electrodes 23 and 24 may be associated with each other into a large number of concave/convex shapes, or may be formed in a spiral shape as shown in FIG. 21. Similarly, the reference electrode member 20B can be manufactured in the same method as the normal method of forming a wiring pattern on the printed board.

According to this embodiment, as described above, the reference electrode member 20B varies in capacitance depending on the circumstantial conditions such as the temperature and the humidity and functions as a comparing member for reference with respect to the measuring electrode member 20A.

In other words, in the first developer remaining amount detecting means according to this embodiment, an output of the measuring electrode member 20A is compared with an output of the reference electrode member 20B which varies in accordance with the circumstance variable. For example, if a given capacitance of the reference electrode member 20B is set to the same value as that of the measuring electrode member 20A to take a difference between the output of the reference electrode member 20B and the output of the measuring electrode member 20A, an output of only the change in the capacitance due to the developer can be obtained, thereby being capable of enhancing a precision in the detection of the developer remaining amount.

The principle of the developer amount detection according to this embodiment will be further described. Since the measuring electrode member 20A measures the capacitance of a contact portion of the pattern surface and presumes the amount of developer within the developer container 11A, a value of the developer amount varies with the circumstance variable (humidity, temperature, etc.).

For example, since the amount of steam in air becomes larger as the humidity is high, the dielectric coefficient of the atmosphere which is in contact with the detecting member 20A also increases. For that reason, even when the amount of developer is the same, an output from the measuring electrode member 20A also changes with the circumstance variable. Also, if the substrate 22 on which the pattern is formed is made of a hygroscopic material, because the dielectric coefficient changes due to the hygroscopicity, the circumstance varies.

For that reason, the reference electrode member 20B that functions as the comparing member having the same circumstance variable as the measuring electrode member 20A, that is, for example, the reference electrode member 20B having the same structure as that of the measuring electrode member 20A which is out of contact with the developer is located under the same circumstance as those of the measuring electrode member 20A, both outputs of those electrode members 20A and 20B are compared with each other to take a difference therebetween and cancel the circumstance variable, thereby being capable of measuring the remaining amount of developer without being adversely affected by the circumstance variable.

Figure 22:
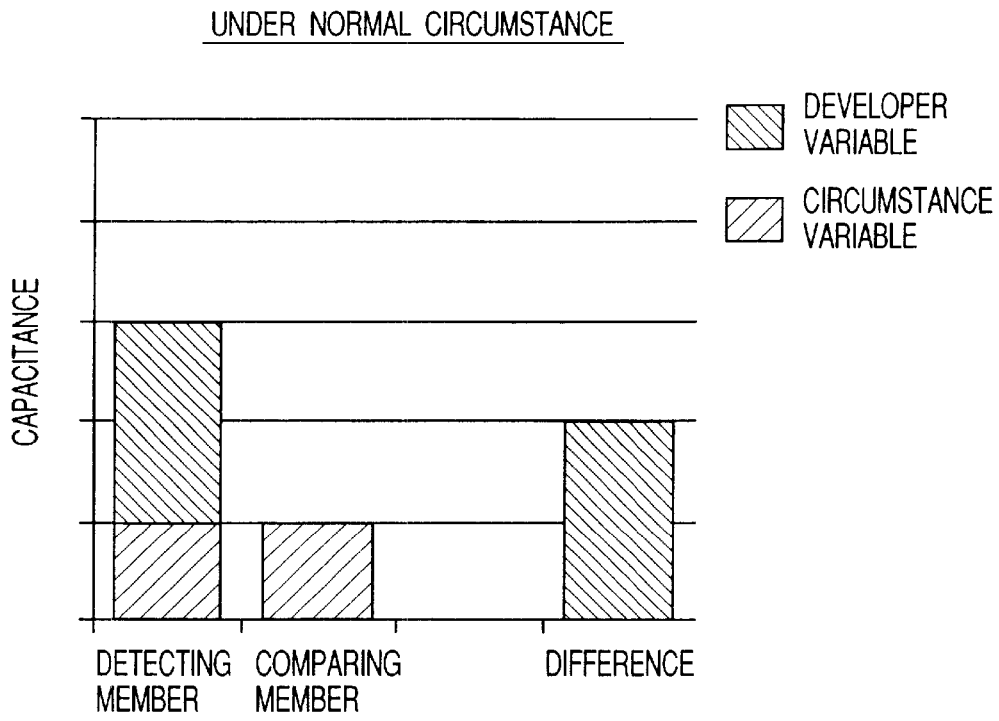
FIG. 22 is a graph for explaining a developer amount detecting principle in accordance with the present invention.

As shown in a bar graph on the most left side of FIG. 22, the capacitance measured from the measuring electrode member 20A which is a detecting member that detects the amount of developer is outputted after the circumstance variable is added to the variable caused by the developer which is in contact with the surface of the detecting member. Then, the outputted capacitance is shifted to the high-temperature high-humidity circumstances, because the circumstance variable increases although the variable caused by the developer does not change as shown in the bar graph on the most left bar graph of FIG. 23, the capacitance is resultantly caused to increase regardless of the same amount of developer.

Figure 23:
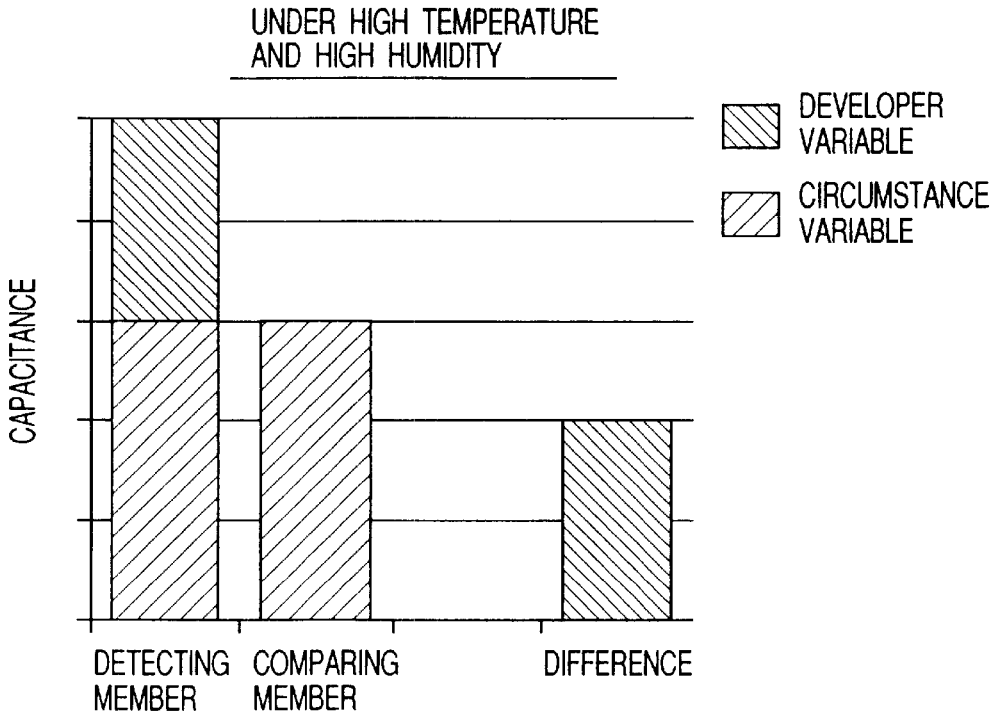
FIG. 23 is a graph for explaining the developer amount detecting principle in accordance with the present invention.

Under the above circumstance, as shown in the middle bar graphs of FIGS. 22 and 23, the reference electrode member (comparing member) 20B having the same circumstance variable as that of the measuring electrode member (detecting member) 20A is disposed to take a difference therebetween (a bar graph on the right side), thereby being capable of measuring only the capacitance caused by the developer.

Figure 24:
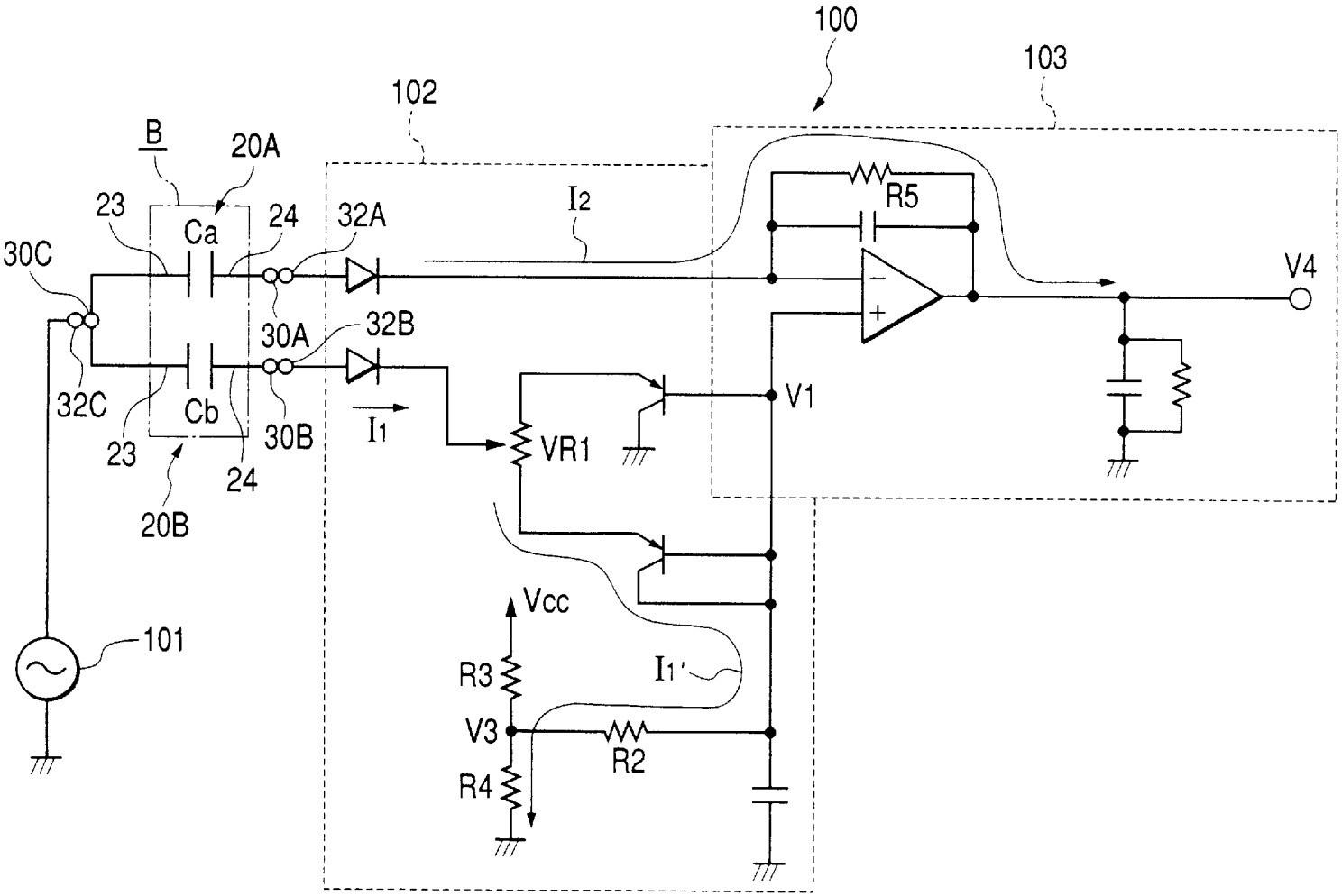
FIG. 24 is a view showing the developer amount detecting circuit for the developer amount detecting device in accordance with another embodiment of the present invention.

The developer amount detecting device that embodies the principle of the present invention will be described with reference to FIG. 24. FIG. 24 shows an example of a developer amount detecting circuit together with a connecting mode of the measuring electrode member 20A and the reference electrode member 20B in the image forming apparatus.

Each of the measuring electrode member 20A that functions as a detecting member having the capacitance Ca that varies with the amount of developer and the reference electrode member 20B that functions as a comparing member having the capacitance Cb that varies with the circumstantial conditions are designed in such a manner that one input side electrode 23 that functions as an impedance element is connected to a developing bias circuit 101 that functions as the developing bias applying means through a contact point 30C (the apparatus main body side contact point is 32C) whereas the other output side electrode 24 is connected to a control circuit 102 of the developer amount detecting circuit 100 through the contact points 30A (apparatus main body side contact point 32A) and 30B (apparatus main body side contact point 32B). The reference electrode member 20B is set with a reference voltage V1 in detection of the remaining amount of developer by using an a.c. (alternating) current $I_1$ supplied through the developing bias circuit 101.

As shown in FIG. 24, the control circuit 102 adds a voltage drop amount V2 caused by an a.c. current $I_1$, which is a value resulting from dividing the a.c. current $I_1$ which is supplied to the reference electrode member 20B, that is, an impedance element by a volume VR1, and a resistor R2 to a set voltage V3 set by resistors R3 and R4 to determine the reference voltage V1.

Therefore, an a.c. (alternating) current $I_2$ which is supplied to the measuring electrode member 20A is inputted to an amplifier 103 and outputted as a detected value V4 ($V1-I_2 \times R5$) of the remaining amount of developer. Then, the output value is used as the detected value of the remaining amount of developer.

As described above, according to the developer amount detecting device of the present invention, since the reference electrode member 20B that varies in the capacitance according to the circumstance as in the measuring electrode member 20A, the circumstance variable of the measuring electrode member 20A can be canceled, thereby being capable of detecting the remaining amount of developer with a high precision.

Figure 25:
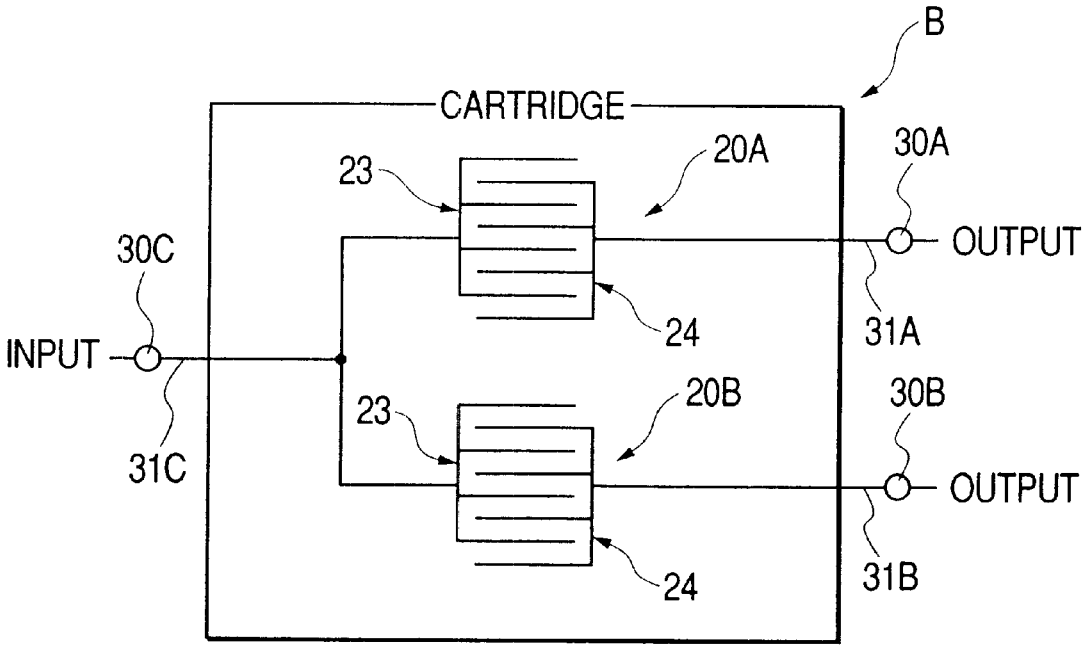
FIG. 25 is a view for explaining an arrangement construction of the measuring electrode member and the reference electrode member.

According to this embodiment, as shown in FIGS. 25 to 27, the measuring electrode member 20A and the reference electrode member 20B structured for comparison in the same manner as that of the measuring electrode member are disposed in the developer container 11A of the developing means 4. Because the above structure includes the measuring electrode member 20A and the reference electrode member 20B in the developer container, the circumstance variable can be canceled, and the measuring electrode member 20A and the reference electrode member 20B can be located under substantially the same circumstances, thereby being capable of enhancing a precision in detection.

Further, according to this embodiment, as is understood with reference to FIGS. 26 and 27, the measuring electrode member 20A and the reference electrode member 20B can be designed in such a manner that the respective electrodes 23 and 24 are formed on one surface of a single bendable substrate 22 such as a flexible printed board and folded back so as to be disposed within the developer container. Also, in this embodiment, the measuring electrode member 20A and the reference electrode member 20B have the same electrode pattern. That is, the patterns of both the electrodes 23 and 24 of the measuring electrode member 20A and the reference electrode member 20B are so shaped as to be substantially identical in the capacitance and substantially identical in the pattern width, the length, the interval and the opposed area. The reference electrode member 20B thus manufactured is folded back on substantially the center of the substrate and is disposed on a location which is in the interior of the developer container 11A where the measuring electrode member 20A is disposed, which is sectioned by a partition wall 21 and which is out of contact with the developer.

As described above, the measuring electrode member 20A and the reference electrode member 20B are manufactured in the same process as a normal printed board manufacturing process, and therefore there occur a variation in the coefficient of moisture absorption of the material and the dielectric coefficient of the material and a variation in the capacitance of the substrate due to a difference in the etching conditions and variations in the electrode pattern width and height. In the present invention, since the single substrate serves as the detecting member and the comparing member with the formation of the measuring electrode member 20A and the reference electrode member 20B on the same surface of the substrate, two or more substrates are not required, thereby being capable of making the costs low. Also, since the electrode patterns are formed on the same material, a variation in the material difference can be suppressed, and also since the patterns are formed on the same surface, a variation in the pattern formation such as etching can be suppressed. In addition, with the above structure, the detecting pattern can be disposed onto the upper portion of the developer container, and for that reason, the amount of developer can be measured even in a state where the developer container is almost full with the developer.

In the description of the above embodiments, the patterns of both the electrodes 23 and 24 of the measuring electrode member 20A and the reference electrode member 20B are so shaped as to be substantially identical in the capacitance and substantially identical in the pattern width, the pattern length, the pattern interval and the opposed area. However, the areas of the electrode patterns 23 and 24 of the reference electrode member 20B for comparison may be made different from the areas of the electrode patterns 23 and 24 of the measuring electrode member 20A. In this case, an output of the reference electrode member 20B is converted into an output resulting from multiplying the output by a given coefficient, and the output thus converted is compared with an output of the measuring electrode member 20A. With the above structure, since the reference electrode member 20B can be small-sized, a space for disposing the detecting member can be made small. Also, the structure can be made in such a manner that the measuring electrode member 20A and the reference electrode member 20B are disposed on the same wall surface on the same side of the developer container 11A, and the reference electrode member 20B is sectioned so as to be out of contact with the developer. In this case, the ratio of the pattern to the limited area on the detecting member 20A side can be increased, thereby being capable of enhancing the variation and precision in the capacitance.

In the present specification, a description that the value of the capacitance occurring when a voltage is applied to the electrode member is the same was made. However, the same value includes not only that the value is completely the same but also that the electrode members are manufactured intentionally so that the value becomes the same. Accordingly, for example, an error caused by the manufacturing variation or the like of the electrode members is included in the same value.

Similarly, the description that the numeric values and the shapes are the same such that the interval between the electrode members is kept constant, the opposed length of the electrodes are the same, the interval of the opposed portion is the same, and the shapes of the measuring electrode member and the reference electrode member are identical includes that the electrode members are intentionally manufactured so that the values or the shapes are the same.

Accordingly, for example, an error in numerical values caused by the manufacturing fluctuations or the like and the difference in shapes are included in the same value or the same shape.

Subsequently, the second developer remaining amount detecting means of the developer amount detecting device will be described.

According to this embodiment, as shown in FIGS. 14 and 16, the second developer remaining amount detecting means is structured in such a manner that a first electrically conductive portion (electrode) 81 and a second electrically conductive portion (electrode) 82 which function as measuring electrode portions that constitute the developer detecting portion 80 of the second developer remaining amount detecting means are disposed along the developing roller 9*a*, and a voltage is applied to any one of the first electrode 81 and the second electrode 82, whereby a capacitance is induced between both the electrodes 81 and 82 and the capacitance is measured to detect the amount of developer. In this embodiment, as will be described in more detail later, a voltage is applied to the first electrode 81.

The magnetic developer attracted onto the surface of the developing roller 9*a* by a magnetic force of a magnet roller 9*c* surrounded by the developing roller 9*a* is scrapped off by the developing blade 9*d* when the developing roller 9*a* rotates and made uniform on the surface of the developing roller 9*a*.

The first and second electrodes 81 and 82 are disposed on positions where the developer scrapped off from the surface of the developing roller 9*a* enters a space between both the electrodes 81 and 82.

Figure 28:
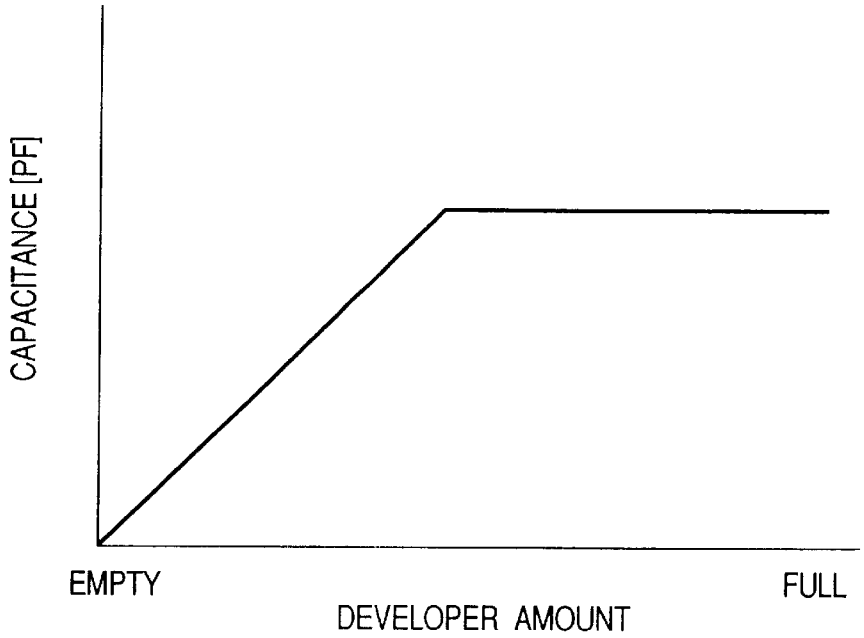
FIG. 28 is a graph showing the relation of a developer amount and capacitance in the developer amount detecting device in accordance with the present invention.

Because the dielectric coefficient of the developer is higher than that of air, when the developer exists between the first and second electrodes 81 and 82, the capacitance increases. Accordingly, as will be described later, if sufficient developer exists within the developing chamber 9A, the above-described scrapped-off developer successively enters the space between the first and second electrodes 81 and 82, therefore a larger capacitance is always outputted. Also, the developer that enters the space between the first and second electrodes 81 and 82 is also decreased more as the developer within the developing chamber 9A is depleted more, and the capacitance is also decreased. That is, the developer amount detecting device can successively detect the amount of developer with a detection of a change in the capacitance. FIG. 28 schematically shows the above detection.

Also, in order to improve a precision in detection in successively detecting the amount of developer, the variation of the capacitance may be increased. Accordingly, it is preferable that the first and second electrodes 81 and 82 are made large in size, and the capacitance is increased. In particular, it is preferable that the widths of the first and second electrodes 81 and 82 on the opposed side are set to be larger than the interval therebetween.

Figure 32:
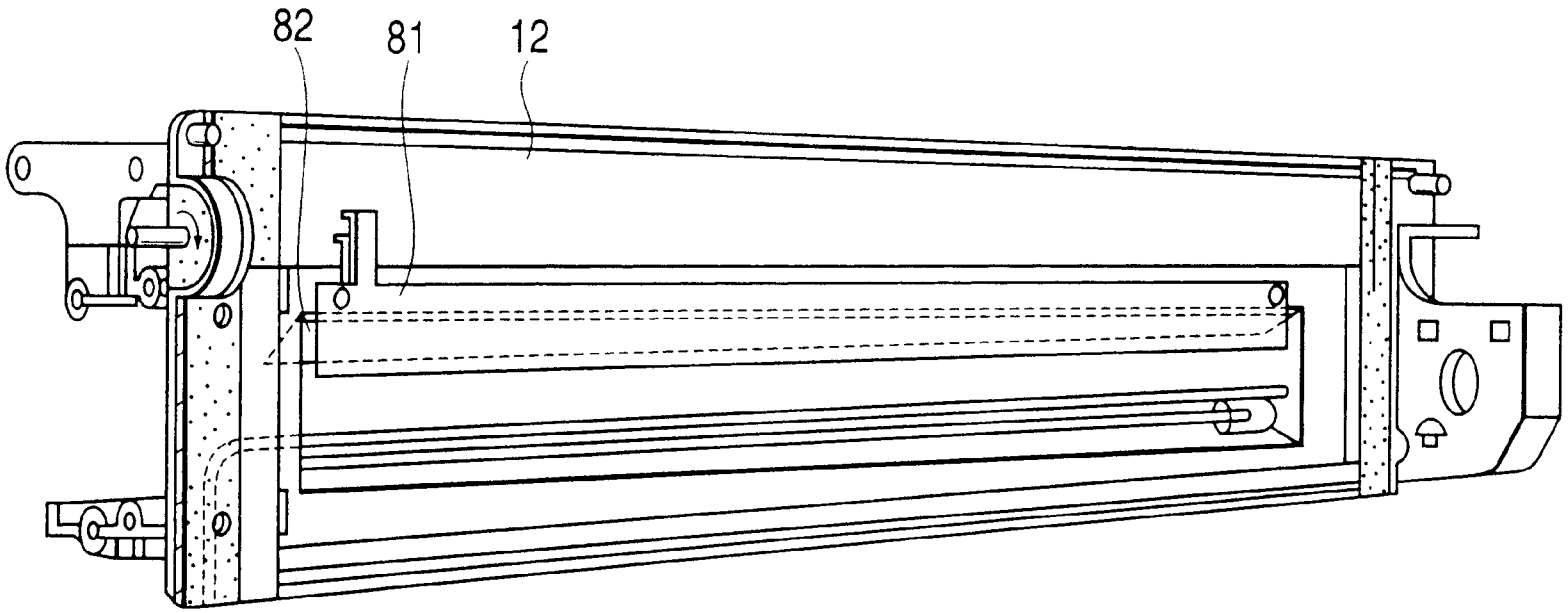
FIG. 32 is a perspective view showing attaching modes of the first and second electrodes with respect to a developing frame.
Figure 39:
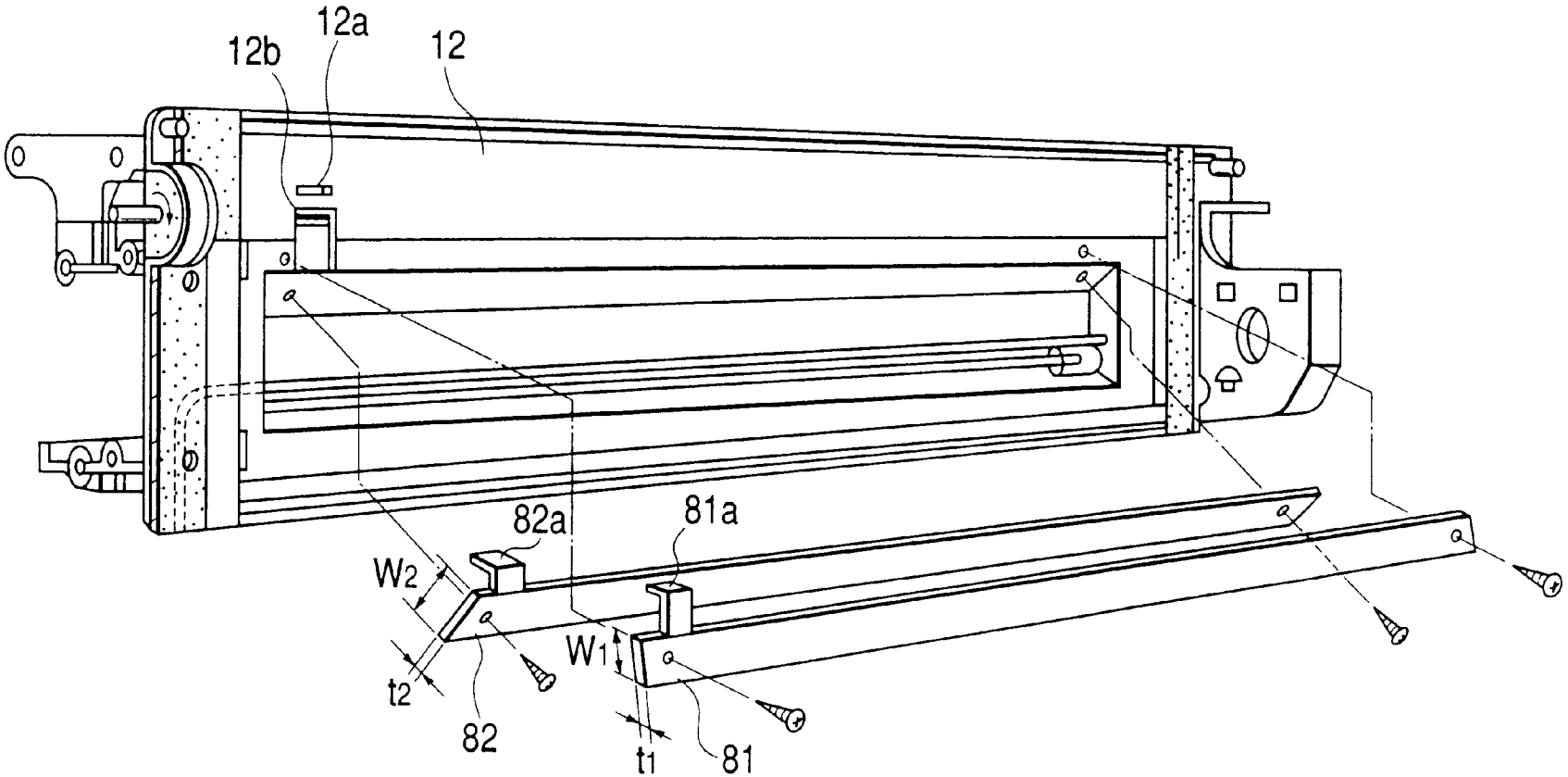
FIG. 39 is a perspective view showing attaching modes of the first and second electrodes with respect to the developing frame in accordance with an embodiment of the present invention.

As may be better understood with reference to FIGS. 32 and 39, in this embodiment, the first and second electrodes 81 and 82 are in a slender shape extending along the longitudinal direction of the developing roller 9*a* and made of an electrically conductive material such as stainless steel (SUS), iron, phosphor bronze, aluminum or an electrically conductive resin. In this way, if the first and second electrodes 81 and 82 are made of the electrically conductive material, all of those electrodes 81 and 82 conduct the equivalent operation. However, in the present invention, a non-magnetic metal material such as a non-magnetic SUS material is used in order to avoid to circulation of the developer.

More specifically, in this embodiment, the first electrode 81 is made of a non-magnetic SUS material which is 14 mm in width ($W_1$) and 0.3 mm in thickness ($t_1$), the second electrode 82 is made of a non-magnetic SUS material which is 17 mm in width ($W_2$) and 0.5 mm in thickness ($t_2$), and those first and second electrodes 81 and 82 are disposed along the longitudinal direction of the developing roller 9*a*, thereby being capable of obtaining an excellent result. Also, both the electrodes 81 and 82 are not limited to this structure, but it is preferable that those electrodes 81 and 82 are disposed in the form of V so that an entrance side 84 of the developer becomes larger than a back side 85, for example, as shown in FIG. 16.

Figure 29A:
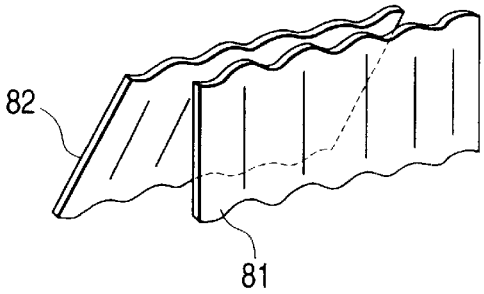
FIGS. 29A and 29B are perspective views showing a first and second electrodes in the developer amount detecting device in accordance with an embodiment of the present invention.
Figure 29B:
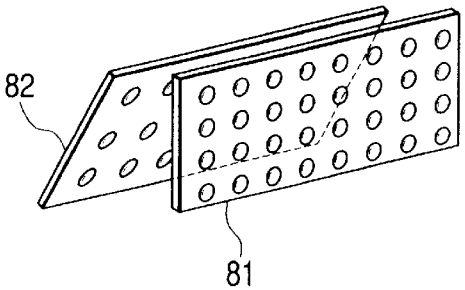
Figure 30:
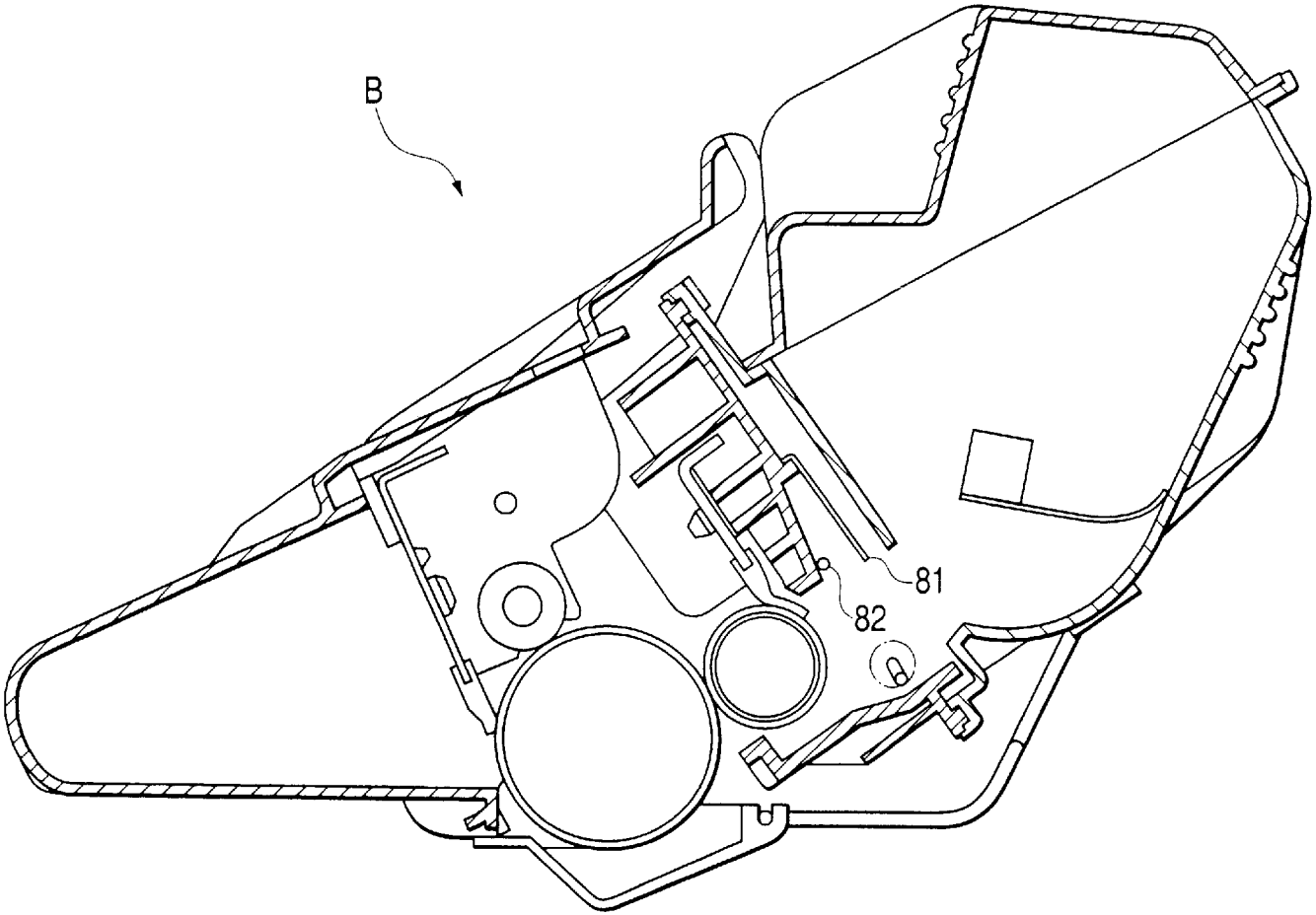
FIG. 30 is a longitudinal sectional view showing the process cartridge in accordance with another embodiment of the present invention.
Figure 31:
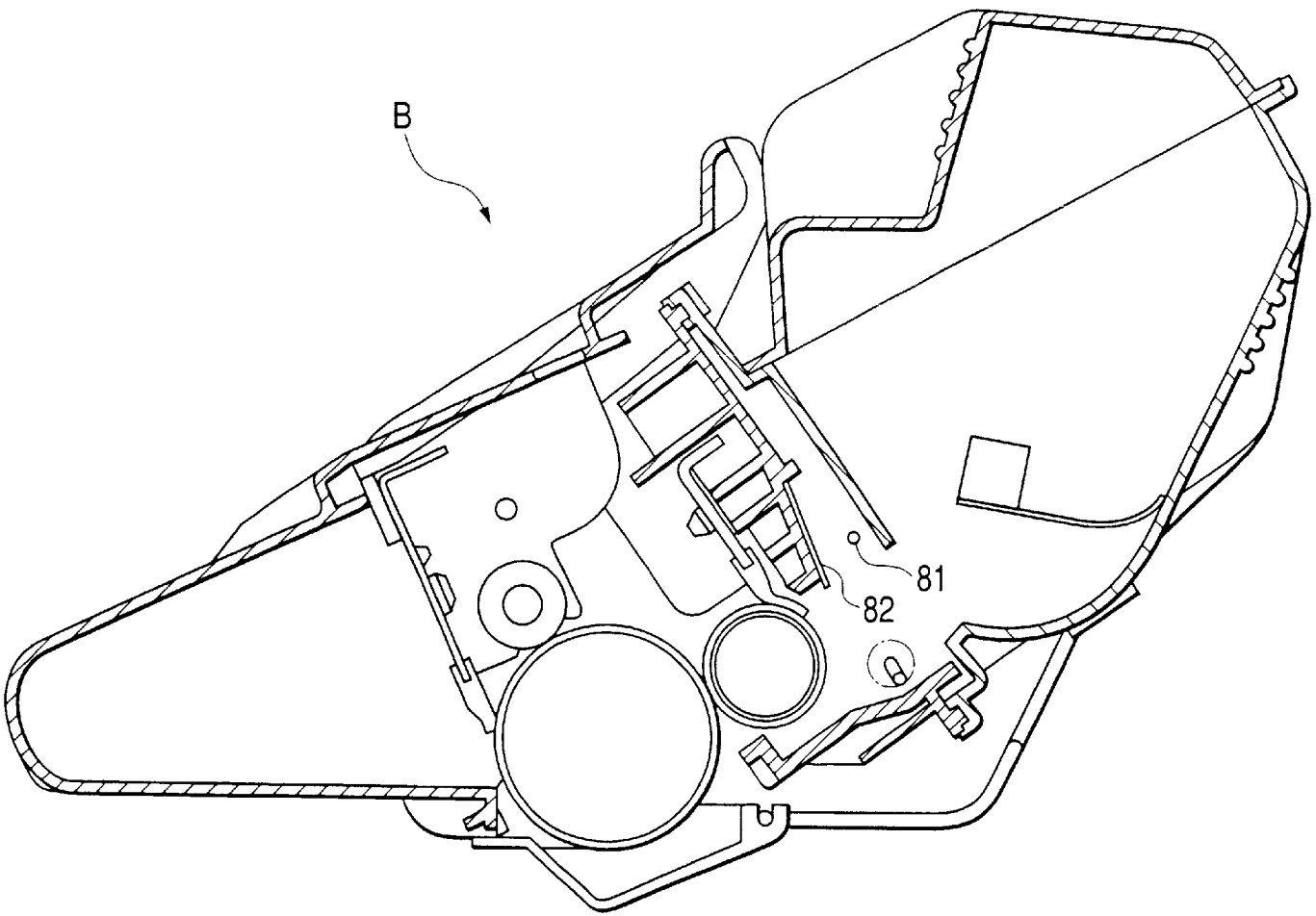
FIG. 31 is a longitudinal sectional view showing the process cartridge in accordance with another embodiment of the present invention.

Also, in order to increase the surface area of the electrodes 81 and 82, the surfaces of the electrodes 81 and 82 may be corrugate-shaped or drawing (embossed)—shaped as shown in FIGS. 29A and 29B. Contrarily, in the case where the space for the electrodes cannot be ensured, or the costs are intended to be reduced, any one of the first electrode 81 or the second electrode 82 may be formed of a round-bar shaped conductor as shown in FIGS. 30 and 31. FIG. 30 shows an embodiment in which the second electrode 82 is shaped in a round bar whereas FIG. 31 shows an embodiment in which the first electrode 81 is shaped in a round bar. In the embodiments of FIGS. 30 and 31, one round-bar is provided. However, a plurality of round-bars may be provided.

Figure 33:
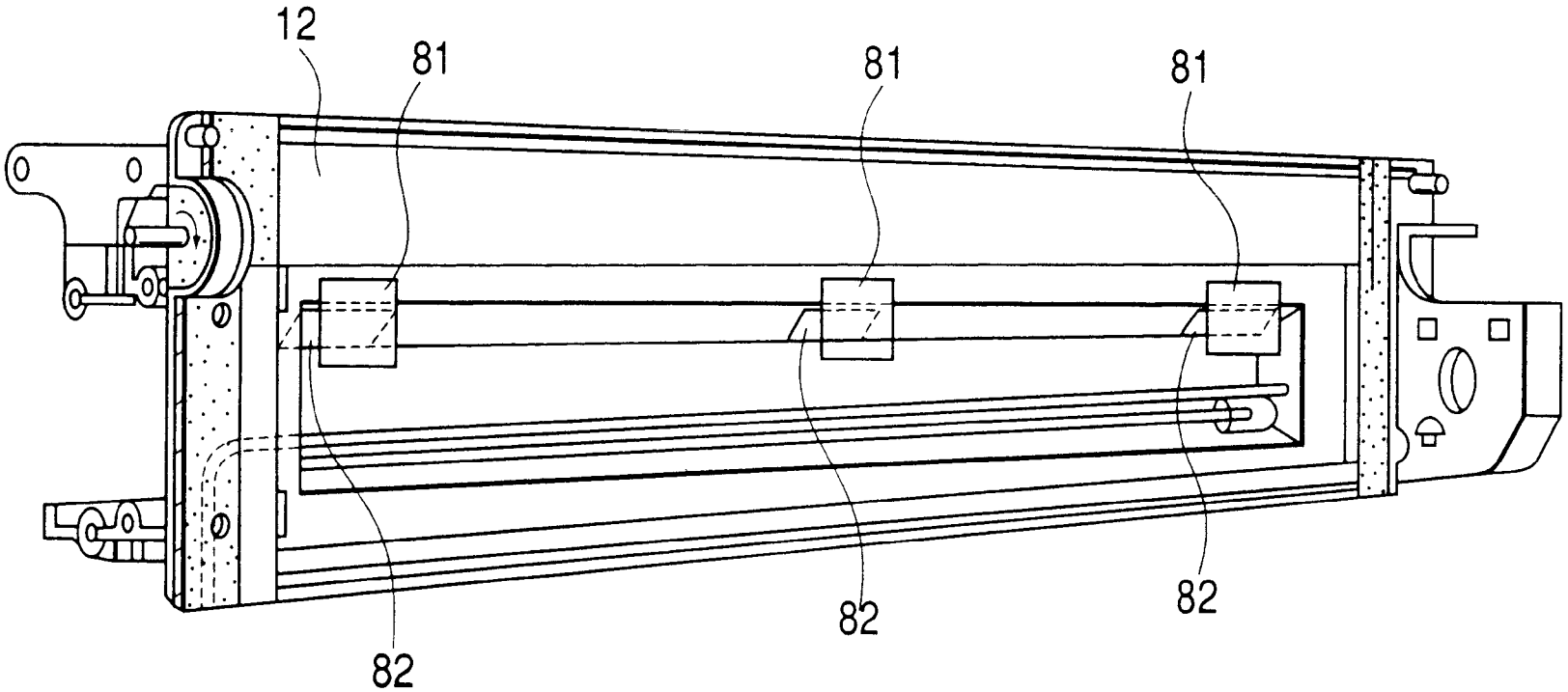
FIG. 33 is a perspective view showing other attaching modes of the first and second electrodes with respect to the developing frame.

Subsequently, an arrangement of the electrodes 81 and 82 in the longitudinal direction will be described. As described above, the first and second electrodes 81 and 82 are set to be substantially the same length as that of the image region along the longitudinal direction of the developing roller 9*a* with the results that the capacitance can be increased, thereby being capable of improving a precision in detection as described above. On the other hand, if the high precision in detection is not relatively required, for example, the electrodes each having a narrower width in correspondence with a portion close to a center or an end of an image, etc., can be disposed so that the costs can be reduced. However, in this case, since a variation in the amount of developer in the longitudinal direction cannot be detected, in order to prevent this defect, it is desirable that the electrodes 81 and 82 narrow in width are disposed on a plurality of portions including both ends and the center thereof as shown in FIG. 33.

Subsequently, the circulation of the developer within the developing chamber 9A will be described with reference to FIGS. 34 to 37.

Figure 34:
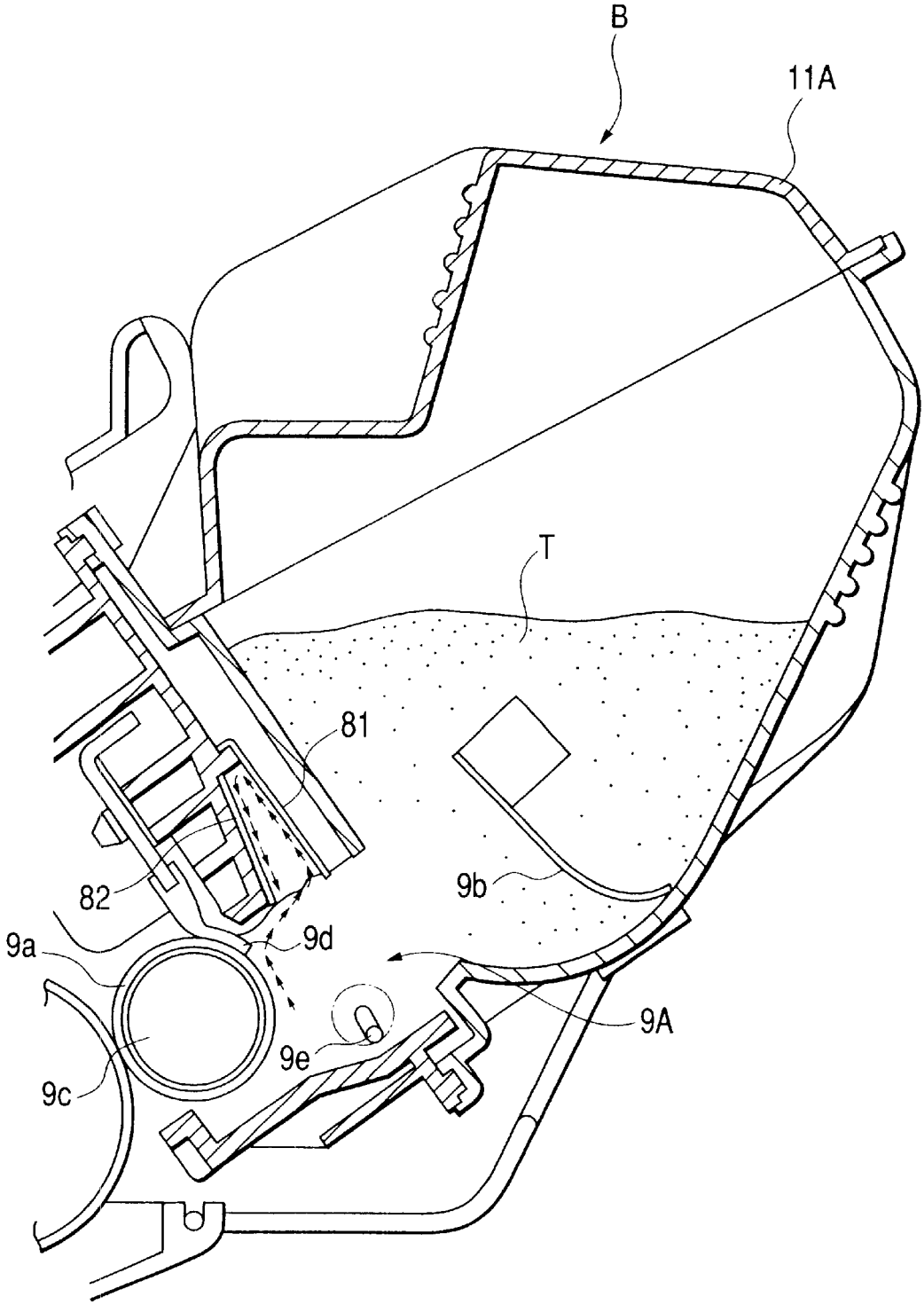
FIG. 34 is a longitudinal sectional view for explaining a circulating mode of the developer in a developing chamber of the process cartridge in the present invention.

In the case where the process cartridge of the present invention, that is, the structural portion of the developing device is used for the first time, no developer exits between the first and second electrodes 81 and 82 and a sufficient developer T exists within the developer container 11A and the developing chamber 9A. In this situation, as shown in FIG. 34, the developer T within the developing chamber 9A is fed to the developing roller 9*a* side by the agitating member 9*e* and thereafter attracted onto the surface of the developing roller 9*a*. Then, with the rotation of the developing roller 9*a*, the developer on the surface of the developing roller 9*a* is scrapped off by the developing blade 9*d*, and the developer T successively enters a space between the first and second electrodes 81 and 82.

Figure 35:
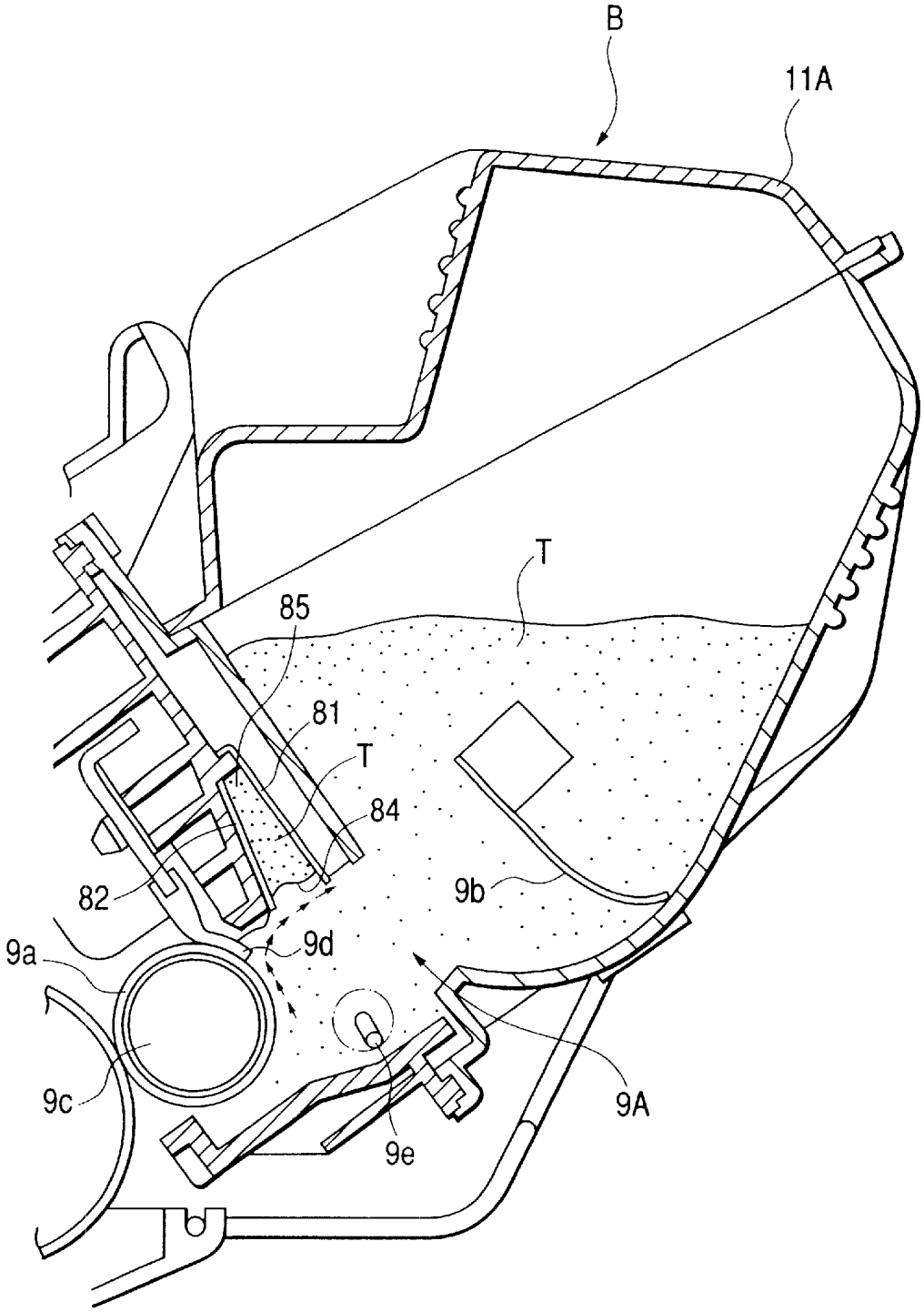
FIG. 35 is a longitudinal sectional view for explaining the circulating mode of the developer in the developing chamber of the process cartridge in the present invention.

After the developer T successively enters a space between the first and second electrodes 81 and 82, as shown in FIG. 35, the space between the first and second electrodes 81 and 82 is filled with the entering developer T. In this situation, because the developing chamber 9A is filled with the developer T, an inlet/outlet 84 of the developer T between the electrodes 81 and 82 is closed. For that reason, the developer T between the electrodes 81 and 82 does not freely drop down due to the gravity or the like until the developer within the developing chamber 9A is decreased. That is, if sufficient developer T exists within the developing chamber 9A, because the space between the first and second electrodes 81 and 82 is filled with the developer T, the capacitance between the electrodes 81 and 82 becomes high.

Figure 36:
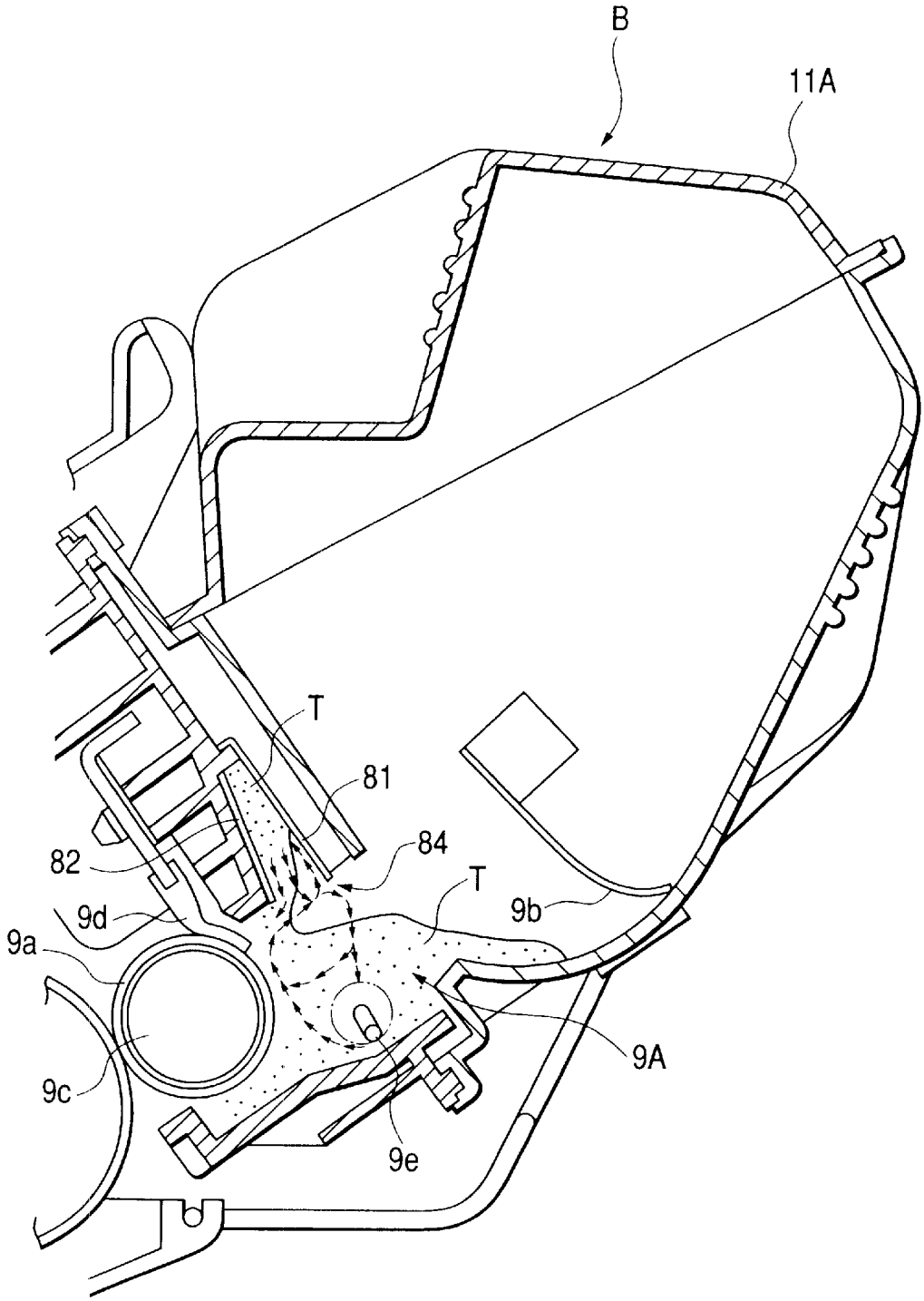
FIG. 36 is a longitudinal sectional view for explaining the circulating mode of the developer in the developing chamber of the process cartridge in the present invention.
Figure 37:
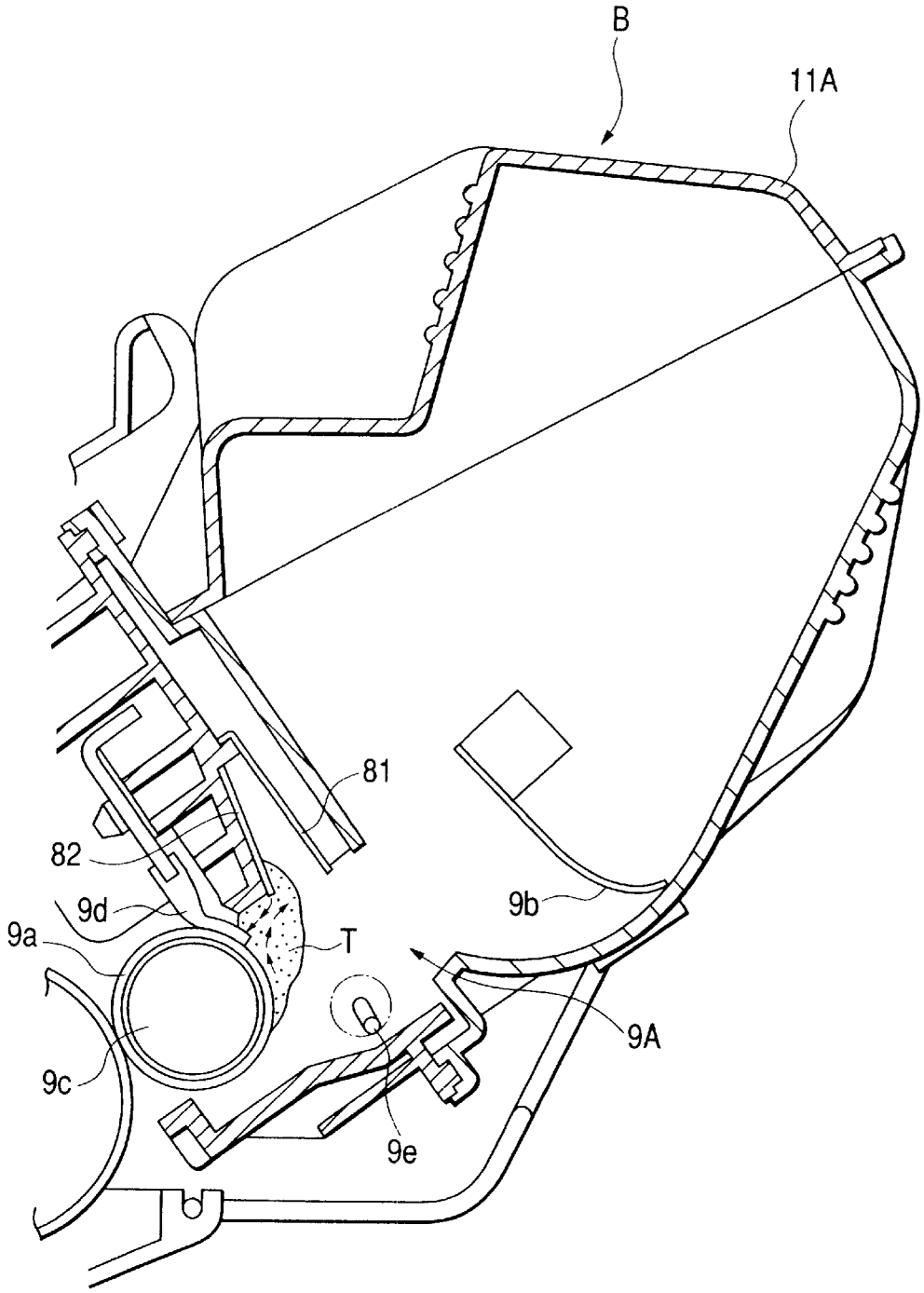
FIG. 37 is a longitudinal sectional view for explaining the circulating mode of the developer in the developing chamber of the process cartridge in the present invention.

As shown in FIG. 36, if the developer is depleted and the developer within the developer container 11A and the developing chamber 9A is reduced, the developer that closes the inlet/outlet 84 of the developer T between the electrodes 81 and 82 is eliminated, and the developer T between the first and second electrodes 81 and 82 drops down in the direction of the gravity by its weight. The dropped developer is attracted onto the developing roller 9*a* by a magnetic force while the developer is dropping or again supplied to the developing roller 9*a* by the agitating member 9*e*. Also, a part of the developer is directly returned to the surface of the developing roller 9*a* by the magnetic force from the space between the first and second electrodes 81 and 82.

In a state shown in FIG. 36, the developer within the developing chamber 9A is reduced, and the developer between the first and second electrodes 81 and 82 goes out of the space between the first and second electrodes 81 and 82. However, since the developer scrapped off by the developing blade 9*d* is always supplied to the space between the first and second electrodes 81 and 82 so far as the developer exists within the developing chamber 9A, the developer between the electrodes 81 and 82 is reduced in accordance with the amount of developer within the developing chamber 9A.

Finally, the developer within the developer container 11A and the developing chamber 9A is depleted, and as shown in FIG. 24, since the developer between a leading edge of the developing blade 9*d* that scrapes off the developer on the surface of the developing roller 9*a*, that is, the developing roller 9*a* and the developer amount detecting portion 80 is depleted, a blank area in an image occurs, resulting in a developer end (=no developer) state.

In this way, according to the present invention the amount of developer within the developing chamber 9A can be successively detected by measuring the amount of developer between the first and second electrodes 81 and 82, that is, by measuring the capacitance between the first and second electrodes 81 and 82.

According to the above embodiment, as shown in FIGS. 16 and 32, the peripheral structure of the first and second electrodes 81 and 82 is made in such a manner that the back side 85 between the first and second electrodes 81 and 82 is closed, and the number of the inlet/outlet 84 of the developer T between the first and second electrodes 81 and 82 is one. For that reason, as described above, it is effective that the space between the first and second electrodes 81 and 82 which are located on the entrance side 84 of the developer is made large.

However, if the developer per unit time on the developing roller 9*a* which is scrapped off by the developing blade 9*d* increases due to the rotating speed-up of the developing roller 9*a*, etc., there is a case in which the developer filled up in the space between the first and second electrodes 81 and 82 is increased and packed. When the developer is packed, because the developer between the first and second electrodes 81 and 82 cannot be circulated, the developer does not drops down by its weight or the magnetic force of the magnet roller 9*c*. This phenomenon is remarkable under the high-humidity circumstance where the developer that absorbs the moisture, and in this state, because the capacitance between the first and second electrodes 81 and 82 does not change, the amount of developer is not detected.

Figure 38:
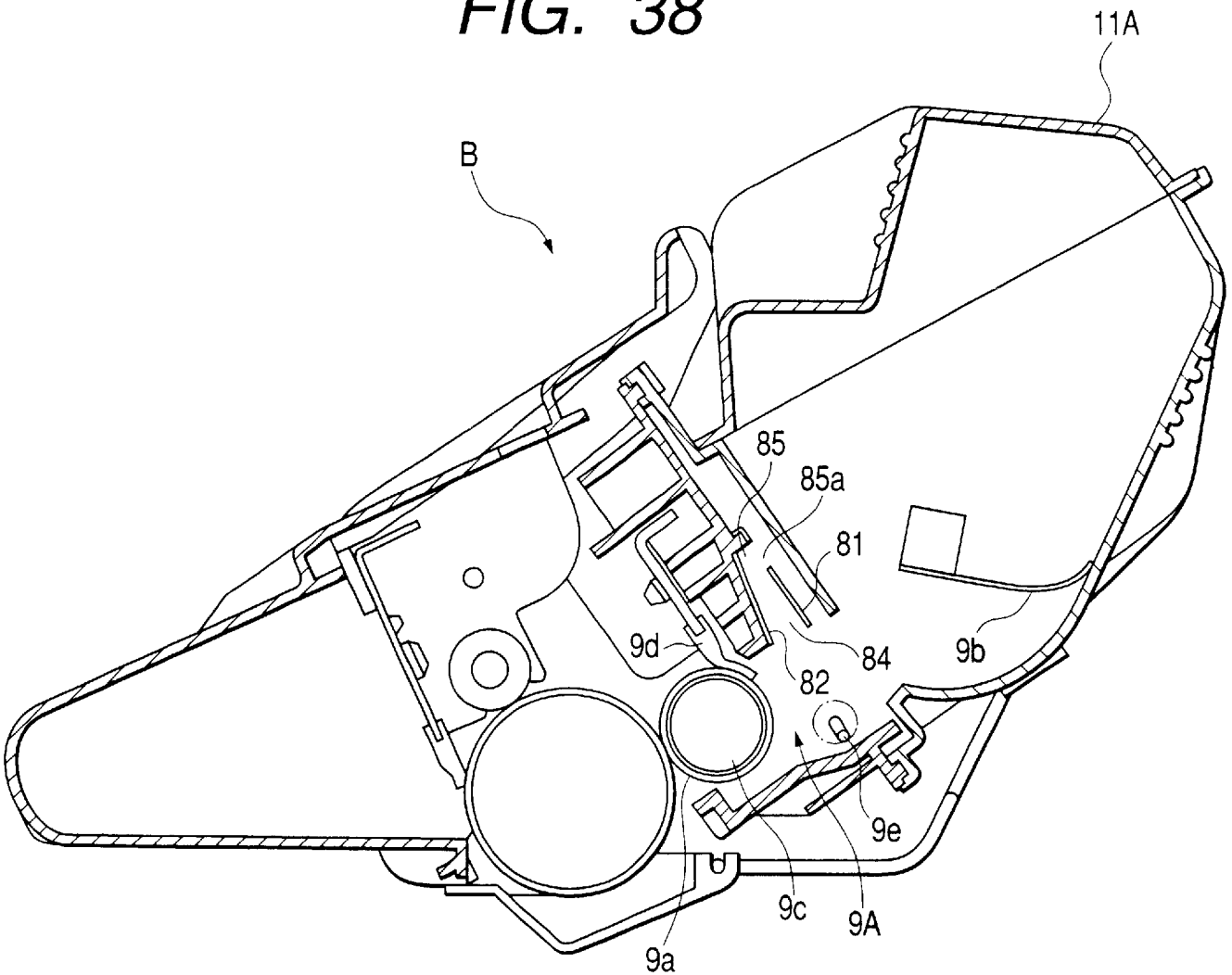
FIG. 38 is a longitudinal sectional view showing the process cartridge in accordance with another embodiment of the present invention.

In view of the above, as shown in FIG. 38, an outlet 85*a* different from the inlet 84 of the developer is defined on the back side 85 between the first and second electrodes 81 and 82 so that the developer can pass through the space between the first and second electrodes 81 and 82, thereby being capable of preventing the developer between the first and second electrodes 81 and 82 from being packed.

Subsequently, the structure of mounting the first and second electrodes 81 and 82 onto the structural portion of the developing device will be described.

Since the developer amount detecting portion 80 using the first and second electrodes 81 and 82 is so adapted as to detect the capacitance between the first and second electrodes 81 and 82, a precision in the position between the first and second electrodes 81 and 82 is extremely important. Also, since an object of the present invention is to accurately detect a timing at which a blank area occurs in an image because the developer is completely depleted, the first and second electrodes 81 and 82 should be arranged in the vicinity of the developing roller 9*a* where the developer remains to the last.

In view of the above, according to this embodiment, as shown in FIG. 39, the first and second electrodes 81 and 82 are mounted on a developing frame, that is, the developing frame 12. A means of mounting the first and second electrodes 81 and 82 may be formed of a spring, an adhesive, a caulking, insert molding or the like. With the above structure, the first and second electrodes 81 and 82 can be relatively positioned with a high precision, and the first and second electrodes 81 and 82 are disposed in the vicinity of the developing roller 9*a*, thereby being capable of detecting a timing just before the developer is reduced.

Also, according to this embodiment, as described above, the first and second electrodes 81 and 82 are made of the non-magnetic SUS material. However, the developing frame 12 may be directly subjected to processing such as vacuum evaporation or printing, or an electrically conductive resin may be dichroic-molded to form an electrically conductive portion, thereby structuring the first and second electrodes 81 and 82. In this case, because a mounting tolerance and a parts tolerance are reduced as compared with the electrodes formed of different members, a precision in position is improved.

Figure 40:
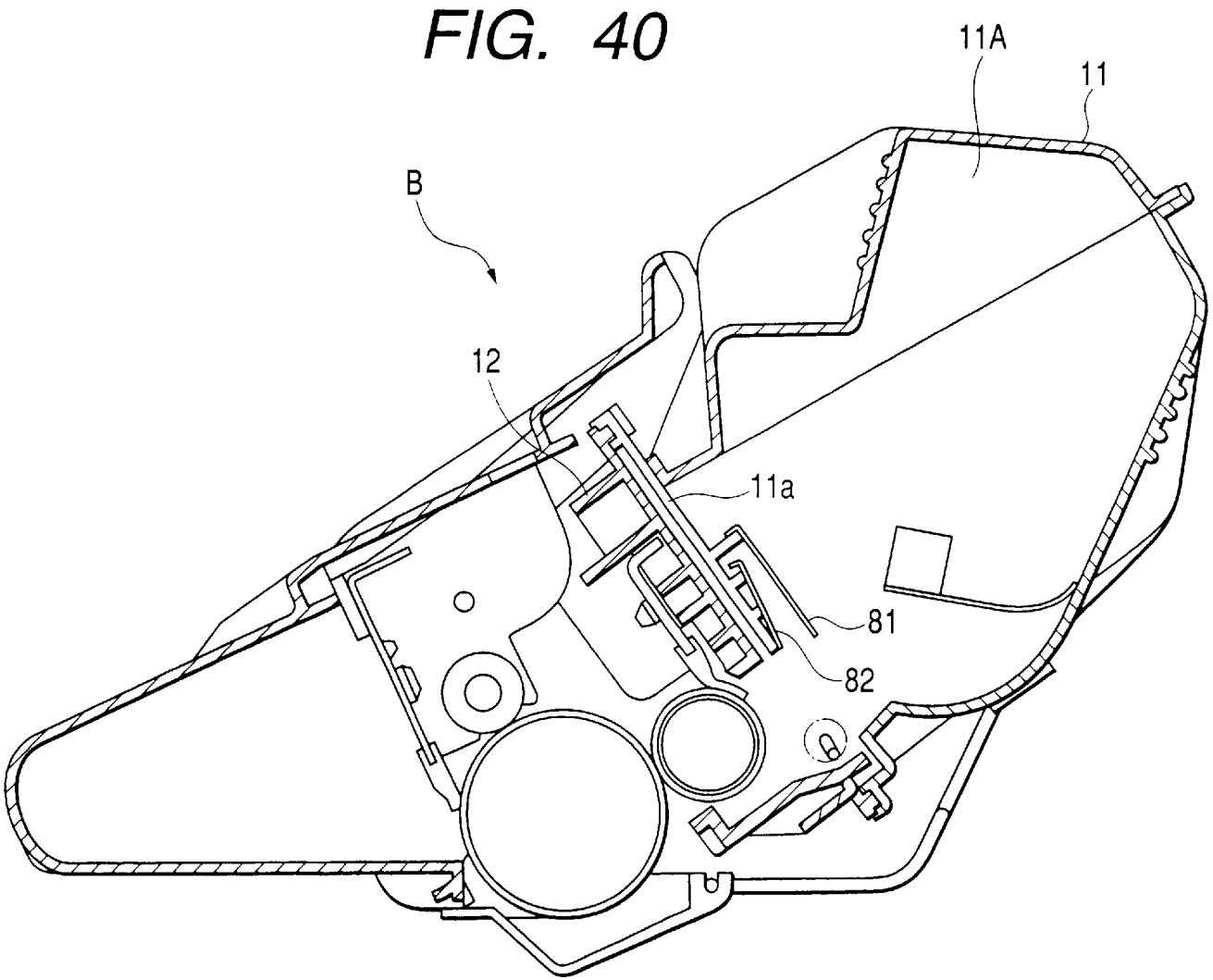
FIG. 40 is a longitudinal sectional view showing the process cartridge in accordance with another embodiment of the present invention.

In addition, for example, in the case where the developing frame 12 is small, as shown in FIG. 40, the first and second electrodes 81 and 82 may be mounted on a front wall 11*a* of the developer container 11A for convenience of a design. In this case, a position between the first and second electrodes 81 and 82 can be located with a high precision.

Figure 41:
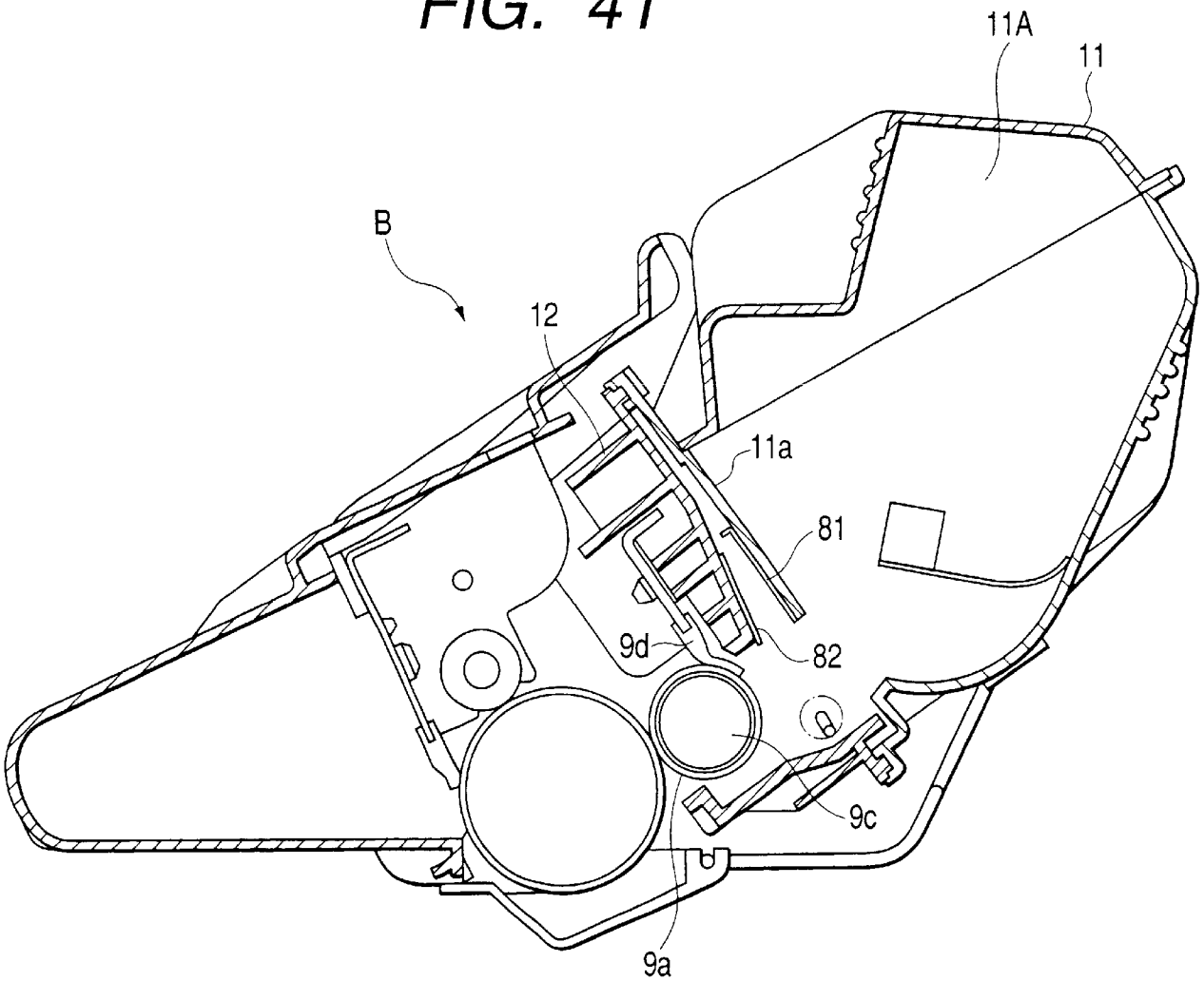
FIG. 41 is a longitudinal sectional view showing the process cartridge in accordance with another embodiment of the present invention.

Further, as shown in FIG. 41, the second electrode 82 is mounted on the developing frame 12, the first electrode 81 is mounted on the front wall 11*a* of the developer container 11A, and the developing frame 12 and the developer container 11A are coupled to each other so that the first and second electrodes 81 and 82 may be opposed to each other. In this case, the degree of freedom of the respective frame structures increases.

Figure 42:
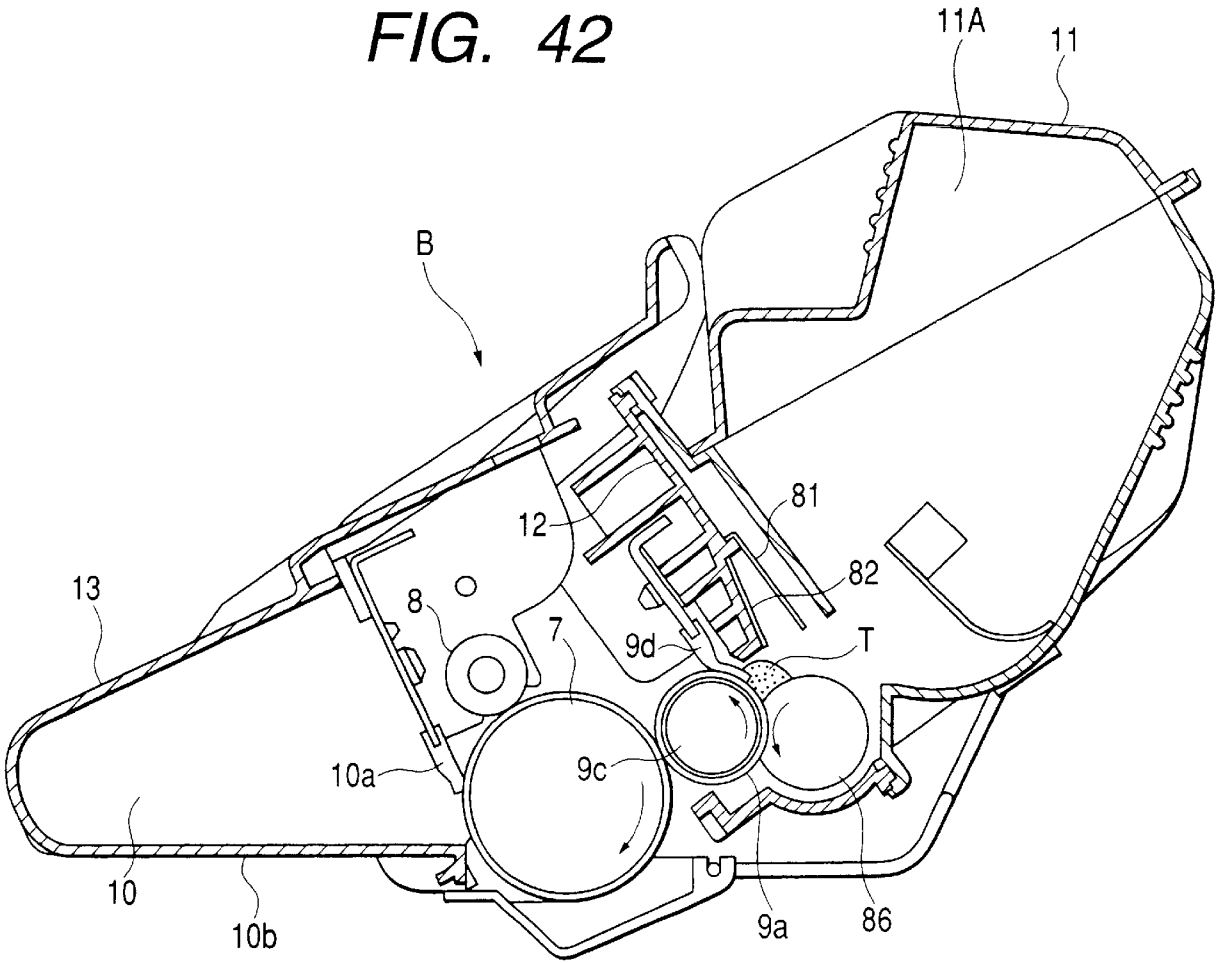
FIG. 42 is a longitudinal sectional view showing the process cartridge in accordance with another embodiment of the present invention.

In the above-described embodiment, the structure of successively detecting the developer in the case of using the magnetic developer as the developer was described. However, the present invention can be applied to a process cartridge having the structure of a developing device using a non-magnetic developer as shown in FIG. 42.

In the structure of the developing device using the non-magnetic developer, a developer coating roller 86 is employed as means for supplying the developer to the developing roller 9*a*. The developer coating roller 86 is formed of an elastic member such as sponge and rotates in a counter direction while being abutted against the developing roller 9*a* and coats the developer on the developing roller 9*a* by a Coulomb force developed there. In this situation, the developer T finally depleted is on an upper portion of a contact portion of the developing roller 9*a* with the developer coating roller 86. Therefore, if the first and second electrodes 81 and 82 are disposed in the vicinity of that upper portion, the amount of developer can be successively detected as in the process cartridge using the magnetic developer.

Figure 43:
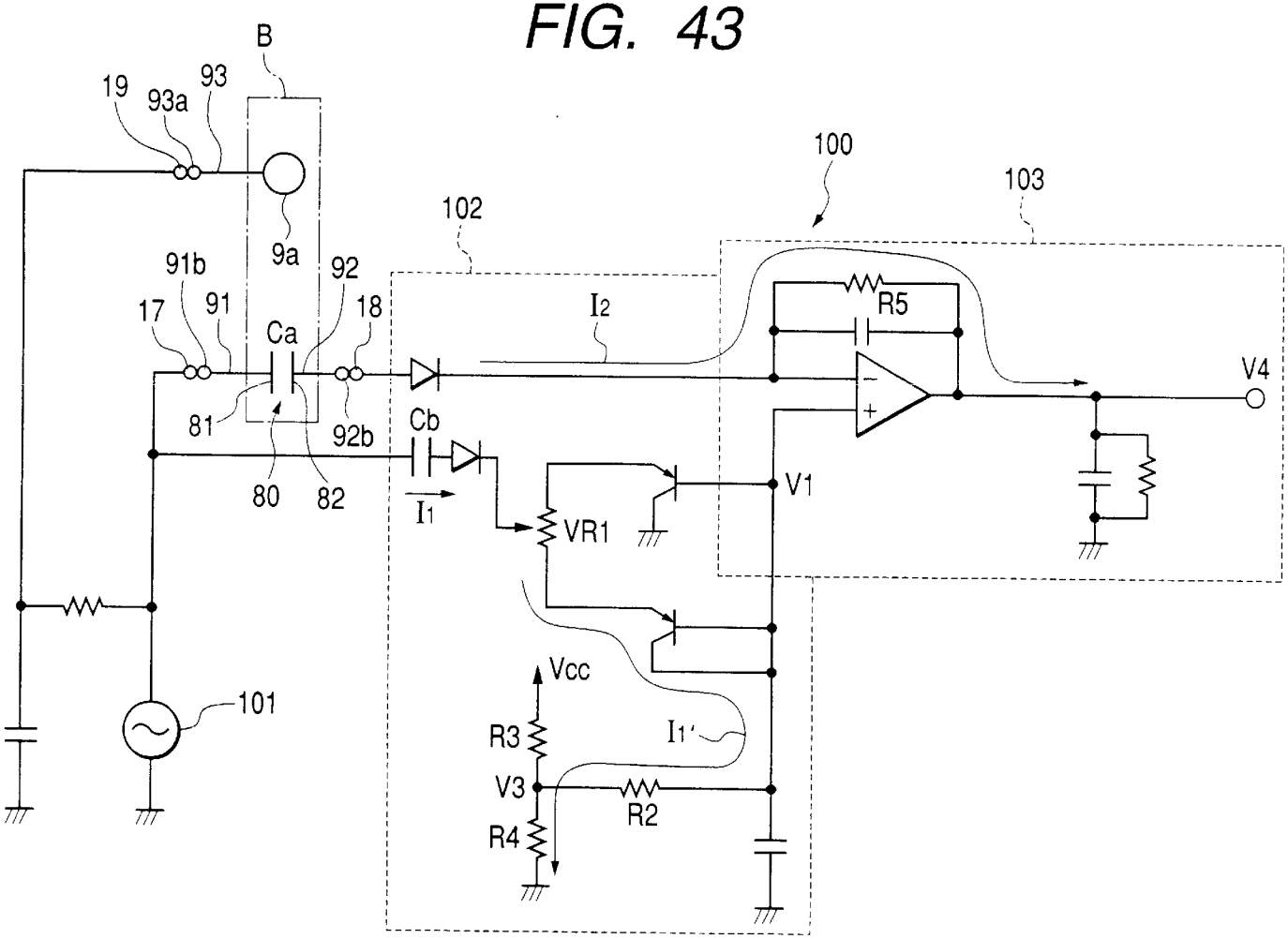
FIG. 43 is a view showing the developer amount detecting circuit for the developer amount detecting device in accordance with an embodiment of the present invention.

The developer amount detecting device that embodies the principle of the present invention will be further described with reference to FIG. 43. FIG. 43 shows an example of the developer amount detecting circuit together with a connecting mode of the developer amount detecting portion 80 having the first and second electrodes 81 and 82 in the image forming apparatus.

In the detecting portion 80 having a capacitance Ca that varies in accordance with the amount of developer, one input side electrode of an impedance element, in this embodiment, the first electrode 81 is connected to the developing bias circuit 101 that functions as the developing bias applying means through a first electric contact point 91, and the other output side electrode, in this embodiment, the second electrode 82 is connected to the control circuit 102 of the developer amount detecting circuit 100 through a second electric contact point 92. A reference capacitance element (Cb) is also connected to the developing bias circuit 101 and sets the reference voltage V1 in the detection of the remaining amount of developer by using the a.c. (alternating) current $I_1$ which is supplied through the bias circuit 101. It is needless to say that the developing roller 9*a* is applied with the developing bias voltage from the bias circuit 101 by electrically connecting a contact point 19 disposed in the apparatus main body 14 to a contact point portion 93*a* of the electric contact point 93 of the developing roller 9*a* when the process cartridge B is installed in the apparatus main body 14.

The control circuit 102 adds a voltage drop amount V2 caused by an a.c. current $I_1$ which is a value resulting from dividing the a.c. current $I_1$ which is supplied to the reference impedance element by a volume VR1, and a resistor R2 to a set voltage V3 set by resistors R3 and R4 to determine the reference voltage V1.

Therefore, an a.c. (alternating) current $I_2$ which is supplied to the developer amount detecting portion 80 is inputted to an amplifier 103 and outputted as a detected value V4 ($V1-I_2 \times R5$) of the remaining amount of developer. Then, the output value is used as the detected value of the remaining amount of developer.

According to the image forming apparatus of the present invention, as described above, the amount of developer between the first and second electrodes 81 and 82 which constitute the second developer remaining amount detecting means is successively detected and the depleted amount of developer is indicated on the basis of the detected information, thereby being capable of calling the user's attention to the preparation of a fresh process cartridge or a developer supplementary cartridge, and also calling the user's attention to the replacement of the process cartridge or the supplement of the developer in accordance with the detected information of the developer end.

Figure 44:
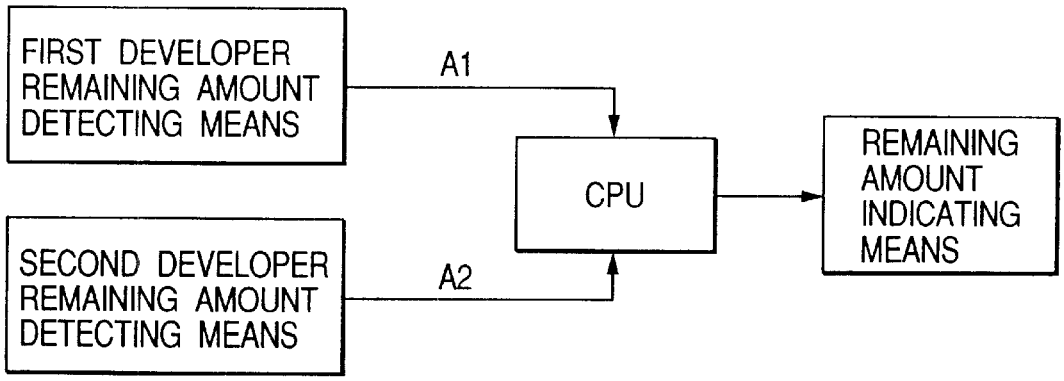
FIG. 44 is a block diagram showing a flow of detecting results when the developer remaining amount is successively detected in accordance with the present invention.

FIG. 44 is a block diagram showing a flow of the detected result in successively detecting the remaining amount of developer by the developer amount detecting device in accordance with the present invention.

As shown in FIG. 44, in this embodiment, values A1 and A2 detected by the first and second developer remaining amount detecting means are inputted to a CPU (not shown) disposed in the main body of the image forming apparatus where those values A1 and A2 are arithmetically operated, and their results are transmitted to the remaining amount indicating means from the CPU.

Conversion tables that convert the detected values A1 and A2 into the amount of developer are prepared within the CPU in accordance with the first and second developer remaining amount detecting means.

Figure 45:
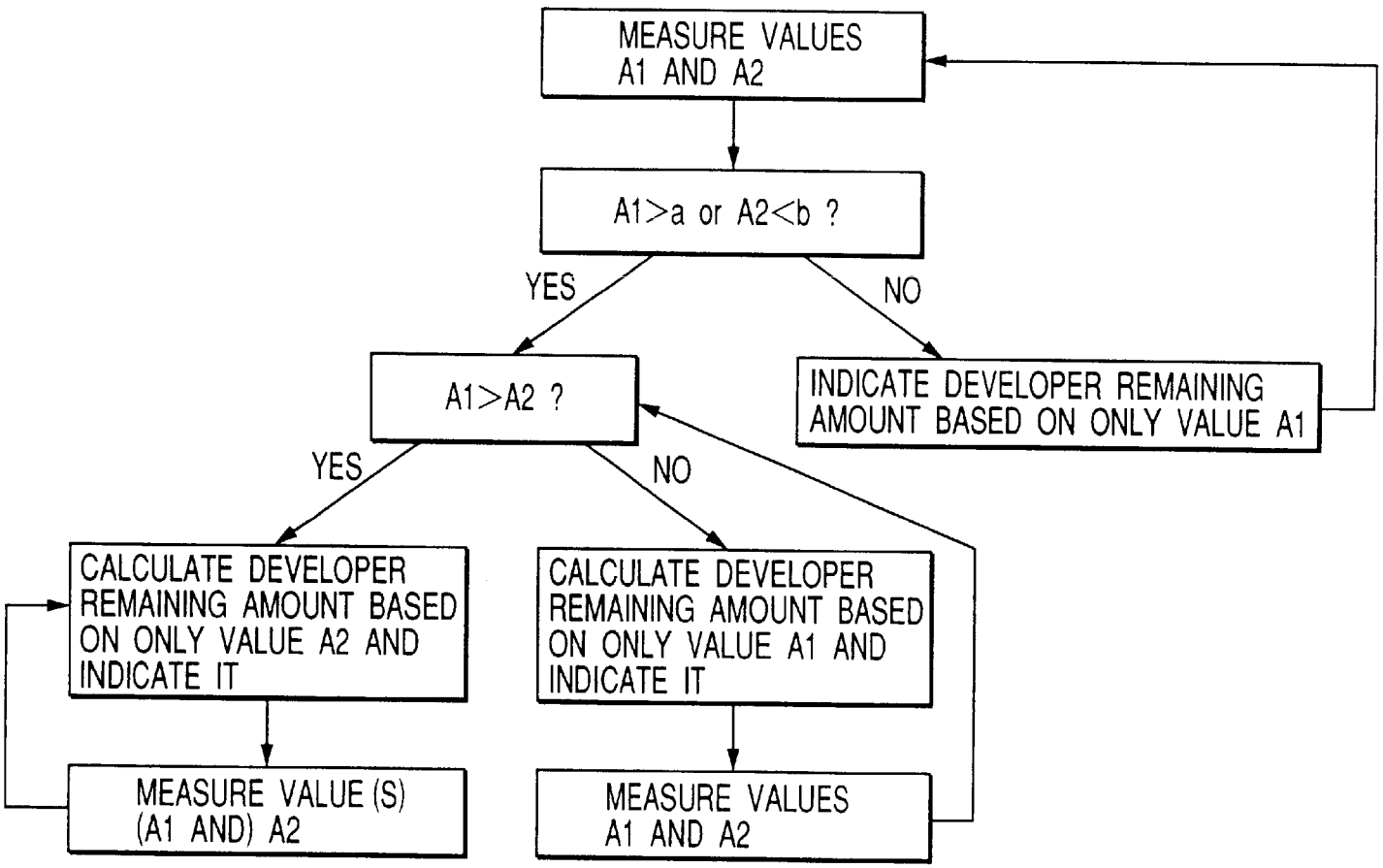
FIG. 45 is a flowchart showing an embodiment when the developer remaining amount is successively detected in accordance with the present invention.

FIG. 45 shows one embodiment of a flowchart used when the developer remaining mount is detected by a developer remaining amount detecting device of this embodiment having first and second developer remaining amount detecting means.

In accordance with this embodiment, developer remaining amount information (detecting values A1, A2) detected by the first and second developer remaining amount detecting means is inputted into a CPU. These detecting values A1, A2 and preset values a, b are compared with each other in large and small relations to judge whether only the first developer remaining amount detecting means is valid, or both the first and second developer remaining amount detecting means are invalid in the present state. As a result, when only the first developer remaining amount detecting means is valid, only the detecting value A1 is used and converted to a developer amount and the developer remaining amount is indicated. In contrast to this, when both the first and second developer remaining amount detecting means are invalid, only the detecting value A1 is used and converted to a developer amount and the developer remaining amount is indicated.

The above operation is repeated. Thereafter, when only the second developer remaining amount detecting means becomes valid, only the detecting value A2 is used and converted to the developer remaining amount and this developer remaining amount is indicated.

In this embodiment, the developer remaining amount information A1, A2 is detected every development, but this detection timing is not particularly restricted.

Sixth Embodiment

Figure 46:
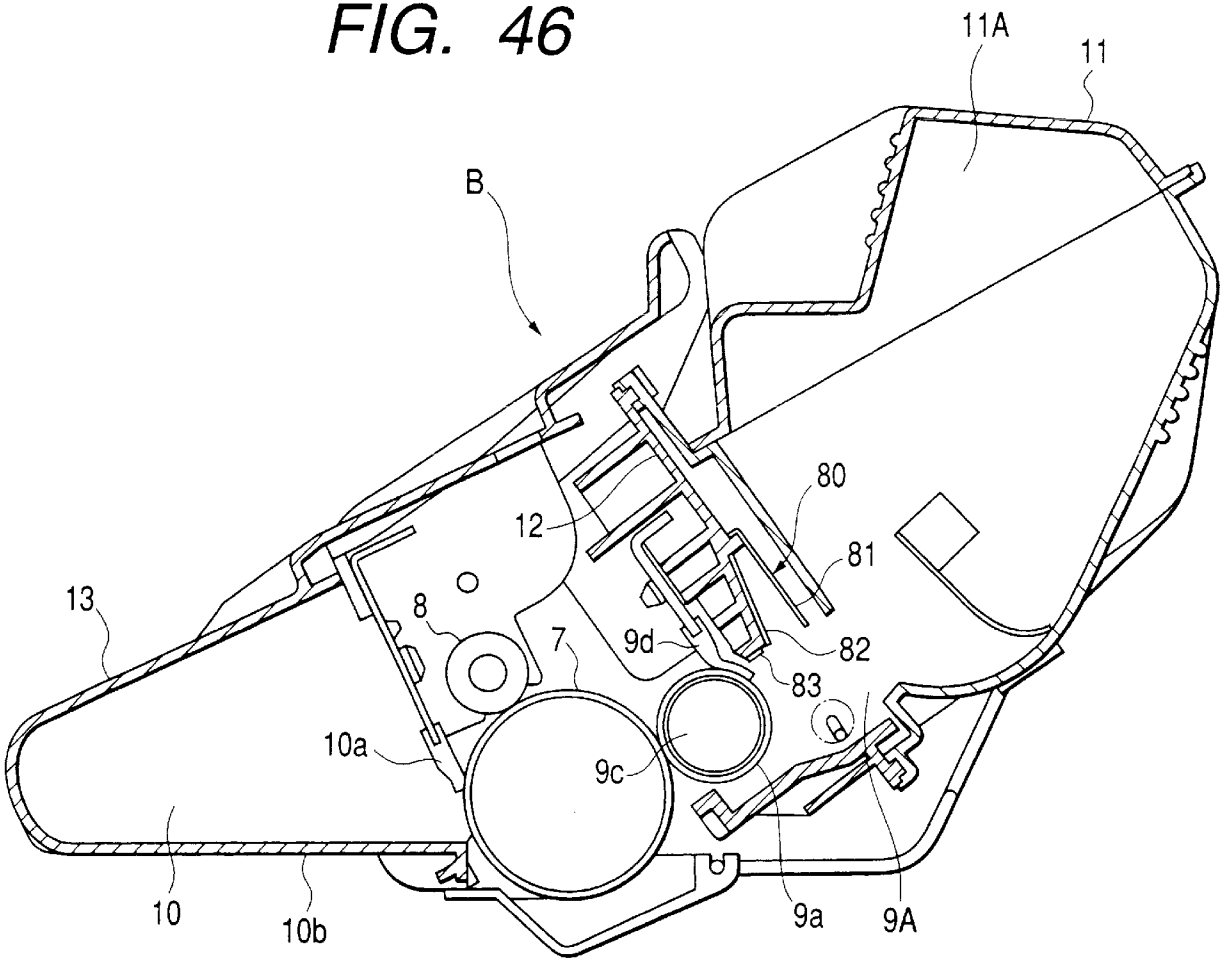
FIG. 46 is a longitudinal sectional view showing the process cartridge in accordance with another embodiment of the present invention.

FIG. 46 shows another embodiment of the present invention. A process cartridge B of this embodiment is structured as the same developing device as the process cartridge B in the first embodiment except that a third electrically conductive portion (electrode) 83 is further provided as the measuring electrode member of the developer amount detecting portion 80. Accordingly, the members identical in structure and operation are designated by the same reference numeral, and their detailed description will be omitted.

Incidentally, a description of the structure and operation which are duplicated with those in the first embodiment, for example, the structure and arrangement of the first and second electrically conductive portion 81 and 82 structured in accordance with the present invention, the circulation of the developer between the first and second electrodes 8*y*, the peripheral structure of the first and second electrodes 8*y*, and the method of mounting the first and second electrodes 8*y*, will be omitted.

A main object of the structure of this embodiment is to accurately detect a time just before a blank area occurs in an image. In order to achieve this object, the amount of developer at a portion where the developer is finally depleted may be detected. Accordingly, this embodiment is structured so as to detect the amount of developer between the second and third electrodes 82 and 83 and the developing roller 9*a* as described with respect to the circulation of the developer in the first embodiment.

In other words, according to the developer amount detecting device of the present invention, as shown in FIG. 46, the first electrode 81 and the second electrode 82 are located as in the fifth embodiment, and the third electrode 83 is also disposed along the developing roller 9*a*. The third electrode 83 is located at a position closer to the developing roller 9*a* than the first and second electrodes 8*y*.

In the above structure, the capacitance Ca is induced between the first and second electrodes 8*y* by application of a voltage to the first electrode 81, and at the same time, a capacitance Cc is also inducted between the developing roller 9*a* and the third electrode 83 by the developing bias voltage applied to the developing roller 9*a*. Then, those capacitances Ca and Cc are measured to detect the amount of developer.

Figure 47:
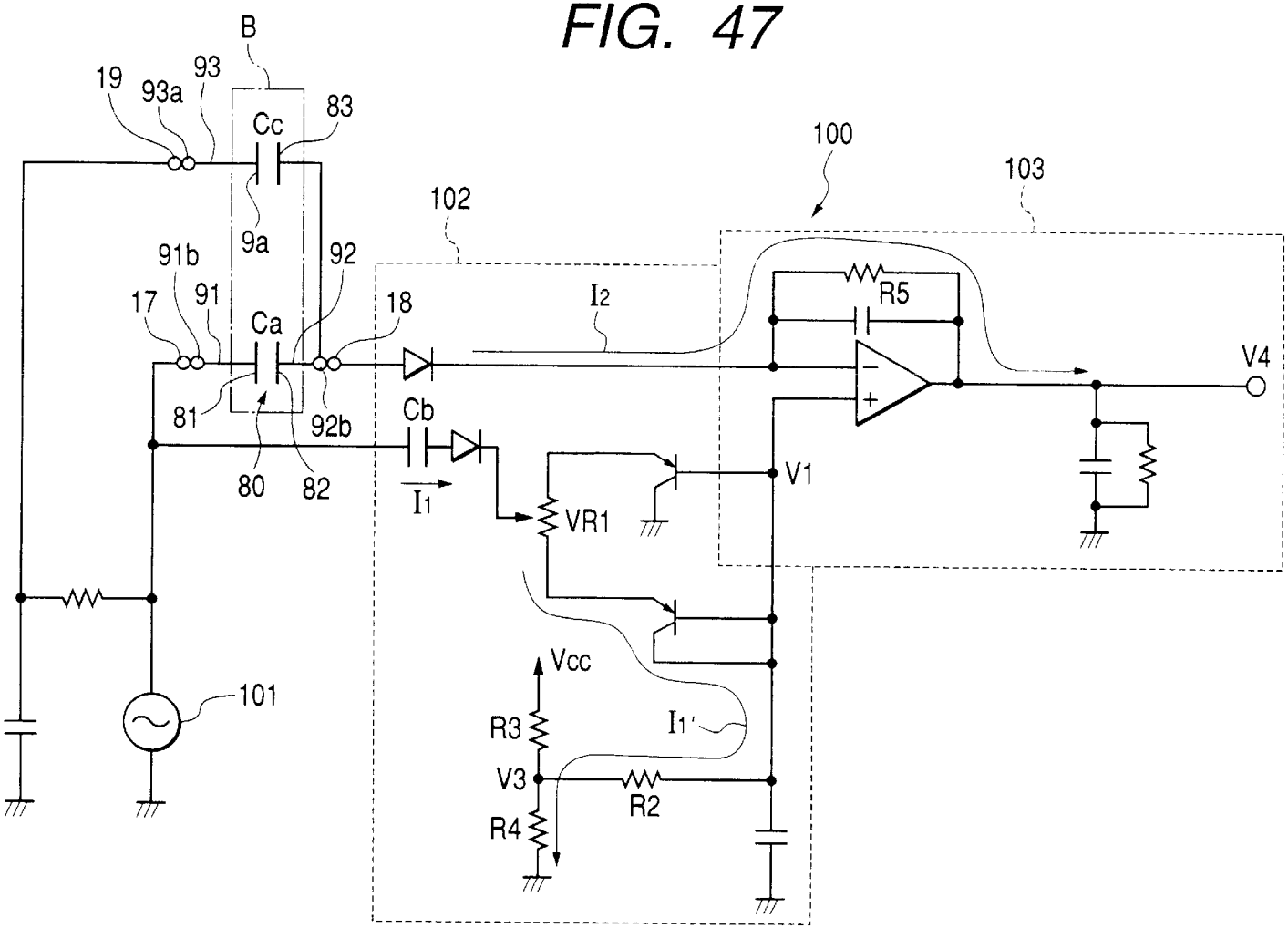
FIG. 47 is a view showing the developer amount detecting circuit for the developer amount detecting device in accordance with another embodiment of the present invention.

An example of the developer amount detecting circuit in accordance with this embodiment is shown in FIG. 47. The entire circuit structure is identical with that of the developer detecting circuit according to the first embodiment which is shown in FIG. 43 except for the structure in which the third electrode 83 is disposed opposite to the developing roller 9*a*, and the capacitance Cc is induced between the developing roller 9*a* and the third electrode 83.

In this embodiment, as shown in FIG. 47, there are provided a contact 91 which electrically comes in contact with the electrode 17 of the main body 14 of the electrophotographic image forming apparatus in order to apply a voltage to the first electrode 81 and a contact 93 which electrically comes in contact with the electrode 19 of the main body 14 of the apparatus in order to apply the developing bias voltage to the developing roller 9*a*. Because those contacts 91 and 93 are provided separately, the degree of freedom of design is improved.

Also, if the voltage applied to the first electrode 81 is applied from the developing bias circuit 101, the number of power supplies is not increased, thereby being capable of preventing the costs from being raised.

In addition, if those contacts 91 and 93 are formed of one component, the capacitance can be accurately measured without producing any parasitic capacitance between those contacts 91 and 93.

Figure 48A:
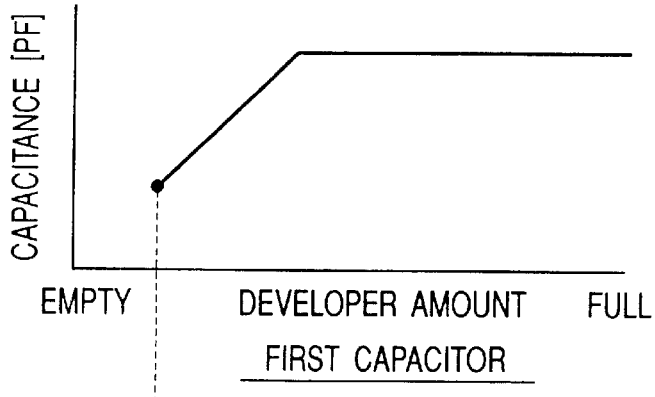
FIGS. 48A, 48B and 48C are graphs for explaining the developer amount detecting principle in accordance with the present invention.
Figure 48B:
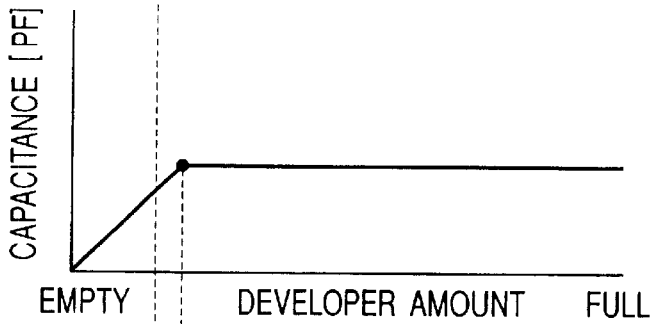
Figure 48C:
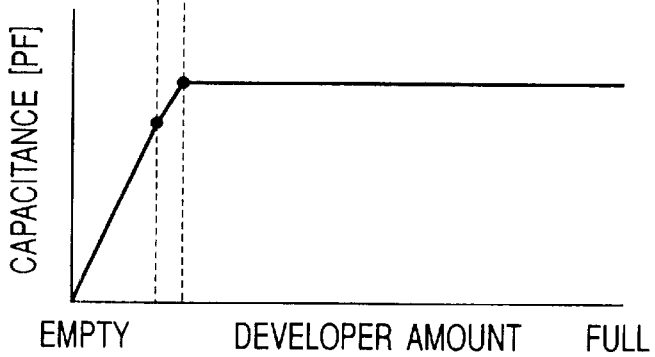

As described above, similarly, in this embodiment, the amount of developer can be successively detected with a reduction of the developer within the developing chamber 9A between the first and second electrodes 8*y*, and an end detection of the amount of developer can be accurately conducted between the developing roller 9*a* and the third electrode 83. A relation between the amount of developer and its output at this time is schematically shown in FIGS. 48A, 48B and 48C.

Also, as shown in FIG. 47, if the first capacitance element (Ca) formed by the first and second electrodes 8*y* and the second capacitance element (Cc) formed by the developing roller 9*a* and the third electrode 83 are disposed in parallel with each other, the number of contacts of the image forming apparatus main body 14 with the process cartridge B can be reduced, thereby reducing the costs.

Figure 49:
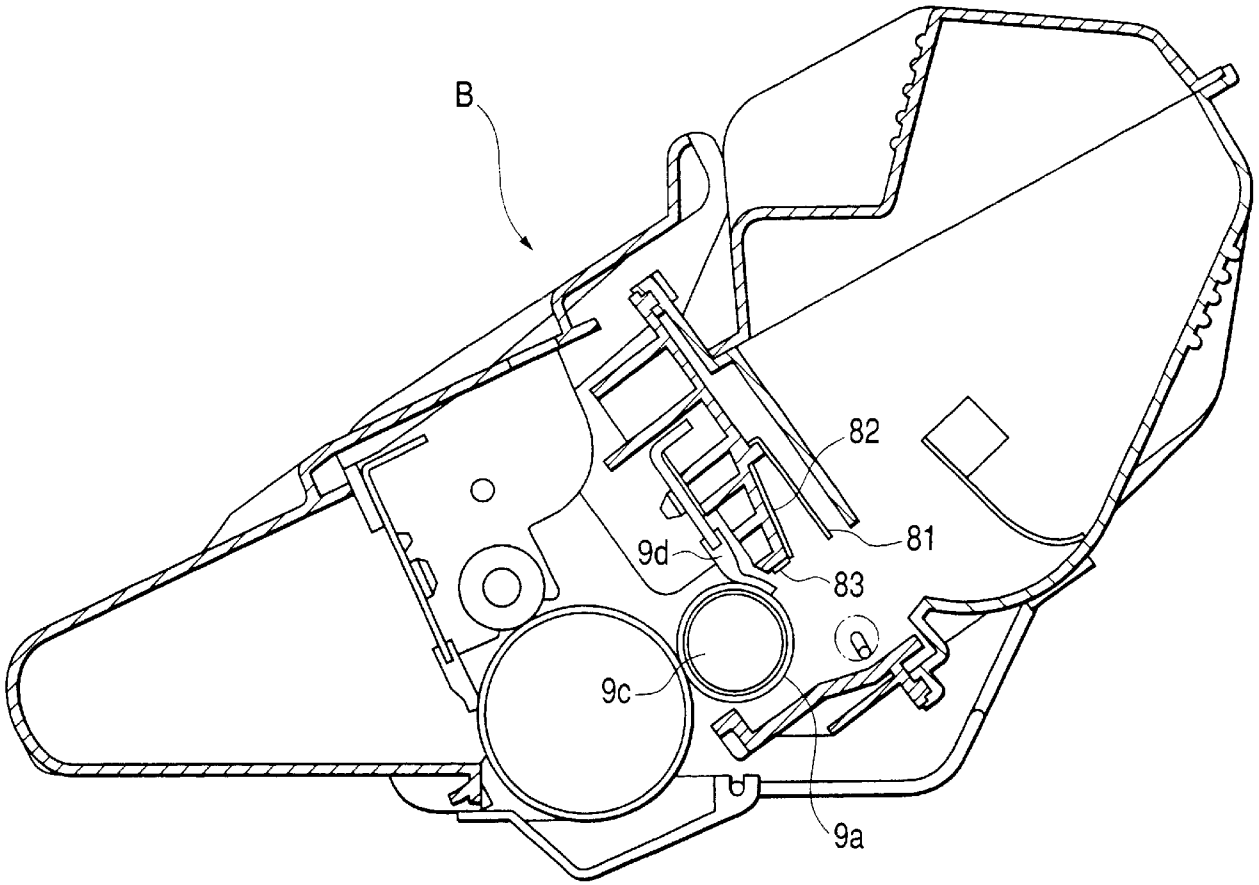
FIG. 49 is a longitudinal sectional view showing the process cartridge in accordance with another embodiment of the present invention.

In addition, if the electric conductors are wired, the capacitance is produced between the conductors, to thereby deteriorate a precision in detection. A reduction in wiring of the electric conductors leads to an improvement in the precision of detection. Therefore, as shown in FIG. 47, it is preferable that the second and third electrodes 82 and 83 are electrically connected to each other. More preferably, as shown in FIG. 49, if the second and third electrodes 82 and 83 are formed integrally, the wiring can be suppressed at the minimum, thereby being capable of accurately maintaining the precision in detection. In this situation, the third electrode 83 is structured so as to be folded with respect to the second electrode 82, and as described above, the third electrode 83 becomes closer to the developing roller 9*a*.

According to this embodiment, because the first developer remaining detecting means is of the system of detecting the amount of developer in the vicinity of the surface of the developer remaining amount detecting means, that is, in the vicinity of the surface of the measuring electrode member 20A, if the remaining amount of developer is large, the detection relatively high in precision can be conducted. However, it is difficult to grasp a state immediately before a blank area in an image occurs which is a defective image caused when the developable developer goes short on the developing roller 9*a*.

This is because the state just before the blank area occurs in an image can be more accurately detected by the system of directly detecting the amount of developer which exists on the surface of the developing roller 9*a*. Also, even if the developer goes short within the developer container 11A, there is no case in which the developer completely goes short on the surface of the measuring electrode member 20A, resulting in a variation factor.

On the other hand, in principle, the second developer remaining amount detecting means can select a portion high in precision of the detection by the arrangement of the electrically conductive members, that is, the first, second and third electrodes 81, 82 and 83 although the selection is within a permissible range of the shape of the developer container 11A. However, it is necessary to more widen an interval between the first and second electrodes as the remaining amount of developer is going to be more wholly detected, as a result of which, a change in the capacitance becomes small, to thereby deteriorate the precision in detection.

In this embodiment, there are provided the first and second electrodes 81 and 82 that successively detect a state where the remaining amount of developer is relatively small, and the third electrode 83 that more accurately detects the remaining amount of developer just before a blank area occurs in an image, and the respective electrodes are located in such a manner that the remaining amount of developer can be successively detected with a high precision from a state where the remaining amount of developer is relatively small to a state where the blank area occurs in an image by connecting two kinds of capacitors consisting of those electrodes 81, 82 and the developing roller 9*a* in parallel with each other.

Figure 50A:
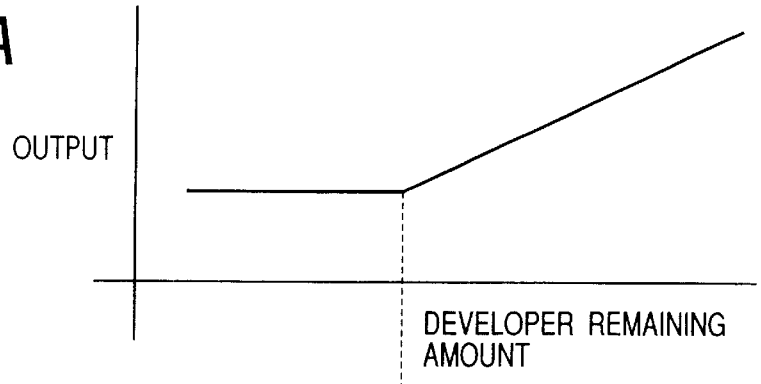
FIGS. 50A, 50B and 50C are graphs for explaining the developer amount detecting principle in accordance with the present invention.
Figure 50B:
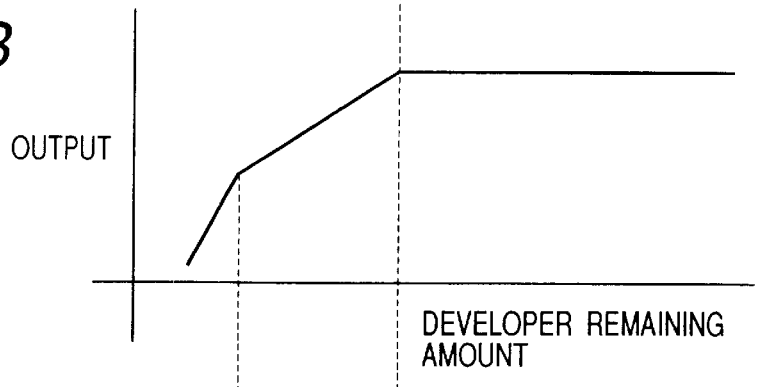
Figure 50C:
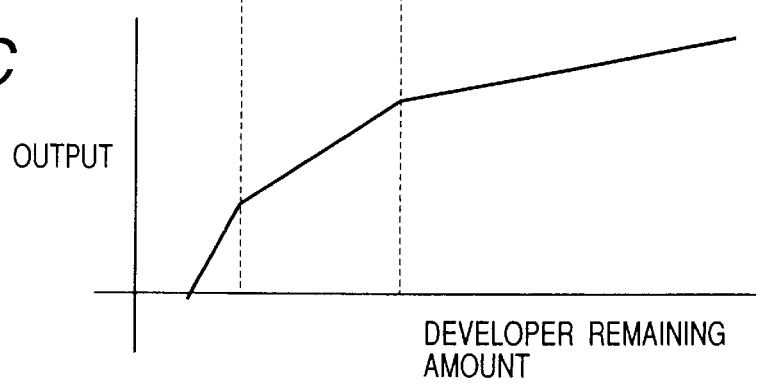

Referring to FIGS. 50A, 50B and 50C, a transition of the capacitance with respect to the remaining amount of developer of the first developer remaining amount detecting means is shown in FIG. 50A, a transition of the capacitance with respect to the remaining amount of developer of the second developer remaining amount detecting means is shown in FIG. 50B, and a transition of the capacitance with respect to the remaining amount of developer of the combination of the first and second developer remaining amount detecting means is shown in FIG. 50C. In FIGS. 50A, 50B and 50C, portions where an output changes are detectable ranges.

As can be understood from FIGS. 50A, 50B and 50C, the developer remaining amount can be precisely detected at any time irrespective of a large or small value of the developer remaining amount by arranging two kinds of developer remaining amount detecting means and using a better detecting accuracy portion of these detecting means.

Figure 51:
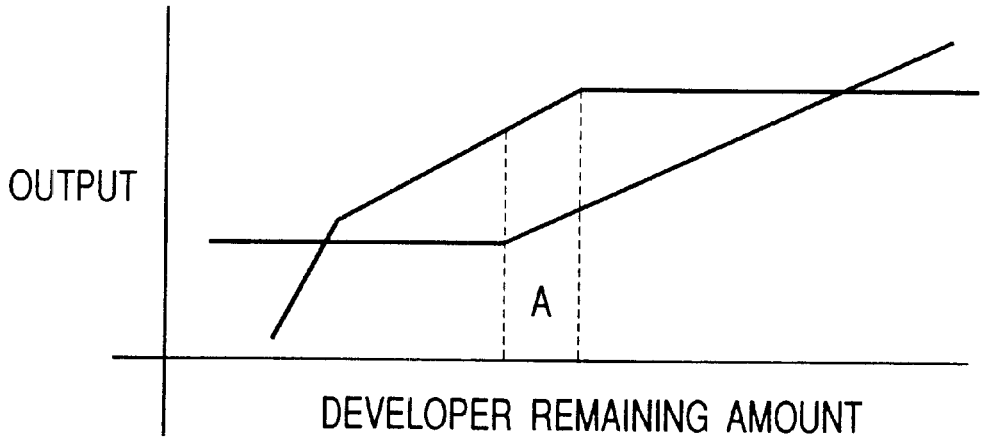
FIG. 51 is a graph for explaining the developer amount detecting principle in accordance with the present invention.

In this embodiment, an undetectable portion of one developer remaining amount detecting means is supplemented by a separate developer remaining amount detecting means. However, when an overlapping portion of detectable ranges shown by a portion A of FIG. 51 is formed by adjusting the position of a used electrode member, etc., the detection is not interrupted and can be mutually supplemented so that the developer remaining amount can be more accurately detected.

In this embodiment, the detecting accuracy is improved by using two kinds of developer remaining amount detecting means, but the number of these kinds is not limited to two. For example, similar effects can be also obtained by arranging plural developer remaining amount detecting means.

Seventh Embodiment

Figure 52:
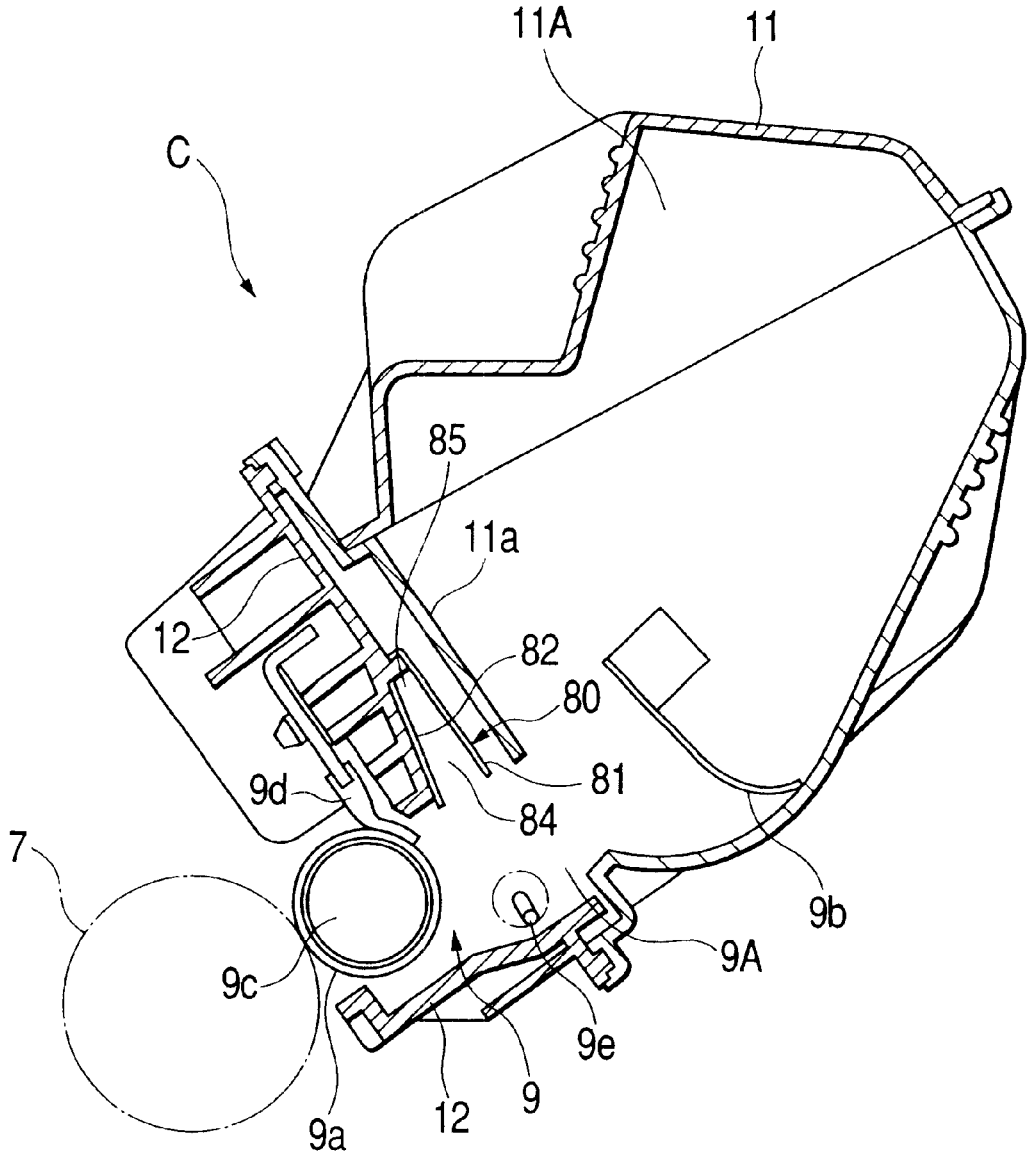
FIG. 52 is a longitudinal sectional view showing a developing apparatus having the developer amount detecting device in accordance with an embodiment of the present invention.

FIG. 52 shows one embodiment of a developing apparatus C formed as a cartridge in another mode of the present invention.

The developing apparatus C of this embodiment has a developer bearing member such as a developing roller 9*a*, and a developing chamber 9A. Toner is stored into the developing chamber 9A so as to supply a developer to this developer bearing member. The developer bearing member and the developing chamber 9A are integrally formed as a cartridge by a developing frame member 11 made of a plastic. Namely, in the developing apparatus C of this embodiment, a developing apparatus constructional portion of the process cartridge B explained in the fifth and sixth embodiments is formed as a unit. Namely, the developing apparatus C of this embodiment can be considered as a cartridge integrated by removing the photosensitive drum 7, the charging means 8 and the cleaning means 10 from the process cartridge B. Accordingly, all constructional portions of the developing apparatus and the construction of the developer amount detecting means explained in the fifth and sixth embodiments are similarly applied to the developing apparatus of this embodiment. Therefore, the above explanation made in the fifth and sixth embodiments is quoted in an explanation about these constructions and operations.

A third electrode 83 can be naturally similarly arranged in the developing apparatus of this embodiment.

In the developing apparatus C shown in FIG. 52, the developing apparatus constructional portion of the process cartridge B explained in the fifth and sixth embodiments is formed as a unit, and the developing apparatus constructional portion of the process cartridge B explained in the first to fourth embodiments is also formed as a unit. Namely, it is possible to form a developing apparatus formed as a cartridge by removing the photosensitive drum 7, the charging means 8 and the cleaning means 10 from the process cartridge B in the first to fifth embodiments.

Eighth Embodiment

In the above fifth to eighth embodiments, a system using a change in capacitance by arranging an electrode member is explained as the developer remaining amount detecting means. However, effects similar to those in the above embodiments can be also obtained by using the following systems, etc.

Figure 53B:
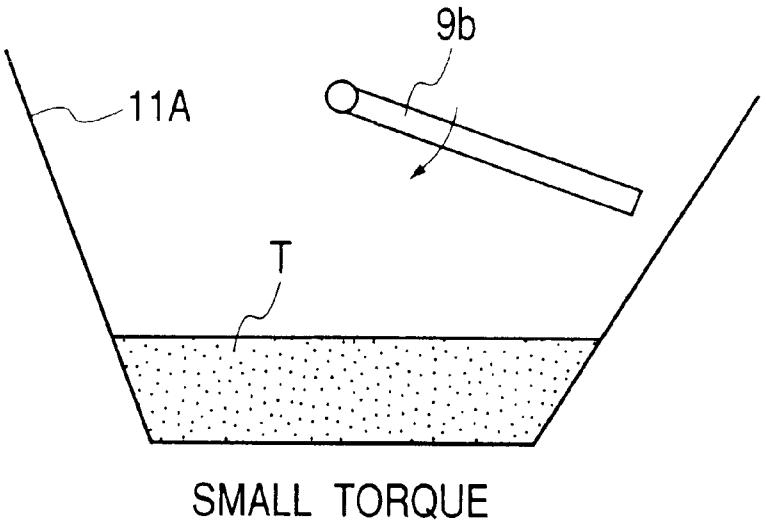
FIGS. 53A and 53B are schematic structural diagrams showing a developer remaining amount detecting means in accordance with another embodiment of the present invention.
Figure 53A:
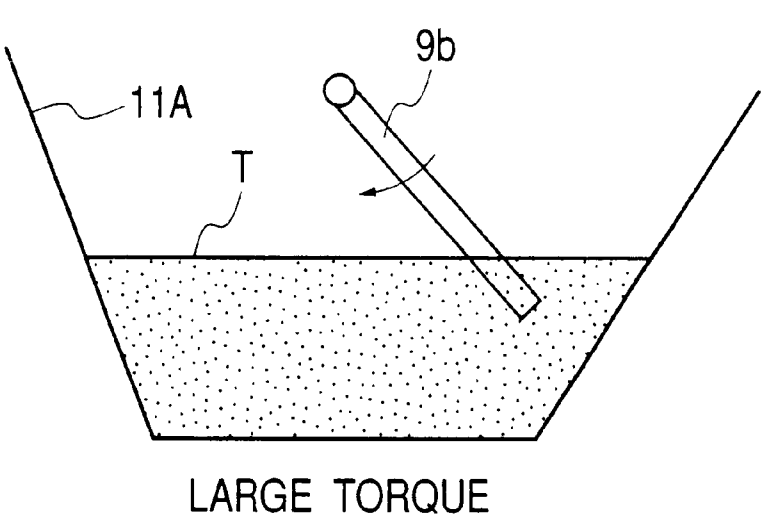

(1) A system as shown in FIGS. 53A and 53B in which the remaining amount of the developer within a developer container 11A is detected by reading a change in force applied to an agitating and conveying member 9*b* for agitating and conveying the developer T within the developing container 11A, or reading a change in torque, etc. when the developer is agitated and conveyed by rotation.

Figure 54B:
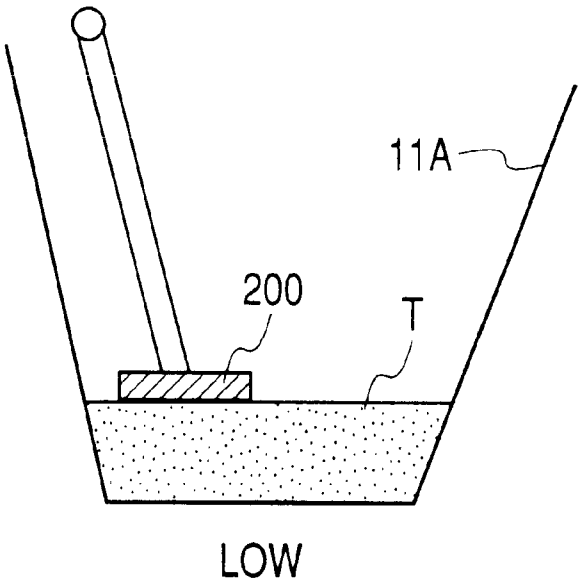
FIGS. 54A and 54B are schematic structural diagrams showing the developer remaining amount detecting means in accordance with another embodiment of the present invention.
Figure 54A:
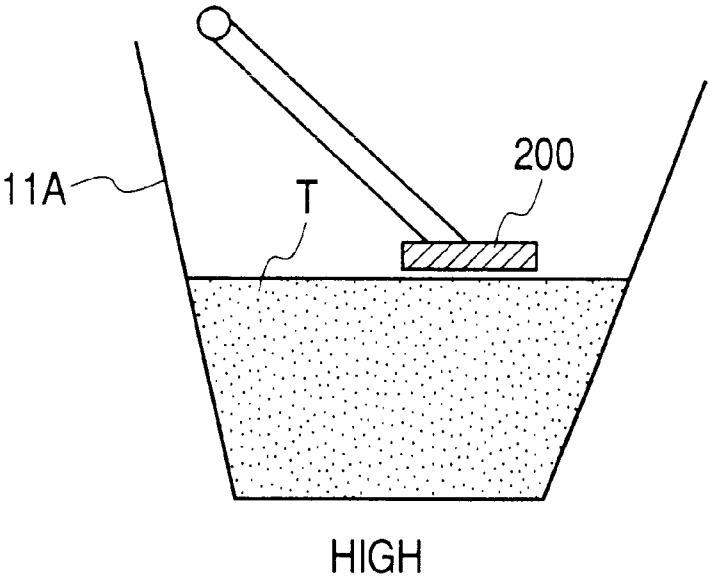

(2) A system as shown in FIGS. 54A and 54B in which an object 200 following the movement of an uppermost face of the developer T within the developer container 11A at any time is arranged, and the developer remaining amount is detected by measuring the height of this object 200.

(3) A system in which a depleted amount of the developer is presumed by an exposure means for forming an electrostatic latent image on the photosensitive drum 7, i.e., by accumulating a light emitting time of a laser, an LED, etc., and the developer remaining amount is detected by results of this presumption.

(4) A system in which the developer remaining amount is detected by the weight of the developer T remaining within the developer container 11A.

Figure 55:
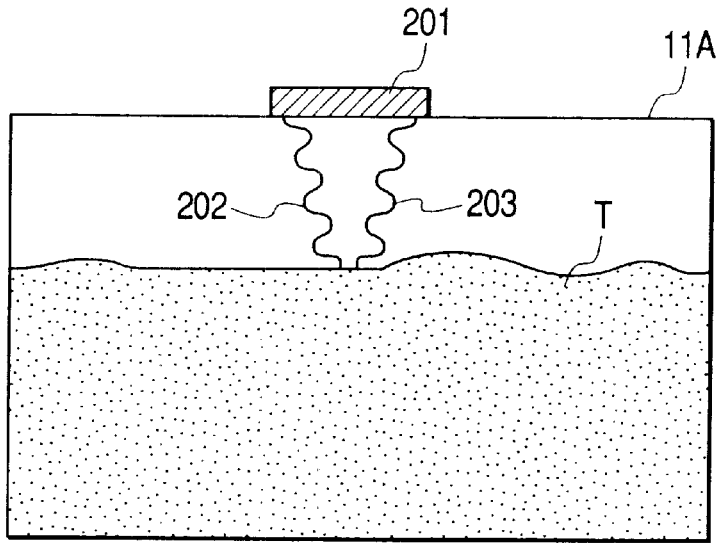
FIG. 55 is a schematic structural diagram showing the developer remaining amount detecting means in accordance with another embodiment of the present invention.

(5) A system as shown in FIG. 55 in which light 202 is irradiated onto a developer surface from a light-emitting and light-receiving element 201 arranged in the vicinity of an upper portion of the developer container 11A, and the remaining amount of the developer is detected by measuring the wavelength of reflected light 203 from the developer surface, a responsive time and a moving distance in a direction approximately perpendicular to an incident angle, or measuring the height of the developer surface from the frequency of a reflected sound wave, etc. when the sound wave is used instead of light.

(6) A system in which a coil is arranged within the developer container 11A and the remaining amount of the developer is detected by utilizing that magnetic permeability is different in accordance with an amount of the developer passing through the interior of this coil.

(7) A system in which the remaining amount of the developer is successively detected as a dummy amount by arranging plural means described in the above (1) to (6).

In the system described in the above (3), the developer remaining amount can be detected at any time irrespective of a large or small value of the developer remaining amount, but no accuracy of the developer remaining amount detecting means is so high. In this system, an accumulating value of an exposure time of the exposure means is used as an index of a detecting value of the developer remaining amount. When the developer remaining amount is large, it is considered that no user's request for the detecting accuracy is high. Therefore, there is no problem in the detecting accuracy, and cost is low in comparison with the other means.

Accordingly, when the system of the above (3) is adopted as a first developer remaining amount detecting means and a second developer remaining amount detecting means uses, for example, the second developer remaining amount detecting means used in the above fifth, sixth embodiments, etc. and able to achieve high precision detection at the time of a small developer remaining amount considered high in the user's request, it is considered that this construction has a merit in the user in view showing balance of the detecting accuracy and cost. Namely, it is necessary to increase the detecting accuracy at the small developer remaining amount time in view showing the balance of the detecting accuracy and cost.

In accordance with the present invention explained in accordance with each of the above first to eighth embodiments, the remaining developer amount can be detected precisely and successively.

Figure 56:
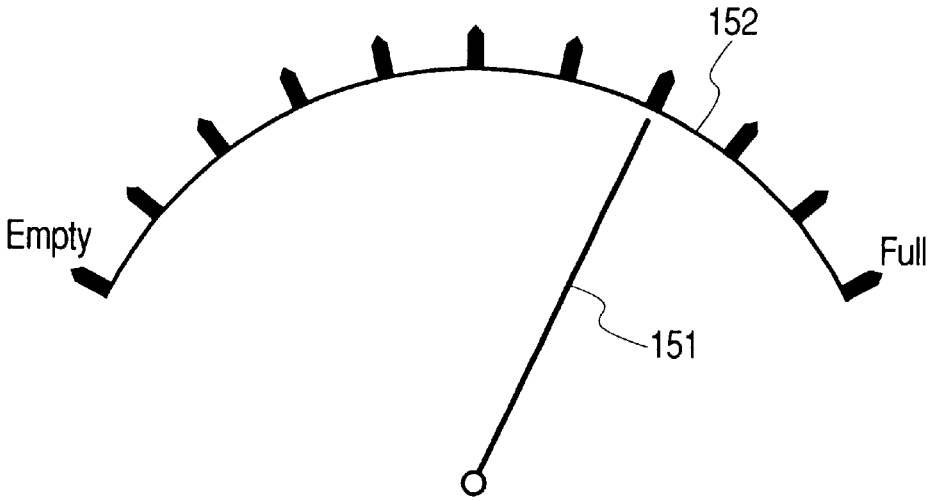
FIG. 56 is a view showing a developer amount indication in accordance with an embodiment of the present invention.
Figure 57:
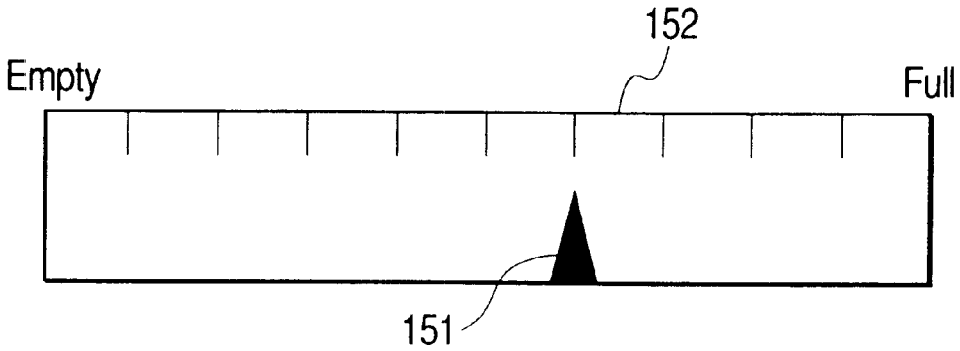
FIG. 57 is a view showing the developer amount indication in accordance with another embodiment of the present invention.

Developer remaining amount information from a developer amount detecting device is displayed by a developer amount display means. A developer amount display method will next be explained. For example, information detected by the above developer amount detecting device is displayed on the terminal screen of a user's personal computer, etc. as shown in FIGS. 56 and 57. In FIGS. 56 and 57, the developer amount is reported and known to the user by a pointing portion of a gauge 152 pointed by a pointer 151 moved in accordance with the developer amount.

Figure 58:
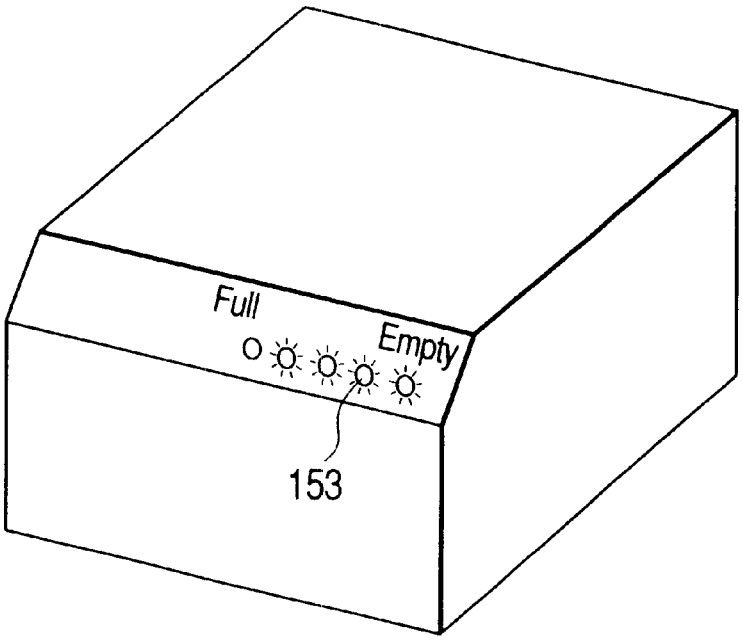
FIG. 58 is a view showing the developer amount indication in accordance with another embodiment of the present invention.

As shown in FIG. 58, a indicating portion of an LED, etc. may be directly arranged in a main body of the electrophotographic image forming apparatus, and the LED 153 may be turned on and off in accordance with the developer amount.

The present invention is not limited to a case in which the developer amount is successively detected in an entire area from 100% to 0% when the amount of the developer stored within the container is first set to 100%. For example, the remaining amount of the developer within the container may be successively detected in an area from 50% to 0%. Here, the developer remaining amount of 0% does not mean only that the developer is perfectly lost. For example, the developer remaining amount of 0% also includes that the developer is left within the container, but the remaining amount of the developer is reduced to such an extent that no predetermined image quality (developing quality) is obtained.

As explained above, plural (N) developer remaining amount detecting means for successively detecting the developer remaining amount within the developer container are arranged in the developing apparatus, the process cartridge, the electrophotographic image forming apparatus and the developer amount detecting method in the present invention. Accordingly, the present invention has the following effects.

(1) The developer remaining amount can be detected accurately and precisely by a simple structure from a full storing state of the developer to a near end state just before a defect in printing even in a developing apparatus or a process cartridge of long life. Further, convenience of a user in use of the apparatus can be improved and cost is low.

(2) A depleted state of the developer can be accurately monitored even when the apparatus is used by plural persons and a print job on a large scale is made. An exchanging period of the developing apparatus or the process cartridge can be accurately grasped. Further, convenience of a user in use of the apparatus can be improved and cost is low.

As explained above, in accordance with the present invention, the developer amount can be detected successively and accurately.

While the invention has been described with reference to the structures disclosed herein, it is not confined to the details set forth and this application is intended to cover such modifications or changes as may come within the purposes of the improvements or the scope of the following claims.

What is claimed is:

1. A developer amount detecting method of detecting an amount of developer for developing an electrostatic latent image formed on an electrophotographic photosensitive member, said method comprising:

a first process for successively detecting the amount of developer contained in a containing portion by counting a number of individual image signals for forming dots of an image by a main body of an electrophotographic image forming apparatus; and a second process for successively detecting said amount of developer by said apparatus main body by transmitting an electric signal according to the amount of developer contained in said containing portion to said apparatus main body.

2. A developer amount detecting method according to claim 1, wherein the electric signal according to capacitance is transmitted to said apparatus main body through an electric contact in said second process.

3. A developer amount detecting method according to claim 1, wherein the electric signal according to a rotating torque of a rotating member arranged within said containing portion is transmitted to said apparatus main body in said second process.

4. A developer amount detecting method according to any one of claims 1, 2 and 3, wherein said containing portion is arranged to contain said developer into a developing device for developing the electrostatic latent image formed on said electrophotographic photosensitive member, or said containing portion is arranged to contain said developer into a process cartridge integrally having said electrophotographic photosensitive member and said developing device and detachably mountable to said apparatus main body.

5. An electrophotographic image forming apparatus for forming an image on a recording medium, said apparatus comprising:

a developing member for developing an electrostatic latent image formed on an electrophotographic photosensitive member by using a developer;

a containing portion for containing said developer;

first means for successively detecting an amount of developer contained in said containing portion by counting a number of individual image signals for forming dots of an image by an apparatus main body; and second means for successively detecting said amount of developer by said apparatus main body by transmitting an electric signal according to the amount of developer contained in said containing portion to said apparatus main body.

6. An electrophotographic image forming apparatus according to claim 5, wherein said second means transmits the electric signal according to capacitance to said apparatus main body through an electric contact, and said developer amount is successively detected by said apparatus main body.

7. An electrophotographic image forming apparatus according to claim 5, wherein said second means transmits the electric signal according to a rotating torque of a rotating member arranged within said containing portion to said apparatus main body, and said amount of developer is successively detected by said apparatus main body.

8. An electrophotographic image forming apparatus according to any one of claims 5, 6 and 7, wherein said containing portion is arranged to contain said developer into a developing device for developing the electrostatic latent image formed on said electrophotographic photosensitive member, or said containing portion is arranged to contain said developer into a process cartridge integrally having said electrophotographic photosensitive member and said developing device and detachably mountable to said apparatus main body.

9. A developing device mounted to a main body of an electrophotographic image forming apparatus, said developing device comprising:

a developing member for developing an electrostatic latent image formed on an electrophotographic photosensitive member by using a developer;

a containing portion for containing said developer; and a detecting member for successively detecting an amount of developer contained in said containing portion by said apparatus main body by transmitting an electric signal according to the amount of developer contained in said containing portion to said apparatus main body after the amount of developer contained in said containing portion is successively detected by counting a number of individual image signals for forming dots of an image by said apparatus main body.

10. A developing device according to claim 9, wherein said detecting member transmits the electric signal according to capacitance to said apparatus main body through an electric contact.

11. A developing device according to claim 9, wherein said detecting member transmits the electric signal according to a rotating torque of a rotating member arranged within said containing portion to said apparatus main body.

12. A process cartridge detachably mountable to a main body of an electrophotographic image forming apparatus, said process cartridge comprising:

an electrophotographic photosensitive member;

a developing member for developing an electrostatic latent image formed on an electrophotographic photosensitive member by using a developer;

a containing portion for containing said developer; and a detecting member for successively detecting an amount of developer contained in said containing portion by said apparatus main body by transmitting an electric signal according to the amount of developer contained in said containing portion to said apparatus main body after the amount of developer contained in said containing portion is successively detected by counting a number of individual image signals for forming dots of an image by said apparatus main body.

13. A process cartridge according to claim 12, wherein said detecting member transmits the electric signal according to capacitance to said apparatus main body through an electric contact.

14. A process cartridge according to claim 12, wherein said detecting member transmits the electric signal according to a rotating torque of a rotating member arranged within said containing portion to said apparatus main body.

15. A developer amount detecting method of defecting an amount of developer for developing an electrostatic latent image formed on an electrophotographic photosensitive member, said method comprising:

a first process for successively detecting the amount of developer contained in a containing portion; and a second process for successively detecting the amount of developer contained in said containing portion, wherein a detectable range of the amount of developer to be detected by said second process is narrower than that by said first process, and the amount of developer contained in said containing portion in said second process is smaller than that in said first process.

16. A developer amount detecting method according to claim 15, wherein the amount of developer contained in said containing portion is successively detected by counting a number of individual image signals for forming dots of an image in said first process.

17. A developer amount detecting method according to claim 15, wherein the amount of developer contained in said containing portion is successively detected by transmitting an electric signal according to capacitance to an apparatus main body through an electric contact in said second process.

18. A developer amount detecting method according to claim 15, wherein the amount of developer contained in said containing portion is successively detected by transmitting an electric signal according to a rotating torque of a rotating member arranged within said containing portion to an apparatus main body in said second process.

19. A developer amount detecting method according to any one of claims 15, 16, 17 and 18, wherein said containing portion is arranged to contain said developer into a developing device for developing the electrostatic latent image formed on said electrophotographic photosensitive member, or said containing portion is arranged to contain said developer into a process cartridge integrally having said electrophotographic photosensitive member and said developing device and detachably mountable to an apparatus main body.

20. A developer amount detecting method according to claim 19, wherein a minimum developer remaining amount at which a detection of the amount of the developer is started in said second process is larger than a maximum developer remaining amount at which the amount of the developer is judged as nonexistence or undetectable in said first process.

21. An electrophotographic image forming apparatus for forming an image on a recording medium, said apparatus comprising:

a developing member for developing an electrostatic latent image formed on an electrophotographic photosensitive member by using a developer;

a containing portion for containing said developer;

first detecting means for successively detecting an amount of developer contained in said containing portion; and second detecting means for successively detecting the amount of developer contained in said containing portion after the first detecting means, wherein a detectable range of the amount of developer to be detected by said second detecting means is narrower than that by said first detecting means.

22. An electrophotographic image forming apparatus according to claim 21, wherein said first detecting means successively detects the amount of developer contained in said containing portion by counting a number of individual image signals for forming dots of an image.

23. An electrophotographic image forming apparatus according to claim 21, wherein said second detecting means is arranged in a developing device having said developing member and said containing portion and detachably mountable to a main body of said image forming apparatus, or is arranged in a process cartridge having said electrophotographic photosensitive member, said developing member and said containing portion and detachably mountable to said apparatus main body, and said second detecting means transmits an electric signal according to capacitance to said apparatus main body through an electric contact, and successively detects said amount of developer by said apparatus main body.

24. An electrophotographic image forming apparatus according to claim 21, wherein said second detecting means is arranged in a developing device having said developing member and said containing portion and detachably mountable to a main body of said image forming apparatus, or is arranged in a process cartridge having said electrophotographic photosensitive member, said developing member and said containing portion and detachably mountable to said apparatus main body, and said second detecting means transmits an electric signal according to a rotating torque of a rotating member arranged within said containing portion to said apparatus main body, and successively detects said amount of developer by said apparatus main body.

25. An electrophotographic image forming apparatus according to claim 21, wherein a minimum developer remaining amount at which said second detecting means starts a detection of the amount of the developer is larger than a maximum developer remaining amount at which said first developer remaining amount judges the amount of developer is nonexistence or undetectable.

26. A developing device mounted to a main body of an electrophotographic image forming apparatus, said developing device comprising:

a developing member for developing an electrostatic latent image formed on an electrophotographic photosensitive member by using a developer;

a containing portion for containing said developer; and second detecting means for successively detecting an amount of developer contained in said containing portion by said apparatus main body by transmitting an electric signal according to the amount of developer contained in said containing portion to said apparatus main body after the amount of developer contained in said containing portion is successively detected by first detecting means arranged in said apparatus main body.

27. A developing device according to claim 26, wherein said first detecting means successively detects the amount of developer contained in said containing portion by counting a number of individual image signals for forming dots of an image.

28. A developing device according to claim 26, wherein said second detecting means successively detects the amount of developer contained in said containing portion by transmitting an electric signal according to capacitance to said apparatus main body through an electric contact.

29. A developing device according to claim 26, wherein said second detecting means successively detects the amount of developer contained in said containing portion by transmitting an electric signal according to a rotating torque of a rotating member arranged within said containing portion to said apparatus main body.

30. A developing device according to any one of claims 26, 27, 28 and 29, wherein a detectable range of the amount of developer to be detected by said second detecting means is narrower than that by said first detecting means.

31. A developing device according to claim 30, wherein a minimum developer remaining amount at which said second detecting means starts a detection of the amount of the developer is larger than a maximum developer remaining amount at which said first developer remaining amount judges that the amount of developer is nonexistence or undetectable.

32. A process cartridge detachably mountable to a main body of an electrophotographic image forming apparatus, said process cartridge comprising:

an electrophotographic photosensitive member;

a developing member for developing an electrostatic latent image formed on an electrophotographic photosensitive member by using a developer;

a containing portion for containing said developer; and second detecting means for successively detecting an amount of developer contained in said containing portion by said apparatus main body by transmitting an electric signal according to the amount of developer contained in said containing portion to said apparatus main body after the amount of developer contained in said containing portion is successively detected by first detecting means arranged in said apparatus main body.

33. A process cartridge according to claim 32, wherein said first detecting means successively detects the amount of developer contained in said containing portion by counting a number of individual image signals for forming dots of an image.

34. A process cartridge according to claim 32, wherein said second detecting means successively detects the amount of developer contained in said containing portion by transmitting an electric signal according to capacitance to said apparatus main body through an electric contact.

35. A process cartridge according to claim 32, wherein said second detecting means successively detects the amount of developer contained in said containing portion by transmitting an electric signal according to a rotating torque of a rotating member arranged within said containing portion to said apparatus main body.

36. A process cartridge according to any one of claims 32, 33, 34, and 35, wherein a detecting accuracy of said second detecting means is higher than that of said first detecting means.

37. A process cartridge according to claim 36, wherein a minimum developer remaining amount at which said second detecting means starts a detection of the amount of the developer is larger than a maximum developer remaining amount at which said first developer remaining amount judges that the amount of developer is nonexistence or undetectable.

38. An image forming system, comprising:

a plurality of developer remaining amount detecting means for detecting a parameter pertaining to a used amount of toner or a remaining amount of toner within a toner container to successively detect the remaining amount of toner, wherein said plurality of developer remaining amount detecting means each independently transmits an electric signal representative of said parameter to an image forming apparatus main body so that the image forming apparatus main body successively detects the remaining amount of toner.

39. An image forming system according to claim 38, wherein said image forming system comprises said image forming apparatus main body and a developing device detachably mountable on said apparatus main body, and wherein all of said plurality of developer remaining amount detecting means are disposed in said developing device.

40. An image forming system according to claim 38, wherein said image forming system comprises said image forming apparatus main body and a developing device detachably mountable on said main body, and wherein all of said plurality of developer remaining amount detecting means are disposed in said apparatus main body.

41. An image forming system according to claim 38, wherein said image forming system comprises said image forming apparatus main body and a developing device detachably mountable on said apparatus main body, and wherein a part of said plurality of developer remaining amount detecting means are disposed in said developing device, and another part of said plurality of developer remaining amount detecting means are disposed in said apparatus main body.

42. An image forming system according to claim 38, wherein at least one of said parameters comprises a capacitance between electrodes between which the toner is interposed.

43. An image forming system according to claim 38, wherein said parameter comprises at least a count value of a number of image signals for forming dots.

44. An image forming system according to claim 38, wherein said parameter comprises at least an agitating torque of the developer.

45. An image forming system according to claim 38, wherein as the remaining amount of toner decreases, developer remaining amount detecting means with a more high precision is selected among the plurality of developer remaining amount detecting means, to carry out a detection.

46. An image forming system according to any one of claims 39 to 41, wherein said developing device and an electrophotographic photosensitive drum are integrated into a unit as a process cartridge.

47. A process cartridge detachably mountable to a main body of an electrophotographic image forming apparatus, said process cartridge comprising:

an electrophotographic photosensitive member;

a developer roller for developing an electrostatic latent image formed on said photosensitive member with developer;

a first detecting member for outputting an electric signal corresponding to a capacitance to said main body so that said main body successively detects a remaining amount of the developer; and a second detecting member, disposed nearer said developing roller than said first detecting member, for outputting an electric signal corresponding to a capacitance to said main body so that said main body successively detects a remaining amount of the developer, wherein said first detecting member and said second detecting member transmit respective electric signals independently of one another to said main body.

48. A process cartridge according to claim 47, wherein a developer amount detecting region of said first detecting member is overlapped with a developer amount detecting region of said second detecting member.

49. A process cartridge according to claim 47, wherein said first detecting member comprises:

(a) a measuring electrode member provided with an input side and an output side electrodes having at least one pair of portions juxtaposed at a predetermined interval, said measuring electrode member being disposed in a position in which said measuring electrode member is in contact with the developer; and (b) a reference electrode member provided with an input side and an output side electrodes having at least one pair of portions juxtaposed at a predetermined interval, said reference electrode member being disposed in a position in which said reference electrode member is out of contact with the developer.

50. A process cartridge according to claim 49, wherein said measuring electrode member and said reference electrode member comprise electrodes patterns formed on one surface of one substrate.

51. A process cartridge according to claim 47 or 49, wherein said second detecting member comprises a first electrode and a second electrode opposed to each other and disposed along a longitudinal direction of said developing roller, and wherein when a voltage is applied to one of said first and second electrodes, said second detecting member outputs the electric signal representative of an amount of the developer existing between said first and second electrodes.

52. A process cartridge according to claim 47 or 49, wherein said second detecting member comprises said developing roller and an electrode opposed to said developing roller and disposed along a longitudinal direction of said developing roller, and wherein when a voltage is applied to said developing roller, said second detecting member outputs the electric signal representative of an amount of the developer existing between said developing roller and said electrode.

53. A process cartridge according to claim 51, wherein said first and second electrodes are made of metal.

54. A process cartridge detachably mountable to a main body of an electrophotographic image forming apparatus, said process cartridge comprising:

an electrophotographic photosensitive member;

a developing roller for developing an electrostatic latent image formed on said photosensitive member with developer;

a first detecting member for outputting an electric signal corresponding to a capacitance to said main body so that said main body successively detects a remaining amount of the developer, wherein said first detecting member comprises:

(a) a measuring electrode member provided with an input side and an output side electrodes having at least one pair of portions juxtaposed at a predetermined interval, said measuring electrode member being disposed in a position in which said measuring electrode member is in contact with the developer; and (b) a reference electrode member provided with an input side and an output side electrodes having at least one pair of portions juxtaposed at a predetermined interval, said reference electrode member being disposed in a position in which said reference electrode member is out of contact with the developer; and a second detecting member, disposed nearer said developing roller than said first detecting member, for outputting an electric signal corresponding to a capacitance to said main body so that said main body successively detects a remaining amount of the developer, wherein said second detecting member comprises a first electrode and a second electrode opposed to each other and disposed along a longitudinal direction of said developing roller, and wherein when a voltage is applied to one of said first and second electrodes, said second detecting member outputs the electric signal representative of an amount of the developer existing between said first and second electrodes.

55. A process cartridge according to claim 54, wherein a developer amount detecting region of said first detecting member is overlapped with a developer amount detecting region of said second detecting member.

56. A process cartridge according to claim 54 or 55, wherein said first detecting member and said second detecting member transmit respective electric signals independently of one another to said main body.

57. A process cartridge according to claim 54, wherein said second detecting member further comprises said developing roller and a third electrode opposed to said developing roller and disposed along a longitudinal direction of said developing roller, and wherein when a voltage is applied to said developing roller, said second detecting member outputs the electric signal representative of an amount of the developer existing between said developing roller and said third electrode.

58. A process cartridge according to claim 57, wherein said first and second electrodes are made of metal.

59. A process cartridge detachably mountable to a main body of an electrophotographic image forming apparatus, said process cartridge comprising:

an electrophotographic photosensitive member;

a developing roller for developing an electrostatic latent image formed on said photosensitive member with developer;

a first detecting member for outputting an electric signal corresponding to a capacitance to said main body so that said main body successively detects a remaining amount of the developer, wherein said first detecting member comprises:

(a) a measuring electrode member provided with an input side and an output side electrodes having at least one pair of portions juxtaposed at a predetermined interval, said measuring electrode member being disposed in a position in which said measuring electrode member is in contact with the developer; and (b) a reference electrode member provided with an input side and an output side electrodes having a least one pair of portions juxtaposed at a predetermined interval, said reference electrode member being disposed in a position in which said reference electrode member is out of contact with the developer; and a second detecting member, disposed nearer said developing roller than said first detecting member, for outputting an electric signal corresponding to a capacitance to said main body so that said main body successively detects a remaining amount of the developer, wherein said second detecting member comprises a first electrode and a second electrode opposed to each other an disposed along a longitudinal direction of said developing roller, and wherein when a voltage is applied to one of said first and second electrodes, said second detecting member outputs the electric signal representative of an amount of the developer existing between said first and second electrodes, wherein a developer amount detecting region of said first detecting member is overlapped with a developer amount detecting region of said second detecting member, and wherein said first detecting member and said second detecting member transmit respective electric signals independently of one another to said main body.

60. A process cartridge according to claim 59, wherein said second detecting member further comprises said developing roller and a third electrode opposed to said developing roller and disposed along a longitudinal direction of said developing roller, and wherein when a voltage is applied to said developing roller, said second detecting member outputs the electric signal representative of an amount of the developer exiting between said developing roller and said third electrode.

61. A process cartridge according to claim 59, wherein said first and second electrodes are made of metal.

62. An electrophotography image forming apparatus to which a process cartridge is detachably mountable for forming an image on an a recording medium, said electrophotographic image forming apparatus comprising:

(a) a mounting portion for detachably mounting said process cartridge, said process cartridge comprising:

an electrophotographic photosensitive member;

a developing roller for developing an electrostatic latent image formed on a said photosensitive member with developer;

a first detecting member for outputting an electric signal corresponding to a capacitance to a main body of said electrophotographic image forming apparatus so that said main body successively detects a remaining amount of the developer; and a second detecting member, disposed nearer said developing roller than said first detecting member, for outputting an electric signal corresponding to a capacitance to said main body so that said main body successively detects a remaining amount of the developer, wherein said first detecting member and said second detecting member transmit respective electric signals independently of one another to said main body; and (b) an output portion for outputting developer remaining amount information for indicating an amount of developer by receiving the electric signal from said first detecting member and the electric signal from said second detecting member of said process cartridge mounted on said mounting region.

63. An electrophotographic image forming apparatus to which a process cartridge is detachably mountable for forming an image on a recording medium, said electrophotographic image forming apparatus comprising:

(a) a mounting portion for detachably mounting said process cartridge, said process cartridge comprising:

an electrophotographic photosensitive member;

a developing roller for developing an electrostatic latent image formed on said photosensitive member with developer;

a first detecting member for outputting an electric signal corresponding to a capacitance to a main body of said electrophotographic image forming apparatus so that said main body successively detects a remaining amount of the developer, wherein said first detecting member comprises:

(i) a measuring electrode member provided with an input side and an output side electrodes having at least one pair of portions, juxtaposed at a predetermined intervals, said measuring electrode member being disposed in a position in which said measuring electrode member is in contact with the developer; and (ii) a reference electrode member provided with an input side and an output side electrodes having at least one pair of portions juxtaposed at a predetermined interval, said reference electrode member being disposed in a position in which said reference electrode member is out of contact with the developer; and a second detecting member, disposed nearer said developing roller than said first detecting member, for outputting an electric signal corresponding to a capacitance to said main body so that said main body successively detects a remaining amount of the developer, wherein said second detecting member comprises a first electrode and a second electrode opposed to each other and disposed along a longitudinal direction of said developing roller, and wherein when a voltage is applied to one of said first and second electrodes, said second detecting member outputs the electric signal representative of an amount of the developer existing between said first and second electrodes; and (b) output portion for outputting developer remaining amount information for indicating an amount of developer by receiving the electric signal from said first detecting member and the electric signal from said second detecting member of said process cartridge mounted on said mounting portion.

64. An electrophotographic image forming apparatus to which a process cartridge is detachably mountable for forming an image on a recording medium, said electrophotographic image forming apparatus comprising:

(a) a mounting portion for detachably mounting aid process cartridge, said process cartridge comprising:

an electrophotographic photosensitive member;

a developing roller for developing an electrostatic latent image formed on said photosensitive member with developer;

a first detecting member for outputting an electric signal corresponding to a capacitance to a main body of said electrophotographic image forming apparatus so that said main body successively detects a remaining amount of the developer, wherein said first detecting member comprises:

(i) a measuring electrode member provided with an input side and an output side electrodes having at least one pair of portions juxtaposed at a predetermined interval, said measuring electrode member being disposed in a position in which said measuring electrode member is in contact with the developer; and (ii) a reference electrode member provided with an input side and an output side electrodes having at least one pair of portions juxtaposed at a predetermined interval, said reference electrode member being disposed in a position in which said reference electrode member is out of contact with the developer; and a second detecting member, disposed nearer said developing roller than said first detecting member, for outputting an electric signal corresponding to a capacitance to said main body so that said main body successively detects a remaining amount of the developer, wherein said second detecting member comprises a first electrode and a second electrode opposed to each other and disposed along a longitudinal direction of said developing roller, and wherein when a voltage is applied to one of said first and second electrodes, said second detecting member outputs the electric signal representative of an amount of the developer existing between said first and second electrodes, wherein a developer amount detecting region of said first detecting member is overlapped with a developer amount detecting region of said second detecting member, and wherein said first detecting member and said second detecting member transmit respective electric signals independently of one another to said main body; and (b) output portion for outputting developer remaining amount information for indicating an amount of developer by receiving the electric signal from said first detecting member and the electric signal from said second detecting member of said process cartridge mounted on said mounting portion.

65. An electrophotographic image forming apparatus according to claim 62, 63, or 64, wherein the remaining amount of the developer is displayed in a screen of a computer based on said developer remaining amount information output from said output portion.

66. An electrophotographic image forming apparatus according to claim 62, 63, or 64, wherein the remaining amount of the developer is indicated in an indicating portion of said main body based on said developer remaining amount information output from said output portion.

* * * * *

UNITED STATES PATENT AND TRADEMARK OFFICE

CERTIFICATE OF CORRECTION

PATENT NO. : 6,397,017 B1
DATED : May 28, 2002
INVENTOR(S) : Hiroaki Sakai et al.

It is certified that error appears in the above-identified patent and that said Letters Patent is hereby corrected as shown below:

Title page,
Item [56], References Cited, U.S. PATENT DOCUMENTS,
"5,790.923" should read -- 5,790,923 --.
"5,966,566" should read -- 5,966,566 --.

Column 1,
Line 57, "the" (second occurrence) should be deleted.

Column 2,
Line 33, "a" (second and third occurrences) should be deleted.
Line 46, "scrapped" should read -- scraped --.

Column 3,
Line 42, "little" should read -- small --.

Column 4,
Line 61, "uselessness" should read -- problems --.

Column 18,
Line 42, "member" should read -- members --.

Column 21,
Line 3, "scrapped" should read -- scraped --.

Column 22,
Line 41, "scrapped" should read -- scraped --.

Column 23,
Line 9, "scrapped" should read -- scraped --.

Column 33,
Line 41, "of defecting" should read -- for detecting --.

Column 35,
Line 15, "nonexistence" should read -- nonexistent --.

UNITED STATES PATENT AND TRADEMARK OFFICE

CERTIFICATE OF CORRECTION

PATENT NO. : 6,397,017 B1
DATED : May 28, 2002
INVENTOR(S) : Hiroaki Sakai et al.

It is certified that error appears in the above-identified patent and that said Letters Patent is hereby corrected as shown below:

Column 36,
Line 29, "detecting accuracy of" should read -- detectable range of the amount of developer to be detected by --.
Line 30, "higher" should read -- narrower -- and "of" should read -- by --.
Line 36, "nonexistence" should read -- nonexistent --.
Line 62, "are" should read -- is --.

Column 37,
Lines 2 and 4, "are" should read -- is --.
Lines 52, 53, 58 and 59, "an" should be deleted.

Column 39,
Lines 22, 23, 29 and 30, "an" should be deleted.
Line 43, "an" should read -- and --.

Column 40,
Line 1, "an a" should read -- a --.

Column 41,
Line 16, "aid" should read -- said --.
Lines 28, 29, 35 and 36, "an" should be deleted.

Signed and Sealed this

Fifteenth Day of July, 2003

JAMES E. ROGAN
*Director of the United States Patent and Trademark Office*